US005887655A

United States Patent [19]

Haugen et al.

[11] Patent Number: 5,887,655

[45] Date of Patent: Mar. 30, 1999

[54] WELLBORE MILLING AND DRILLING

[75] Inventors: David M. Haugen, League City; William A. Blizzard, Jr., Houston; Mark W. Schnitker, Friendswood; Steve R. Delgado; Thurman B. Carter, both of Houston; John D. Roberts, Spring; Joseph D. Mills, Houston; Frederick T. Tilton, Spring; Paul J. Johantges, Deer Park; Charles W. Pleasants, Cypress, all of Tex.

[73] Assignee: Weatherford/Lamb, Inc, Houston, Tex.

[21] Appl. No.: 790,543

[22] Filed: Jan. 30, 1997

Related U.S. Application Data

[63] Continuation-in-part of Ser. No. 673,791, Jun. 27, 1996, abandoned, Ser. No. 642,118, May 2, 1996, and Ser. No. 752,359, Nov. 19, 1996, Pat. No. 5,787,978, which is a continuation-in-part of Ser. No. 655,087, Jun. 3, 1996, Pat. No. 5,620,051, which is a division of Ser. No. 414,338, Mar. 31, 1995, Pat. No. 5,522,461, and a continuation-in-part of Ser. No. 542,439, Oct. 12, 1995, Pat. No. 5,720,349, said Ser. No. 673,791, is a continuation-in-part of Ser. No. 210,697, Mar. 18, 1994, Pat. No. 5,429,187, and a division of Ser. No. 414,201, Mar. 31, 1995, Pat. No. 5,531,271, which is a continuation-in-part of Ser. No. 300,917, Sep. 6, 1994, Pat. No. 5,425,417, which is a continuation-in-part of Ser. No. 225,384, Apr. 4, 1994, Pat. No. 5,409,060, which is a continuation-in-part of Ser. No. 119,813, Sep. 10, 1993, Pat. No. 5,452,759.

[51] Int. Cl.[6] ..... E21B 29/00

[52] U.S. Cl. ..... 166/298; 160/50; 160/55.7; 175/425

[58] Field of Search ..... 166/297, 298, 166/50, 55, 55.7; 175/425

[56] References Cited

U.S. PATENT DOCUMENTS 1,387,447 8/1921 Alford .
1,454,048 5/1923 Esperson .

(List continued on next page.)

FOREIGN PATENT DOCUMENTS 80 303725 8/1980 European Pat. Off. .
2 307 704 6/1997 United Kingdom .

OTHER PUBLICATIONS

Drilling and completing multiple lateral sections from one borehole, Brockman et al, Offshore, May 1995, pp. 130, 132, 134.

Shell Expro's first application of coiled tubing drilling, World Oil, Jun. 1997, pp. 119–124.

WHIPCO Blast Stock, Whipstock, Inc., Composite Catalog 1970–71, pp. 4984–4986.

Red Baron Oil Tools Rental, 1989, pp. 2935–2936(19).

(List continued on next page.)

*Primary Examiner*—Roger Schoeppel
*Attorney, Agent, or Firm*—Guy McClung

[57] ABSTRACT

Wellbore operations (e.g. for milling and/or drilling) are disclosed which require a reduced number of tool trips into a wellbore to create a cut-out pocket, opening, or window in a tubular such as casing in the wellbore; and, in some aspects, to continue into a formation adjacent a main wellbore forming a lateral wellbore in communication with the main wellbore. Preferably one trip is required to complete a window or a window and the lateral wellbore. In one aspect a full gauge tool body is used so that the completed lateral wellbore is of a substantially uniform diameter along its entire length, which, in one aspect is suitable for the passage therethrough of full gauge tools, pipe, devices, and apparatuses. In one aspect a cutting system has cutting apparatus initially covered with a wearable away material which is worn away by contacting a tubular to be milled, exposing the cutting apparatus for milling and/or for drilling formation adjacent the wellbore. In certain aspects the lateral wellbore is: about one foot long; two feet long or less; five feet long or less; between five feet and fifty feet long; one hundred feet long or less; between about one hundred and about two hundred feet long; or two hundred or more feet long. In one aspect mill-drill tools are disclosed that both mill tubulars and drill formation.

31 Claims, 41 Drawing Sheets

U.S. PATENT DOCUMENTS

| | | | |
|---|---|---|---|
| 1,502,427 | 7/1924 | Getty . | |
| 1,522,593 | 1/1925 | Pickin . | |
| 1,532,330 | 4/1925 | Mitchell . | |
| 1,571,931 | 2/1926 | Church . | |
| 1,610,569 | 12/1926 | Maynard . | |
| 1,636,032 | 7/1927 | Abbott . | |
| 1,698,496 | 1/1929 | Gray . | |
| 1,727,563 | 9/1929 | Ross . | |
| 1,899,727 | 2/1933 | Sandstone . | |
| 2,124,414 | 7/1938 | Goldman . | |
| 2,203,747 | 6/1940 | Sandstone | 175/379 |
| 2,223,864 | 12/1940 | Zublin . | |
| 2,234,273 | 3/1941 | Pennington | 175/379 |
| 2,267,833 | 12/1941 | McMahan | 175/307 |
| 2,296,939 | 9/1942 | McMahan | 255/1 |
| 2,342,292 | 2/1944 | Morissette . | |
| 2,452,920 | 11/1948 | Gilbert | 166/50 |
| 2,485,826 | 10/1949 | Harinck . | |
| 2,543,861 | 3/1951 | Mader . | |
| 2,554,780 | 5/1951 | Goolsbee . | |
| 2,633,682 | 4/1953 | Jackson . | |
| 2,644,672 | 7/1953 | Mathews | 175/307 |
| 2,645,456 | 7/1953 | Thompson . | |
| 2,723,836 | 11/1955 | Fraser | 175/307 X |
| 2,754,090 | 7/1956 | Kammerer . | |
| 2,833,520 | 5/1958 | Owen . | |
| 2,855,994 | 10/1958 | Kammerer, Jr. . | |
| 2,877,998 | 3/1959 | Cameron et al. . | |
| 2,882,015 | 4/1959 | Beck . | |
| 3,066,749 | 12/1962 | Hildebrandt | 175/317 |
| 3,066,750 | 12/1962 | Hildebrandt | 175/329 |
| 3,147,536 | 9/1964 | Lamphere . | |
| 3,227,230 | 1/1966 | Lagerstrom | 175/214 |
| 3,295,617 | 1/1967 | Willis | 175/379 |
| 3,330,349 | 7/1967 | Owsley et al. | 166/117.5 |
| 3,343,615 | 9/1967 | Terry | 175/406 |
| 3,367,430 | 2/1968 | Rowley | 175/385 |
| 3,537,538 | 11/1970 | Generoux | 175/330 |
| 3,685,600 | 8/1972 | Lorenz et al. | 175/307 |
| 3,718,196 | 2/1973 | Lorenz et al. | 175/307 |
| 3,765,493 | 10/1973 | Rosar et al. | 175/319 |
| 3,788,407 | 1/1974 | Lorenz et al. | 175/307 |
| 3,908,759 | 9/1975 | Cagle et al. | 166/117.6 |
| 4,244,432 | 1/1981 | Rowley et al. | 175/329 |
| 4,253,533 | 3/1981 | Baker, III | 175/329 |
| 4,290,498 | 9/1981 | Triplett et al. | 175/379 |
| 4,359,335 | 11/1982 | Garner | 75/208 R |
| 4,396,075 | 8/1983 | Wood et al. | 175/79 |
| 4,396,077 | 8/1983 | Radtke | 175/329 |
| 4,397,361 | 8/1983 | Langford | 175/329 |
| 4,440,247 | 4/1984 | Sartor | 175/393 |
| 4,533,004 | 8/1985 | Ecer | 175/329 |
| 4,573,541 | 3/1986 | Josse et al. | 175/78 |
| 4,717,290 | 1/1988 | Reynolds et al. | 407/34 |
| 4,719,979 | 1/1988 | Jones | 175/329 |
| 4,766,040 | 8/1988 | Hillert et al. | 428/552 |
| 4,796,709 | 1/1989 | Lynde et al. | 166/55.6 |
| 4,797,138 | 1/1989 | Komanduri | 51/293 |
| 4,848,491 | 7/1989 | Burridge et al. | 175/329 |
| 4,887,668 | 12/1989 | Lynde et al. | 166/55.8 |
| 4,978,260 | 12/1990 | Lynde et al. | 166/55.6 |
| 5,004,057 | 4/1991 | Tibbitts et al. | 175/408 |
| 5,027,914 | 7/1991 | Wilson | 166/55.6 X |
| 5,038,859 | 8/1991 | Lynde et al. | 166/55.6 |
| 5,038,873 | 8/1991 | Jurgens | 175/246 |
| 5,058,666 | 10/1991 | Lynde et al. | 166/55.6 |
| 5,069,584 | 12/1991 | Obermeier et al. | 408/145 |
| 5,086,838 | 2/1992 | Cassel et al. | 166/55.6 |
| 5,109,924 | 5/1992 | Jurgens et al. | 166/117.5 |
| 5,150,755 | 9/1992 | Cassel et al. | 166/297 |
| 5,193,620 | 3/1993 | Braddick | 166/382 |
| 5,199,513 | 4/1993 | Stewart et al. | 175/73 |
| 5,275,374 | 1/1994 | Sievers et al. | 175/374 |
| 5,289,876 | 3/1994 | Graham | 166/276 |
| 5,289,889 | 3/1994 | Gearhart et al. | 175/325.5 |
| 5,301,760 | 4/1994 | Graham | 175/61 |
| 5,318,122 | 6/1994 | Murray et al. | 166/313 |
| 5,322,127 | 6/1994 | McNair et al. | 166/313 |
| 5,337,808 | 8/1994 | Graham | 166/191 |
| 5,341,873 | 8/1994 | Carter et al. | 166/117.5 |
| 5,353,876 | 10/1994 | Curington et al. | 166/313 |
| 5,361,859 | 11/1994 | Tibbitts | 175/286 |
| 5,373,900 | 12/1994 | Lynde et al. | 166/297 |
| 5,388,648 | 2/1995 | Jordan, Jr. | 166/380 |
| 5,423,387 | 6/1995 | Lynde | 175/61 |
| 5,425,417 | 6/1995 | Carter | 166/117.6 |
| 5,425,419 | 6/1995 | Sieber | 166/206 |
| 5,427,177 | 6/1995 | Jordan, Jr. et al. | 166/50 |
| 5,431,220 | 7/1995 | Lennon et al. | 166/55.7 |
| 5,435,400 | 7/1995 | Smith | 175/61 |
| 5,445,222 | 8/1995 | Pritchard et al. | 116/298 |
| 5,456,312 | 10/1995 | Lynde et al. | 166/55.6 |
| 5,458,209 | 10/1995 | Hayes et al. | 175/61 |
| 5,462,120 | 10/1995 | Gondovin | 166/380 |
| 5,467,819 | 11/1995 | Bradick | 166/117.6 |
| 5,474,126 | 12/1995 | Lynde et al. | 166/117.6 |
| 5,474,131 | 12/1995 | Jordan, Jr. et al. | 166/313 |
| 5,477,925 | 12/1995 | Trahan et al. | 166/382 |
| 5,522,461 | 6/1996 | Carter et al. | 166/298 |
| 5,526,880 | 6/1996 | Jordan, Jr. et al. | 166/291 |
| 5,531,271 | 7/1996 | Carter | 166/117.6 |
| 5,533,573 | 7/1996 | Jordan, Jr. et al. | 166/313 |
| 5,544,704 | 8/1996 | Laurel et al. | 166/117.6 |
| 5,551,509 | 9/1996 | Braddick | 166/55.7 |
| 5,564,503 | 10/1996 | Longbottom et al. | 166/313 |
| 5,566,763 | 10/1996 | Williamson et al. | 166/382 |
| 5,584,350 | 12/1996 | Schnitker et al. | 175/61 |
| 5,592,991 | 1/1997 | Lembcke et al. | 166/298 |
| 5,620,051 | 4/1997 | Carter et al. | 166/298 |
| 5,641,027 | 6/1997 | Foster | 175/107 |
| 5,647,436 | 7/1997 | Braddick | 166/298 |
| 5,647,437 | 7/1997 | Braddick et al. | 166/382 |
| 5,651,415 | 7/1997 | Scales | 166/250.09 |
| 5,655,602 | 8/1997 | Collins | 166/313 |
| 5,655,612 | 8/1997 | Grimes et al. | 175/401 |
| 5,655,614 | 8/1997 | Azar | 175/404 |
| 5,657,820 | 8/1997 | Bailey et al. | 166/55.7 |
| 5,678,634 | 10/1997 | Rehbock et al. | 166/377 |
| 5,697,438 | 12/1997 | Rehbock et al. | 166/55.7 |
| 5,697,445 | 12/1997 | Graham | 166/313 |
| 5,715,891 | 2/1998 | Graham | 166/313 |
| 5,725,060 | 3/1998 | Blount et al. | 175/61 |
| 5,727,629 | 3/1998 | Blizzard, Jr. et al. | 166/298 |
| 5,730,221 | 3/1998 | Longbottom et al. | 166/298 |
| 5,730,224 | 3/1998 | Williamson et al. | 166/386 |
| 5,732,773 | 3/1998 | Parks et al. | 166/117.5 |
| 5,735,350 | 4/1998 | Longbottom et al. | 166/313 |

OTHER PUBLICATIONS

US Official Gazette entries, Aug. 12, 1997, for U.S. Patents 5,655,613 and Sep. 16, 1997, for 5,667,023.

Slim–Hole and Coiled–Tubing Window Cutting Systems, SPE 26714, Faure et al, Sep. 1993 pp. 351–357.

Improved Casing Sidetrack Procedure Now Cuts Wider, Longer Windows Cagle et al, Petroleum Engineer, Mar. 1979.

Horizontal Slim–Hole Drilling With Coiled Tubing: An Operator's Experience, Ramos et al, Society of Petroleum Engineers, 1992 pp. 152–158.

System Limits Sidetracking Trips To Single Operation, p. 33, Har's Petroleum Engineer Int'l, Apr. 1997.

Multilateral Systems, Halliburton, 1996.

TIW Window Cutting Systems, TIW Corp., 1994.

1994–95 TIW General Catalog, 1993, pp. 2, 3–6.

Technologies Spur Horizontal Activity, Crouse, American Oil & Gas Reporter, Aug. 1997. pp. 62, 64, 67.

Multilaterals Achieve Success In Canada, The Netherlands, Hart's Petroleum Engineer Int'l. Jun. 1997, pp. 49, 51, 52.

Multilateral Wells Can Multiply Reserve Potential, Longbottom et al, American Oil & Gas Reporter, Sep. 97, pp. 53, 54, 56, 58.

Int'l Search Report PCT/GB98/00197,.

Int'l Search Report PCT/GB98/00192, Foreign counterpart of this case S.N. 08/790,543.

FIG. 10a
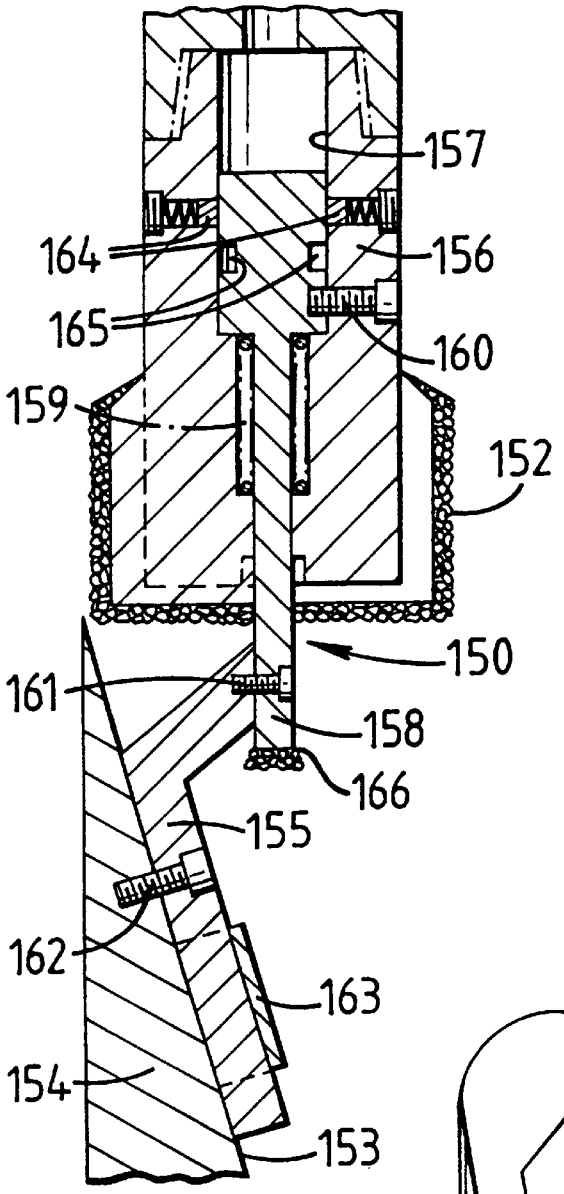
FIG. 11
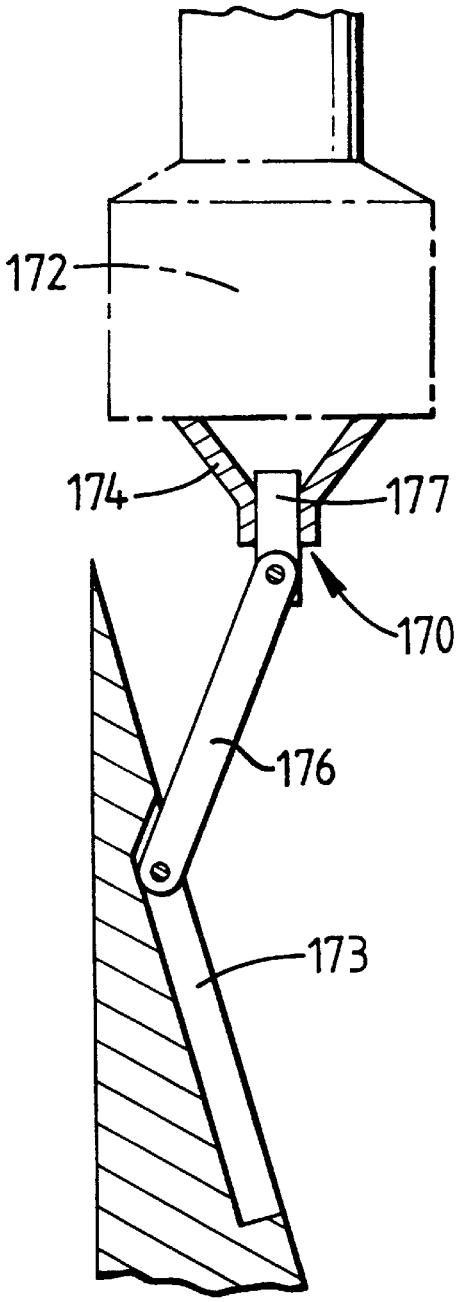
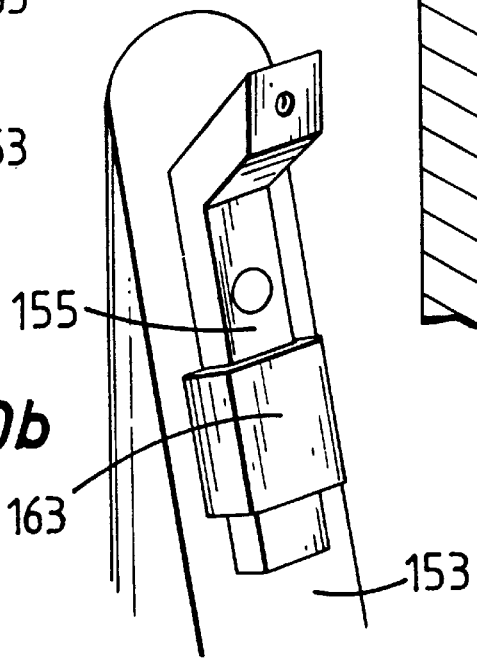
FIG. 10b

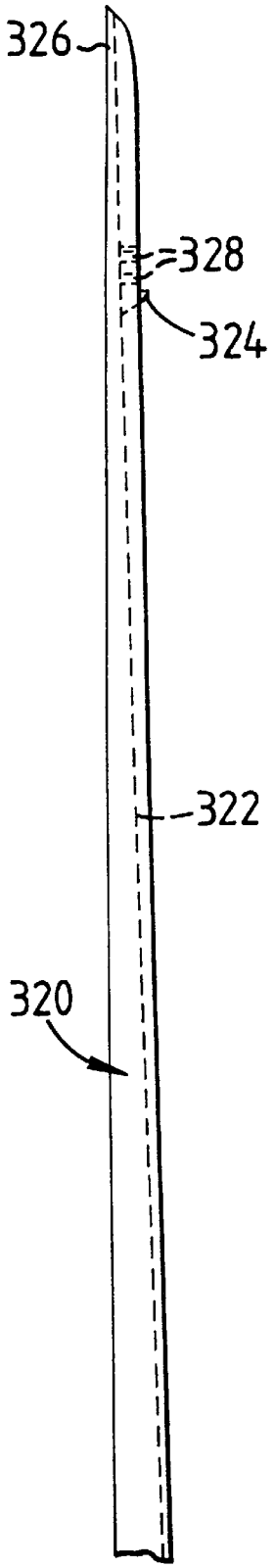
FIG.18b
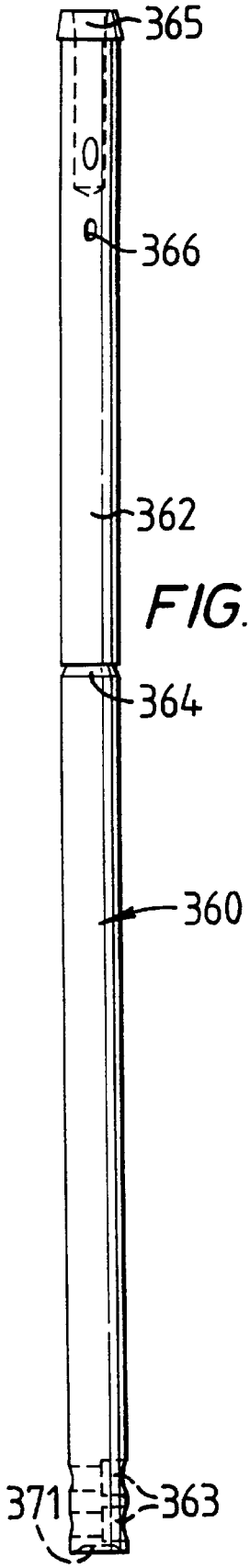
FIG.18c
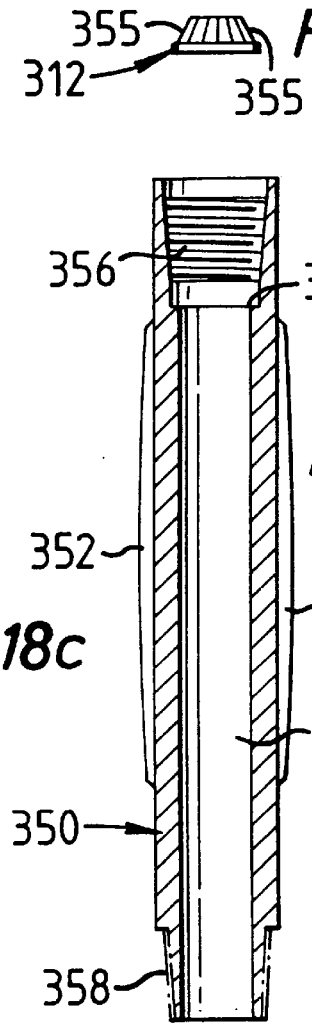
FIG.18f
FIG.18g
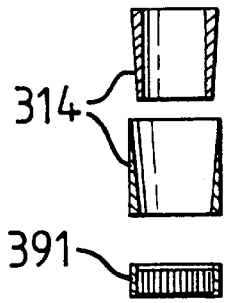
FIG.18e
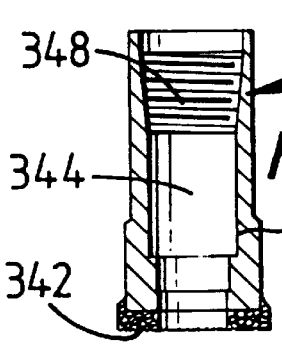
FIG.18d FIG. 18h
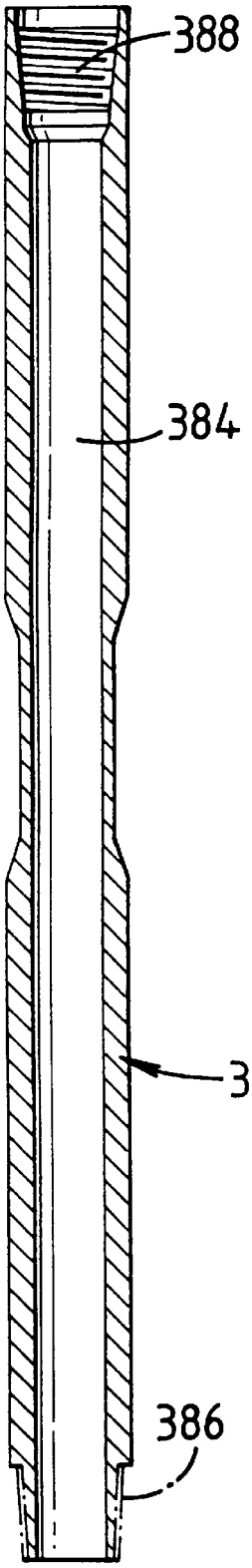
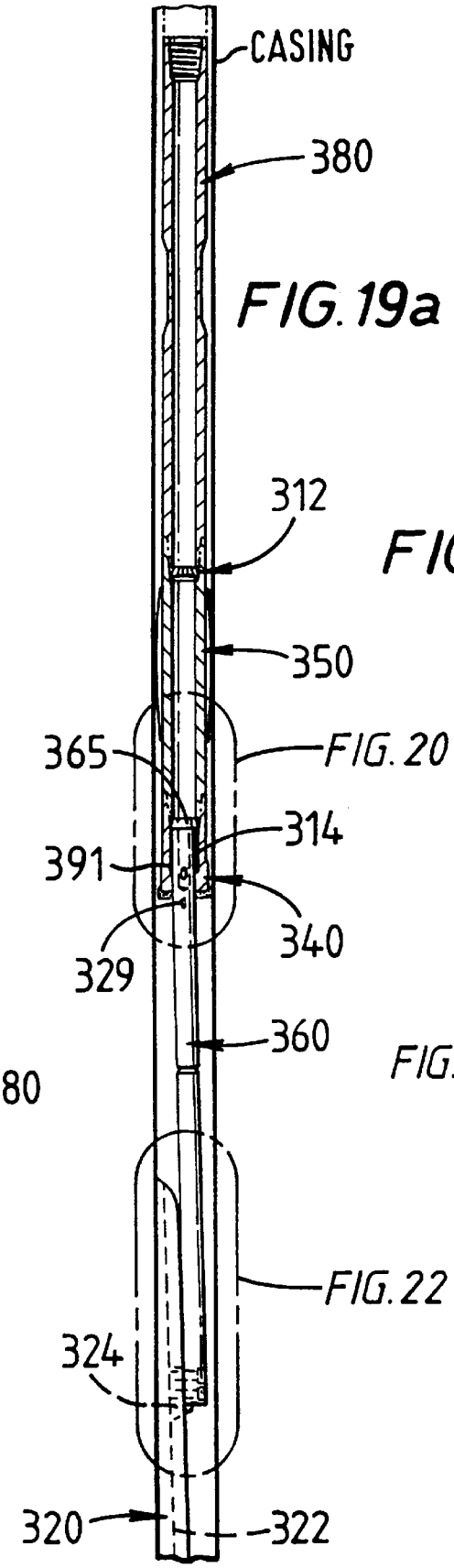
FIG. 19a
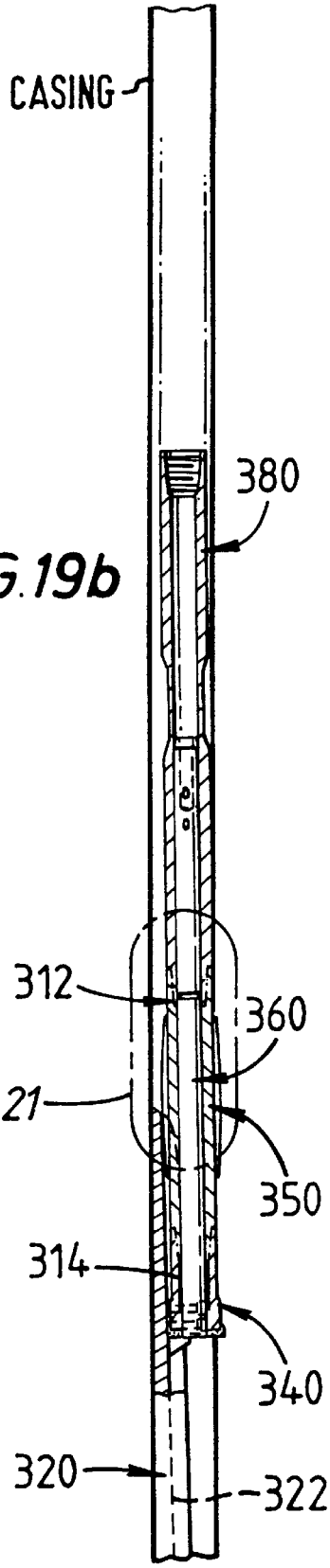
FIG. 19b FIG. 20
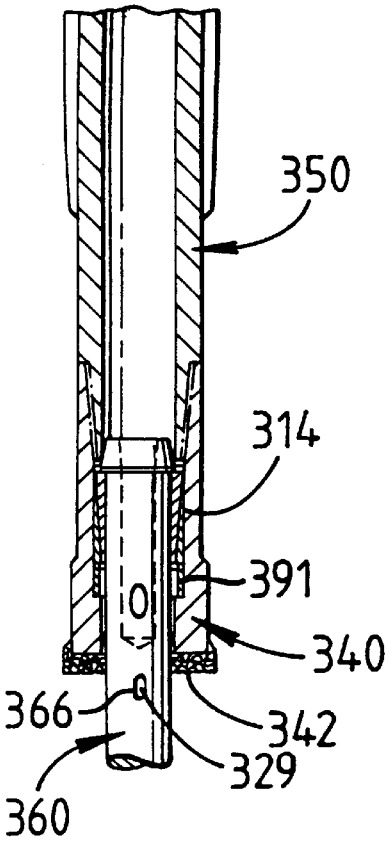
FIG. 21
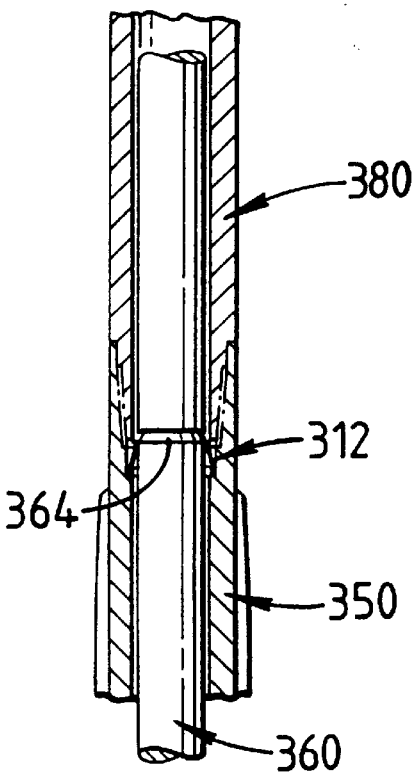
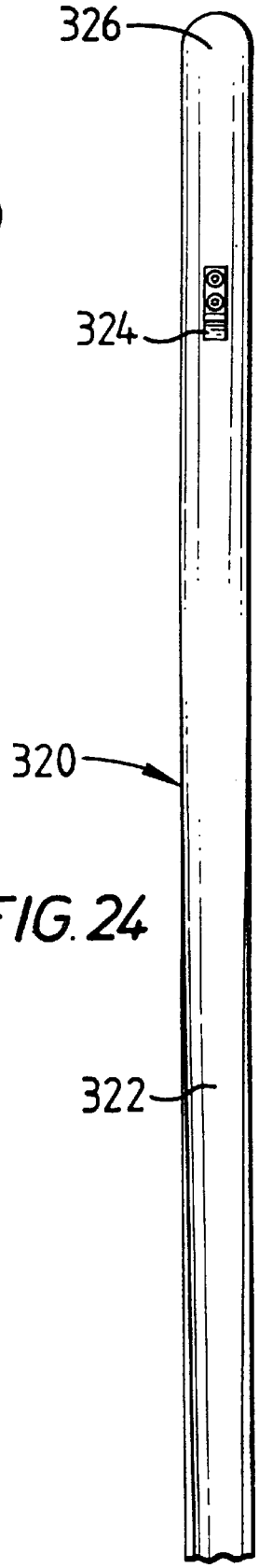
FIG. 24
FIG. 22
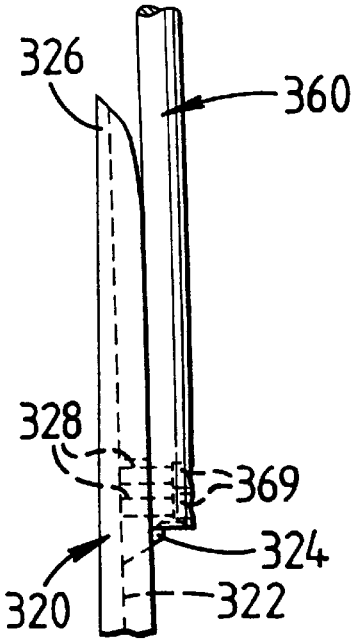
FIG. 23
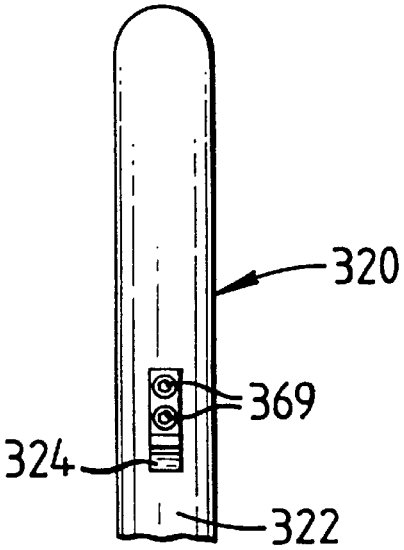

FIG. 27B
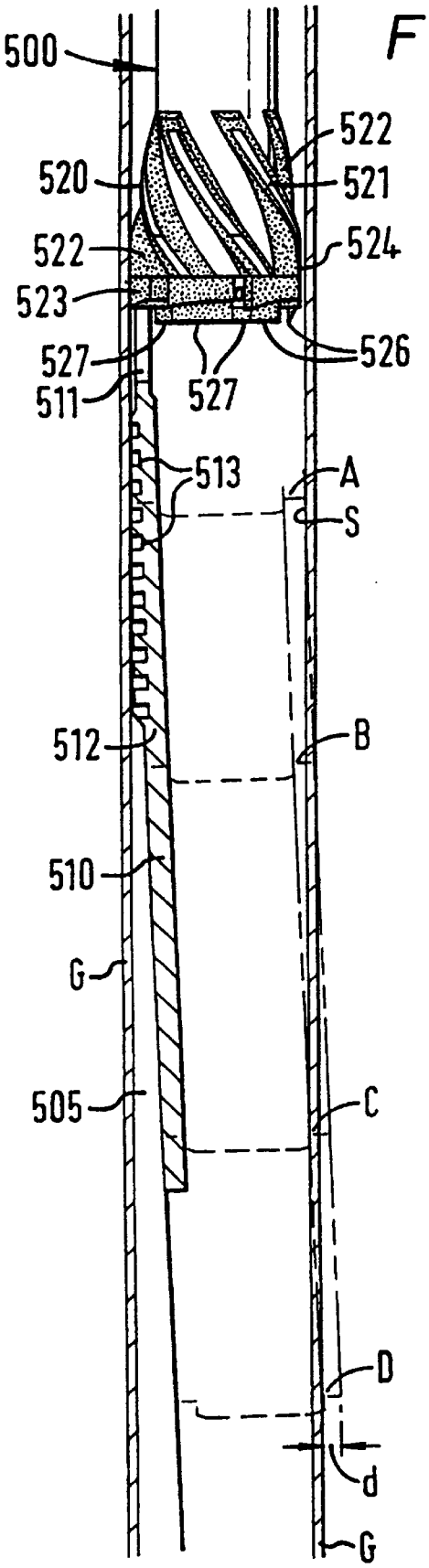
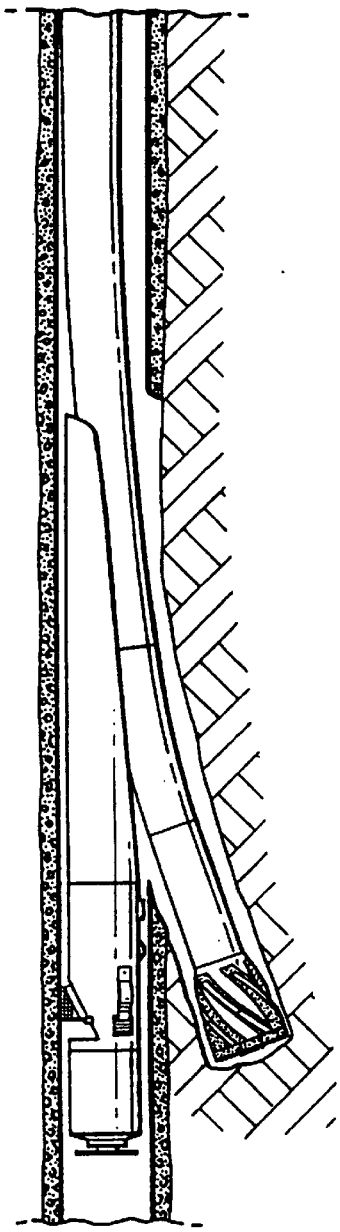
FIG. 27C

FIG. 31B
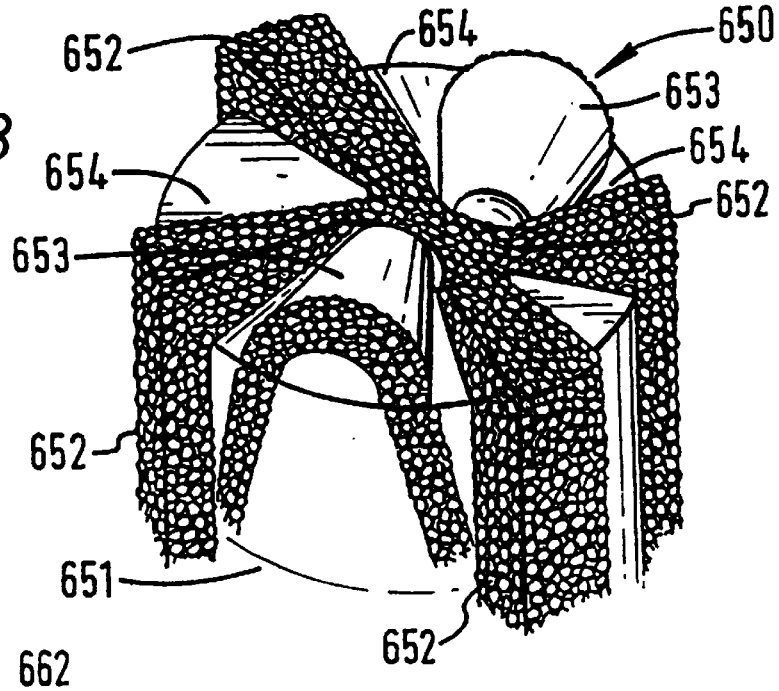
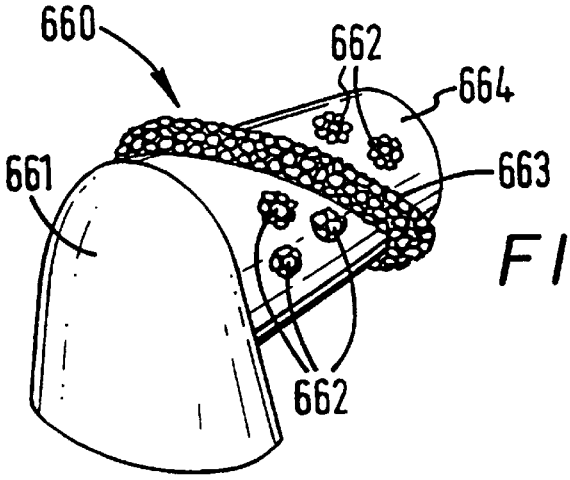
FIG. 31C
FIG. 31D
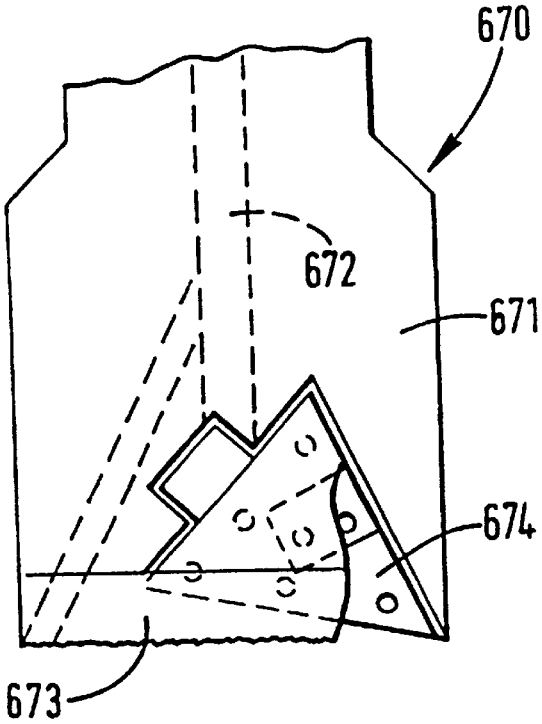

FIG. 32C
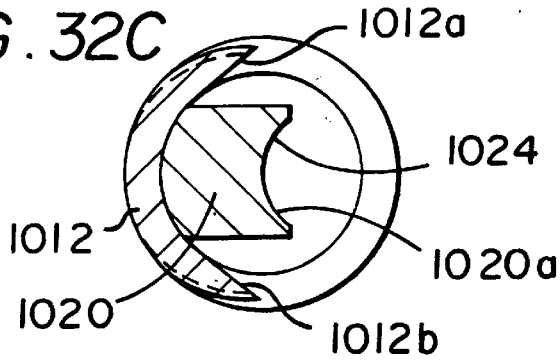
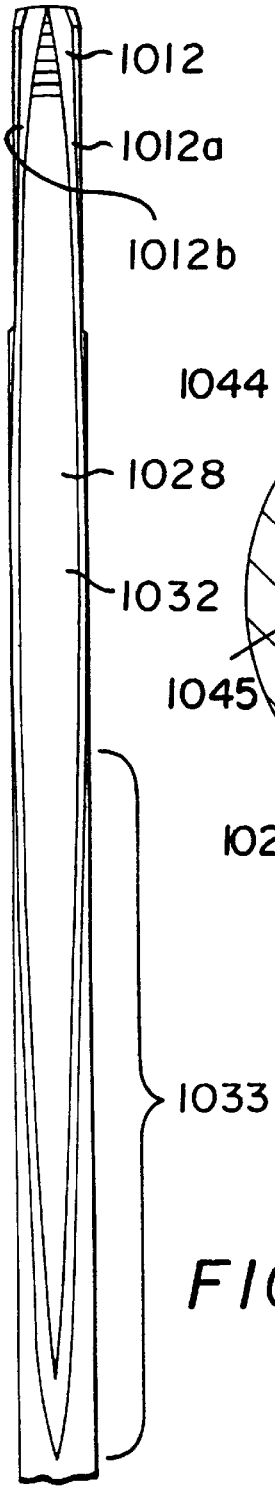
FIG. 32D
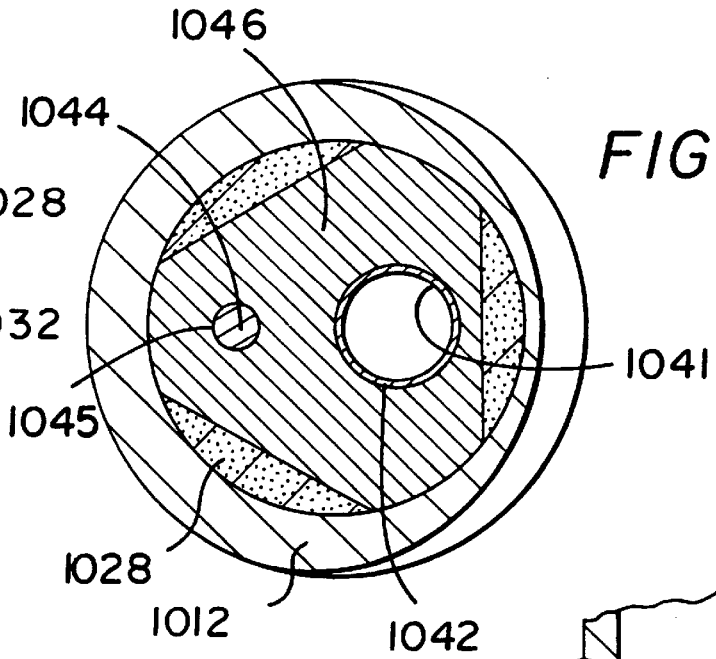
FIG. 32E
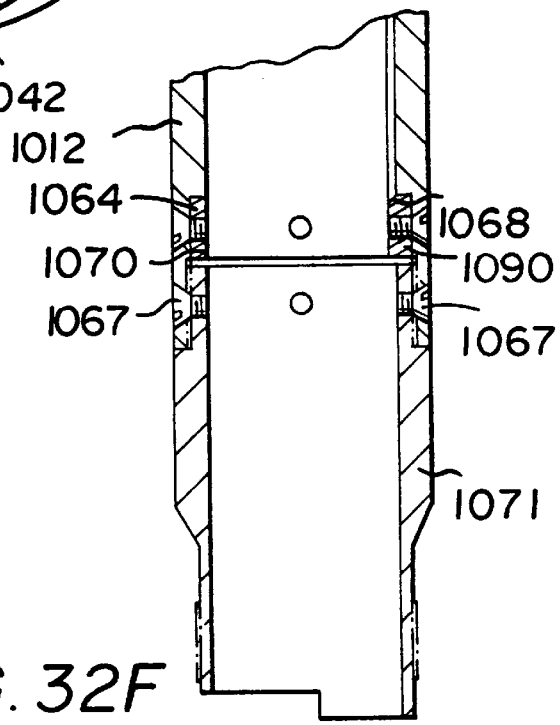
FIG. 32F

WELLBORE MILLING AND DRILLING

RELATED APPLICATIONS

This is a continuation-in-part of pending U.S. application Ser. No. 08/673,791 filed on Jun. 27, 1996 entitled "Wellbore Securement System," now abandoned, which is a continuation-in-part of U.S. application Ser. No. 08/210,697 filed on Mar. 18, 1994 entitled "Milling Tool & Operations" now U.S. Pat. No. 5,429,187 issued Jul. 4, 1995 and is a division of application Ser. No. 414,201 filed on Mar. 31, 1995 entitled "Whipstock Side Support" now U.S. Pat. No. 5,531,271 issued Jul. 2, 1996, which is a continuation-in-part of U.S. application Ser. No. 08/300,917, filed on Sept. 6, 1994 entitled "Wellbore Tool Setting System" now U.S. Pat. No. 5,425,417 issued Jun. 20, 1995 which is a continuation-in-part of U.S. application Ser. No. 08/225,384, filed on Apr. 4, 1994 entitled "Wellbore Tool Orientation," now U.S. Pat. No. 5,409,060 issued on Apr. 25, 1995 which is a continuation-in-part of U.S. application Ser. No. 08/119,813 filed on Sep. 10, 1993 entitled "Whipstock System" now U.S. Pat. No. 5,452,759 issued on Sep. 26, 1995. This is a continuation-in-part of U.S. application Ser. No. 08/642,118 filed May, 2, 1996 entitled "Wellbore Milling System" and of U.S. application Ser. No. 08/752,359 filed Nov. 19, 1996 entitled "Multi-Face Whipstock With Sacrificial Face Element" now U.S. Pat. No. 5,787,978 which is a continuation-in-part of pending U.S. application Ser. No. 08/655,087 filed Jun. 3, 1996 entitled "Whipstock" now U.S. Pat. No. 5,620,051 which is a division of U.S. application Ser. No. 08/414,338 filed Mar. 31, 1995 entitled "Mill Valve" issued as U.S. Pat. No. 5,522,461 on Jun. 4, 1996, and a continuation-in-part of U.S. application Ser. No. 08/542,439 filed Oct. 12, 1995 entitled "Starting Mill and Operations" now U.S. Pat. No. 5,720,349. All applications cited above are co-owned with the present invention and incorporated herein in their entirety for all purposes.

BACKGROUND OF THE INVENTION

1. Field of the Invention

This invention is related to milling and drilling methods, tools and whipstocks; and in one aspect to single-trip milling methods and systems.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. Drilling systems are used to drill wellbores, both main boreholes and lateral bores extending therefrom. The prior art discloses various types of drilling, milling and cutting tools provided for drilling a formation or for cutting or milling existing pipe or casing previously installed in a well. Certain of these tools have cutting blades or surfaces and are lowered into the well or casing and then rotated in a drilling or cutting operation. With certain tools, a suitable drilling fluid is pumped down a central bore of a tool for discharge beneath the cutting blades. An upward flow of the discharged fluid in the annulus outside the tool removes from the well cuttings or chips resulting from the cutting operation. Milling of casing can result in the formation of part of a lateral borehole when a mill exits the casing and bores into the formation.

Milling tools have been used for removing a section or "window" of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like.

Prior art sidetracking methods use cutting tools of the type having cutting blades and use a diverter or a deflector such as a whipstock to cause the tool to be moved laterally while it is being moved downwardly in the well during rotation of the tool to cut an elongated opening, pocket, or window in the well casing.

Certain prior art well sidetracking operations which employ a whipstock also employ a variety of different milling tools used in a certain sequence. This sequence of operation requires a plurality of "trips" into the wellbore. For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for an efficient and effective milling method in which the number of trips into the wellbore is reduced. There has long been a need for tools useful in such methods, particularly in single-trip milling methods.

SUMMARY OF THE PRESENT INVENTION

The present invention, in certain embodiments, discloses a system for making an opening in a tubular in a first wellbore in a formation, the system having milling apparatus for milling the tubular, the milling apparatus having a body and a lower nose, the lower nose having cutting apparatus at least a portion of which is covered with a material to be worn away by contacting the tubular thereby exposing the cutting apparatus for cutting the tubular. In one aspect the wearable material is a ring around the cutting apparatus and in another aspect it is a partial ring. In one aspect the cutting apparatus includes drilling apparatus.

The present invention discloses, in certain embodiments a system for making an opening in a tubular in a first wellbore in a formation, the system including milling apparatus for milling the tubular, the milling apparatus having a body and a lower nose, the lower nose having cutting apparatus at least a portion of which has thereon a material to be worn away thereby exposing the cutting apparatus for cutting the tubular; such a system with a sacrificial element releasably secured to the milling apparatus and for directing the milling apparatus against an inner surface of the tubular; any such system with a whipstock to which is secured the sacrificial element, the whipstock for directing the milling apparatus away therefrom toward the tubular; any such system with a whipstock connected to the milling apparatus for directing the milling apparatus away therefrom toward the tubular; any such system wherein the milling apparatus is suitable for cutting a completed window through the tubular in a single trip of the system into the wellbore; any such system wherein the cutting apparatus is also suitable for cutting a second wellbore beyond the window into the formation; any such system wherein the second wellbore is five feet or less in length, two feet or less in length, at least fifty feet in length, or at least one hundred feet in length; any such system wherein the milling apparatus is a full gauge milling apparatus so that the second wellbore is of a substantially uniform diameter along its entire length; any such system wherein the sacrificial element has at least one recess therein for reducing the amount of the sacrificial element remaining following milling of the sacrificial element by the milling apparatus; any such system wherein the at least one recess is a series of a plurality spaced apart recesses; any such system wherein the series of a plurality of spaced apart recesses includes recesses at angles to each other forming a plurality of projections projecting from the sacrificial element; any such system wherein the lower nose is sized and positioned so that the lower nose does not cut the whipstock; any such system wherein the sacrificial element has at least a portion projecting upwardly beyond the whipstock so that the milling system initiates milling of the tubular prior to reaching a top of the whipstock.

In one aspect the present invention discloses a system for making an opening in a tubular in a first wellbore in a formation, the system having milling apparatus for milling the tubular, the milling apparatus having a body and a lower nose, the lower nose having cutting apparatus covered with a material to be worn away by contacting the tubular thereby exposing the cutting apparatus for cutting the tubular to form a window therethrough and a second wellbore there beyond, a sacrificial element millable by the milling apparatus, the sacrificial element for directing the milling apparatus against an inner surface of the tubular, a whipstock to which is secured the sacrificial element, the whipstock for directing the milling apparatus away therefrom, the milling apparatus suitable for cutting a completed window through the tubular in a single trip of the system into the wellbore, the sacrificial element having at least one recess therein for reducing the amount of the sacrificial element remaining following milling of the sacrificial element by the milling apparatus; any such system wherein the milling apparatus is suitable for cutting a completed window through the tubular in a single trip of the system into the wellbore; any such system wherein the cutting apparatus is also suitable for cutting a second wellbore beyond the window into the formation.

In one aspect the present invention discloses a system for making an opening in a tubular in a wellbore in a formation, the system having a body, cutting apparatus on the body for cutting the tubular, and material on at least a portion of the cutting apparatus, the material to be worn away by contacting the tubular thereby exposing the cutting apparatus for cutting the tubular; such a system wherein the cutting apparatus is suitable for cutting a completed window through the tubular in a single trip of the system into the wellbore; any such system wherein the cutting apparatus is also suitable for cutting a second wellbore beyond the window into the formation; any such system with a sacrificial element releasably secured to the body and for directing the cutting apparatus against an inner surface of the tubular, a whipstock for directing the cutting apparatus away therefrom, the sacrificial element having at least a portion projecting upwardly beyond the whipstock so that the system initiates cutting of the tubular prior to reaching a top of the whipstock.

In one aspect the present invention discloses a method for forming an opening in a tubular in a first wellbore, the method having positioning a milling apparatus in the tubular at a location at which an opening is desired in the tubular, the milling apparatus for milling the tubular, the milling apparatus having a body and a lower nose, the lower nose having cutting apparatus at least a portion of which has a material thereon to be worn away thereby exposing the cutting apparatus for cutting the tubular, and milling the opening in the tubular with the milling apparatus; such a method including exposing the cutting apparatus of the milling apparatus by wearing away the material on the cutting apparatus so that the cutting apparatus assists in formation of the opening; and such a method including cutting a second wellbore beyond the opening in the tubular with the milling apparatus; any such method wherein the second wellbore is five feet or less in length, two feet or less in length, at least fifty feet in length, or at least one hundred feet in length; any such method wherein the cutting apparatus includes wellbore drilling apparatus.

The present invention discloses, in certain aspects, mill-drill tools that include both milling structure (e.g. like known blades, surfaces, or combinations thereof on a tool body with or without matrix milling material and/or with or without milling inserts) and drilling structure (e.g. like known drill bit rotary roller cones). A drill bit rotary roller cone according to the present invention has a milling surface or blade and/or a body of milling material thereon.

The present invention also discloses: such a system also with a sacrificial element releasably secured to the milling apparatus and for directing the milling apparatus against an inner surface of the tubular; such a system with a whipstock to which is secured the sacrificial element, the whipstock for directing the milling apparatus away therefrom toward the tubular; such a system wherein the milling apparatus is suitable for cutting a completed window through the tubular in a single trip of the system into the wellbore; such a system wherein the cutting apparatus is also suitable for cutting a second wellbore beyond the window into the formation; such a system wherein the second wellbore is five feet or less in length, two feet or less in length, or about two feet long or about one-and-a-half feet long; such a system wherein the milling apparatus is a full gauge milling device so that the second wellbore is of a substantially uniform diameter along its entire length and, in one aspect, is of a desired finished diameter; any such system wherein the sacrificial element has at least one recess therein for reducing the amount of the sacrificial element remaining following milling of the sacrificial element by the milling means and one such system wherein the at least one recess is a series of a plurality spaced apart recesses, in one aspect wherein the series of a plurality of spaced apart recesses includes recesses at angles to each other forming a plurality of projections projecting from the sacrificial element, any such system wherein the lower nose is sized and positioned so that it does not cut the whipstock; and any such system wherein the sacrificial element has at least a portion projecting upwardly beyond the whipstock so that the milling system initiates milling of the tubular prior to reaching a top of the whipstock.

In certain embodiments the present invention discloses a system for making an opening in a tubular in a first wellbore in a formation, the system having milling apparatus for milling the tubular, the milling apparatus having a body and a lower nose, the lower nose having cutting apparatus covered with a material to be worn away by contacting the tubular thereby exposing the cutting apparatus for cutting the tubular to form a window therethrough and a second wellbore therebeyond, a sacrificial element releasably secured to the milling apparatus and millable thereby, the sacrificial element for directing the milling apparatus against an inner surface of the tubular, a whipstock to which is secured the sacrificial element, the whipstock for directing the milling apparatus away therefrom toward the tubular, the sacrificial element having at least one recess therein for reducing the amount of the sacrificial element to be milled and remaining following milling of the sacrificial element by the milling apparatus. The present invention discloses such a system wherein the milling apparatus is suitable for cutting a completed window through the tubular in a single trip of the system into the wellbore and also wherein the cutting apparatus is suitable for cutting a second wellbore beyond the window into the formation.

In certain embodiments the present invention discloses: a system for making an opening in a tubular in a wellbore in a formation, the system having a body, cutting apparatus on the body for cutting the tubular, material covering at least a portion of the cutting apparatus, the material to be worn away by contacting the tubular thereby exposing the cutting apparatus for cutting the tubular; such a system wherein the cutting apparatus is suitable for cutting a completed window through the tubular in a single trip of the system into the wellbore; any such system wherein the cutting apparatus is suitable for cutting a second wellbore beyond a window into the formation; and any such system with a sacrificial element releasably secured to the cutting apparatus and for directing the cutting apparatus against an inner surface of the tubular, a whipstock to which is secured the sacrificial element, the whipstock for directing the cutting apparatus away therefrom and toward the tubular, and the sacrificial element having at least a portion projecting upwardly beyond the whipstock so that the milling system initiates milling of the tubular prior to reaching a top of the whipstock.

The present invention, in one embodiment, discloses a mill with a nose member or a nose cone releasably attached to a mill, the nose cone extending downwardly from the mill and having a lower end or nose releasably connected to a diverter or whipstock set in the casing. The nose cone may be solid; it may be a hollow cone; it may have one connecting bar attached to the center or side of the mill; or it may have two, three, or more spaced-apart fins, ribs or struts that connect it to the mill. The nose cone can be made of metal (e.g. brass, aluminum, zinc, steel, or an alloy or combination thereof of any of these), plastic, fiberglass, cermet, composite, wood, or any other suitable material.

In one aspect the nose cone is hollow and tapered with three upper fingers for receipt in corresponding holding slots in a mill body. The fingers may be held in the slots with shear pins or with explosive bolts or an explosive charge may be used to separate the fingers and therefore the nose cone from a mill. Alternatively, the fingers themselves may be shear members which shear when a desired force is applied to them. The nose cone's length is sufficient to space cutting elements on the mill above the top of a concave of a whipstock prior to release of the nose cone from the whipstock. A shear bolt in a lug extending out from the whipstock may be used to releasably secure the nose cone to the whipstock. The nose cone is also sufficiently long so that upon release from the lug the nose cone moves down past the lug while contacting the lug, thus directing the mill above the nose cone against a casing in which the system is disposed in a wellbore. Rotating the mill (either by a downhole motor on coiled tubing or by a rotary at the surface) initiates the creation of an opening or window in the casing at a level even with or above the top of the concave. This milling of the casing continues until the mill encounters the lug and mills it off while still milling the window opposite the concave. After the lug is milled off the mill is in contact with the concave and the concave directs the mill outwardly against the casing for further milling of the window. In one preferred embodiment, at the point at which the lug is milled off, the casing has been completely milled through for at least a minimal axial distance thus facilitating further milling of the casing (rather than milling of the concave) and producing minimal damage to and milling of the concave.

As the mill mills the lug the nose cone's fingers are released. In another aspect, the nose cone is positioned so that it can be subject to the pressure of fluid flowing down through a mill to which the nose cone is attached and the pressure of the fluid shears shear pins or bolts holding the nose cone to the mill. The nose cone upon release falls down beneath the mill between the concave and the casing. At some point, in one aspect, the mill encounters the nose cone and mills past and/or through it. In another aspect, the nose cone is detonated with known explosives, preferably without adverse consequences to the formation. To inhibit or prevent nose cone rotation after its release, it may have a spike or point on its lower surface and/or an outer helical thread or helical surface which engages the casing and/or the concave.

In one aspect the nose cone is made of steel; in one aspect it is mild steel.

The present invention also discloses a variety of other devices, apparatuses, and mechanisms for initial guidance of a mill, for spacing it apart from and (in some aspects) above a concave during initial milling of casing, and for facilitating window initiation prior to mill-concave contact. Once a substantial amount of casing thickness has been milled prior to mill-concave contact or, more preferably, the entire casing thickness has been milled through, the concave's job of forcing the mill against the casing for the completion of a milled window is made easier and damage to the concave is reduced.

In another aspect a minor portion at the top, a major portion, substantially all, or all of the concave is hardfaced e.g. with tungsten carbide, or armored with suitable armor material, e.g. Conforma Clad™ material, Arnco 200™ hard banding material, or Technoginia™ material. Such material is welded on, baked on, plasma flame-sprayed on or explosively bonded to the concave. The hardfacing or armor is preferably harder than the casing to be milled so that a mill will preferentially mill the casing.

It is, therefore, an object of at least certain preferred embodiments of the present invention to provide:

New, useful, unique, efficient, non-obvious milling systems, milling tools, whipstocks, and devices and methods for milling operations and/or for milling-drilling operations;

A milling system and method requiring a single trip into a wellbore to create a desired opening or window in a tubular in the wellbore;

A milling method in which a window is milled at a desired location in a casing;

A nose cone, pilot cone, or other mechanism for initially releasably spacing a mill apart from a top portion of a concave of a whipstock set in tubing, casing, or a wellbore while at least initial milling is accomplished;

A mill-drill tool with milling apparatus and drillling apparatus in a single tool; and New, useful, unique, efficient non-obvious systems for producing at least part of a lateral wellbore extending from a main wellbore; and such systems which efficiently both mill tubulars and drill in a formation.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 10*a* is a side view in cross-section of a milling system according to the present invention. FIG. 10*b* is a partial view of the system of FIG. 10*a*.

FIGS. 11–14 are side views in cross-section of milling systems according to the present invention.

FIGS. 18*a*–18*h* are side views of parts of a milling system according to the present invention. FIGS. 18*d*–18*h* are in crosssection.

FIGS. 19*a* and 19*b* show the milling system including the parts shown in FIGS. 18*a*–18*h* and show steps in the operation of the system.

FIG. 20 is an enlarged view of part of the tool show in FIG. 19*a*.

FIG. 21 is an enlarged view of a part of the tool shown in FIG. 19*b*.

FIG. 22 is an enlarged view of a portion of the tool of FIG. 19*a*.

FIG. 23 is a side view of the tool as shown in FIG. 22.

FIG. 24 is a side view of the whipstock concave member of the tool of FIG. 19*a*.

FIG. 27B is an enlarged view of part of the system of FIG. 27A. FIG. 27C shows a window milled in a tubular and a lateral wellbore extending from a main wellbore formed with the system of FIG. 27A.

FIG. 31B is a perspective view of a mill-drill tool according to the present invention. FIG. 31C is a perspective view of a mill-drill rotary roller bit cone according to the present invention. FIG. 31D is a schematic side view partially in cross-section of a mill-drill tool according to the present invention.

FIG. 32C is a cross-section view along line 32C—32C of FIG. 32A. FIG. 32D is a front view of part of the system of FIG. 32A. FIG. 32E is a cross-section view along line 32E—32E of FIG. 32B. FIG. 32F is a partial view of part of the system as shown in FIG. 32B.

DESCRIPTION OF EMBODIMENTS PREFERRED AT THE TIME OF FILING FOR THIS PATENT

Figure 1:
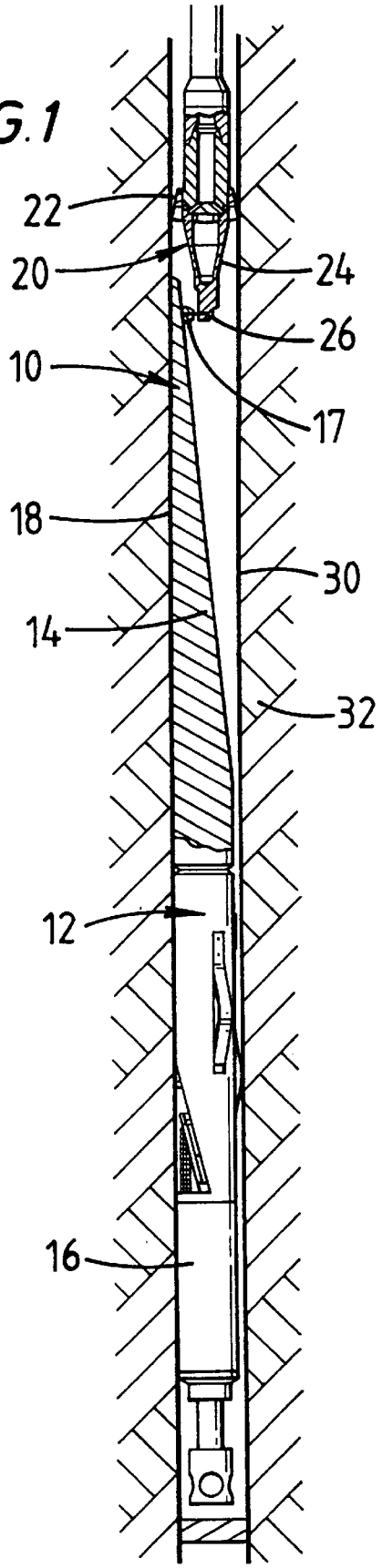
FIG. 1 is a side view in cross-section of a milling system according to the present invention.

FIG. 1 shows a system 10 according to the present invention which has a milling system 20 according to the present invention, and a whipstock 12 with a concave 14 and an anchor or setting tool 16. The milling system 20, connected to a tubular string or coiled tubing 34 and rotatable by a downhole motor 36 or by a rotary (not shown) has a mill 22 and a nose cone 24 releasably attached at the top to the mill 22 and at the bottom with a shear bolt 26 to a lug 17 of the whipstock 12. The whipstock 12 may be any known whipstock or diverter for a bit or mill. The system 10 is in a tubular string 18 (e.g. casing) in a wellbore 30 extending through a formation 32 from the earth's surface to a point underground.

Figure 2:
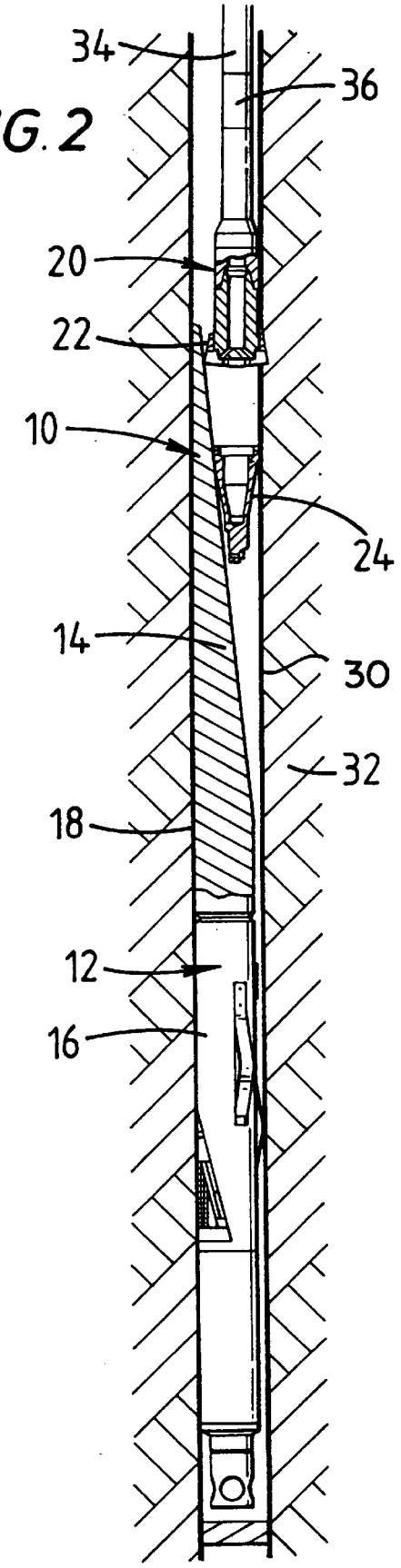
FIG. 2 is a temporally subsequent view to that of FIG. 1.

As shown in FIG. 2, the shear bolt 26 has been sheared by increasing weight on the milling system 20, the nose cone 24 has been released and has fallen down wedging itself between the concave and the casing, and the mill 22 has milled through the lug and through the casing to initiate a casing window slightly above and adjacent the top of the concave 14.

Figure 3:
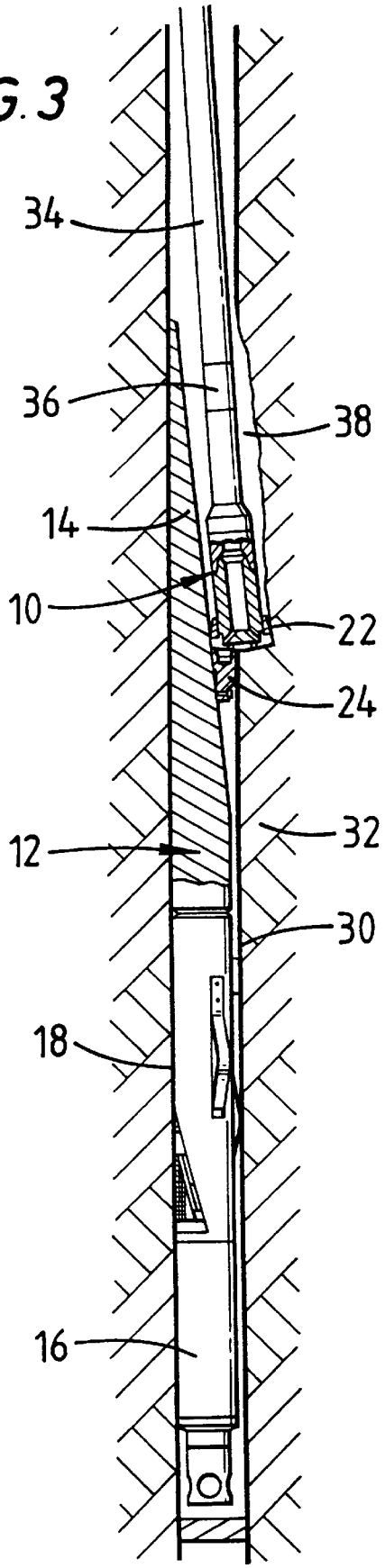
FIG. 3 is a temporally subsequent view to that of FIG. 2.

As shown in FIG. 3 the milling system 20 has progressed downwardly milling out a portion of a window 38 and it has also commenced to mill the nose cone 24. The concave 14 has forced the mill 22 toward the casing to facilitate milling of the window 38. The mill 22 will now proceed to mill further to complete the window 38.

Figure 4:
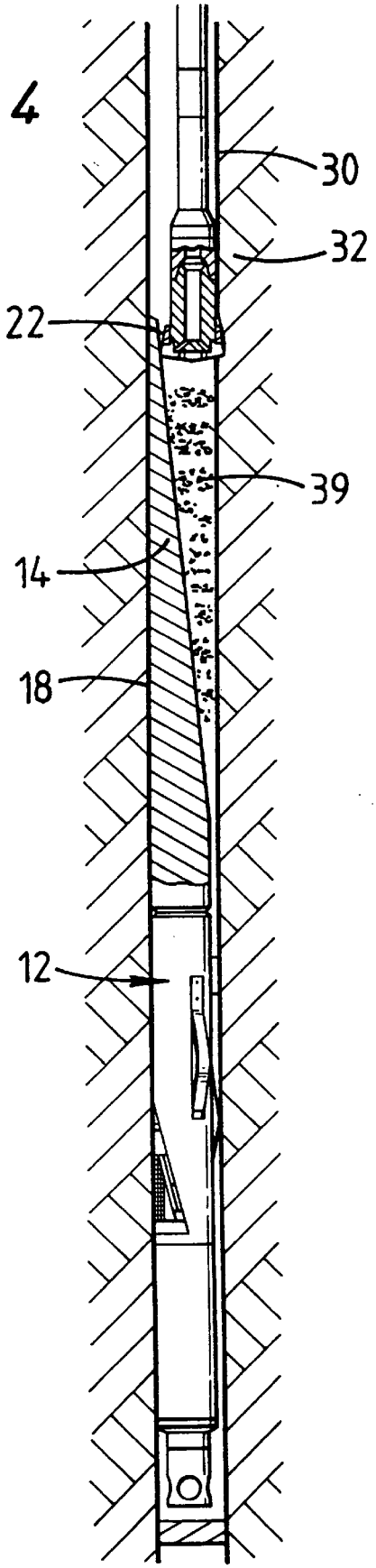
FIG. 4 is an alternative step for the use of the system of FIG. 2.

FIG. 4 presents an alternative way to dispose of the nose cone 24. With an appropriate explosive device, a releasable mechanism releasably securing the nose cone to the concave is exploded, thereby releasing the nose cone and disintegrating it. In one aspect a single explosive device is used. In another aspect one device releases the nose cone from the concave and another device disintegrates the nose cone resulting in relatively small pieces 39 or weakens it to facilitate milling thereof.

The milling system 20 (as is true of any system disclosed herein) can employ any known and suitable cutter, reamer, bit, mill or combination thereof. The setting tool 16 can be any known anchor, setting tool, packer, etc. The mill or mills may have any number of known blades, knives, or cutting elements with any known matrix milling material and/or cutting inserts in any known array or pattern, with or without chipbreakers, over some or all of the blade or element surface. Instead of a mill or mills, a drill bit and drilling system may be used.

Figure 5:
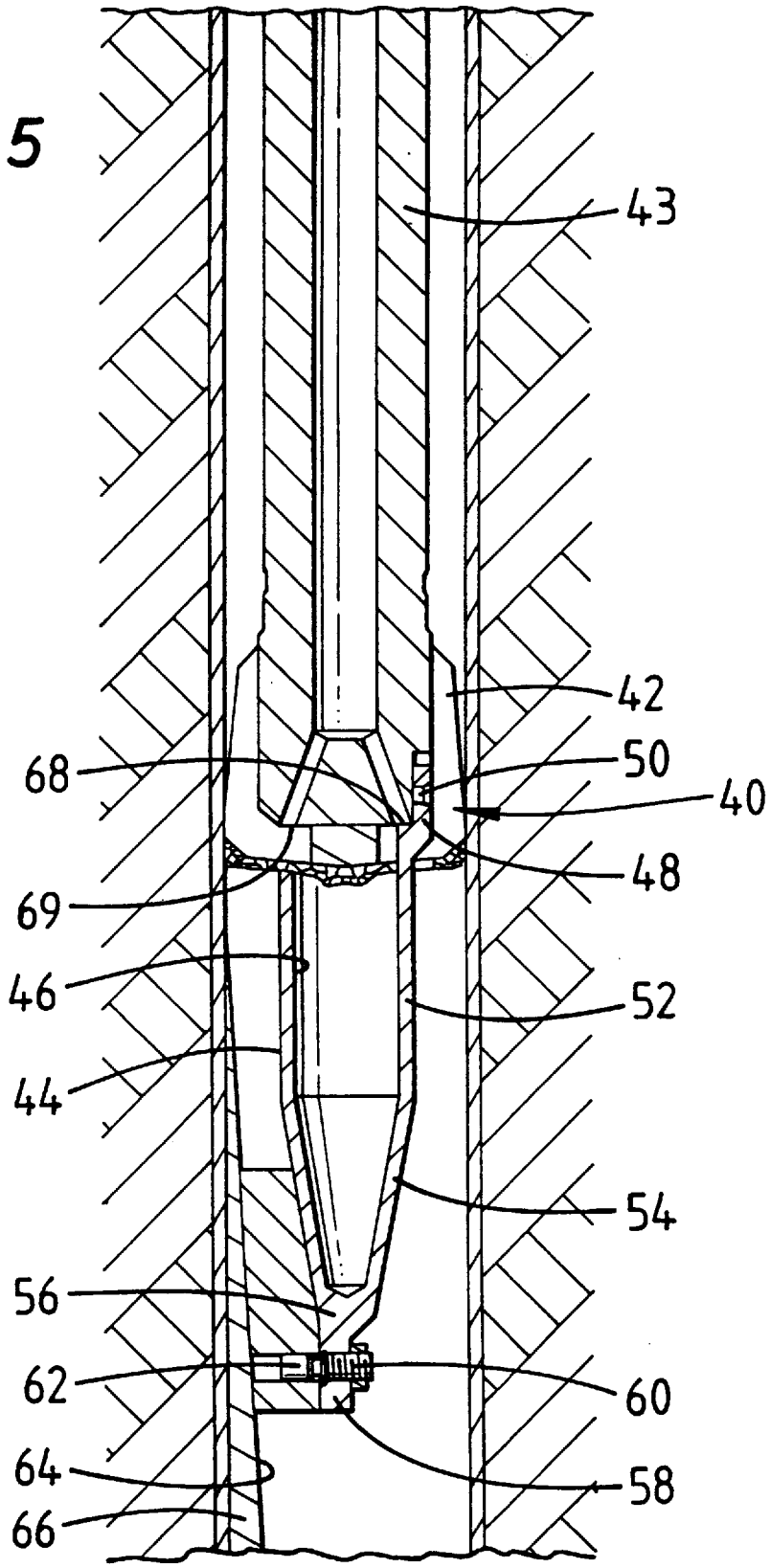
FIG. 5 is a side view of part of the system of FIG. 1.

FIG. 5 shows a milling system 40 (like the milling system 20, FIG. 1 and useful in the methods illustrated in FIGS. 1–4) which has a mill 42 on a string 43 with a hollow nose cone 44. The nose cone 44 has an inner space 46. A top end 48 is secured to the mill 42 by pins 50 (e.g. stainless steel pins straddling tops of the fingers and extending into half-recesses in the fingers and half recesses in the mill body). The nose cone has a body 52 and a lower taper portion 54, the taper portion meeting at an end 56 from which projects a bar 58 through which extends a shear bolt 60 that pins the bar 58 to a lug 62 of a concave 64 of a whipstock 66. The whipstock 66 is in a tubular (e.g. casing) in a string of tubulars in a wellbore (not shown). For stability a shoulder 68 abuts a surface 69 of the mill 42. An explosive charge may be placed on the hollow nose cone and detonated by a firing head in or above the mill to disintegrate the nose cone following its release from the mill.

Figure 6:
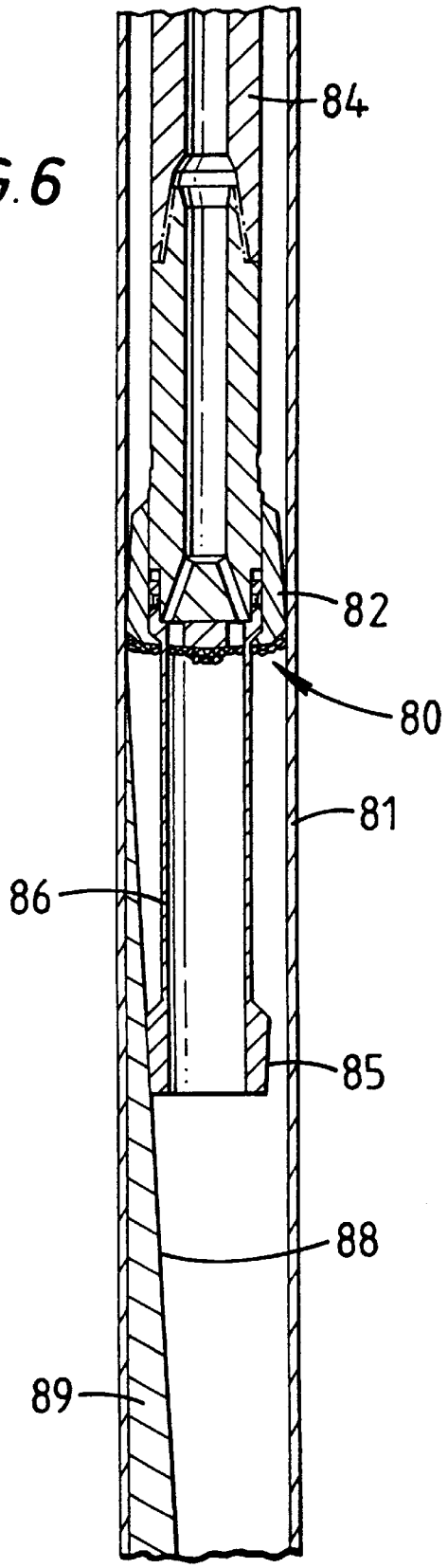
FIG. 6 is a side view in cross-section of a milling system according to the present invention.
Figure 7:
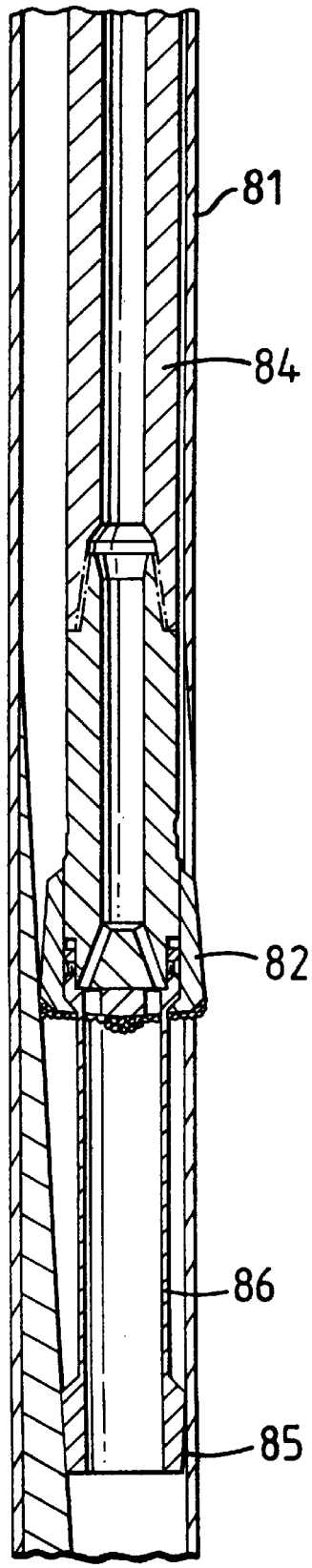
FIG. 7 is another side view in cross-section of the system of FIG. 6.

FIGS. 6 and 7 disclose a milling system 80 with a mill 82 on a string 84 having a pilot member 86 with its top releasably attached to the mill 82 and with its bottom releasably attached to a concave 88 of a whipstock 89. The pilot member 86 can be attached to the concave 88 with a shear pin or shear bolt or by welding or using an adhesive. The pilot member can be separated from the concave by applying weight on shear pin(s), shear bolt(s), or on a welded area, or by using an explosive charge to sever the concave-pilot-member connection.

The pilot member 86 has a taper surface 85 fashioned and configured to move down along the concave 88 thereby inhibiting movement of the mill against the concave and facilitating direction of the mill against casing 81 which is to have a window 87 milled therethrough. As shown, the pilot member 86 is a cylinder with an upper end secured to the mill 82 in a fashion similar to that of the nose cone 44, FIG. 5. Alternatively, the pilot member 86 can have fins like those of the nose cone 44.

When the pilot member reaches the position shown in FIG. 7, it is released from the mill 82, explosively severed from the mill 82, and/or explosively destroyed or explosively weakened so the mill 82 can continue downward milling of the window 87. In one aspect the portion of the window 87 milled as shown in FIG. 7 is between about 10 to about 30 inches; but this distance is adjustable depending on the length of the pilot member 86.

Figure 8A:
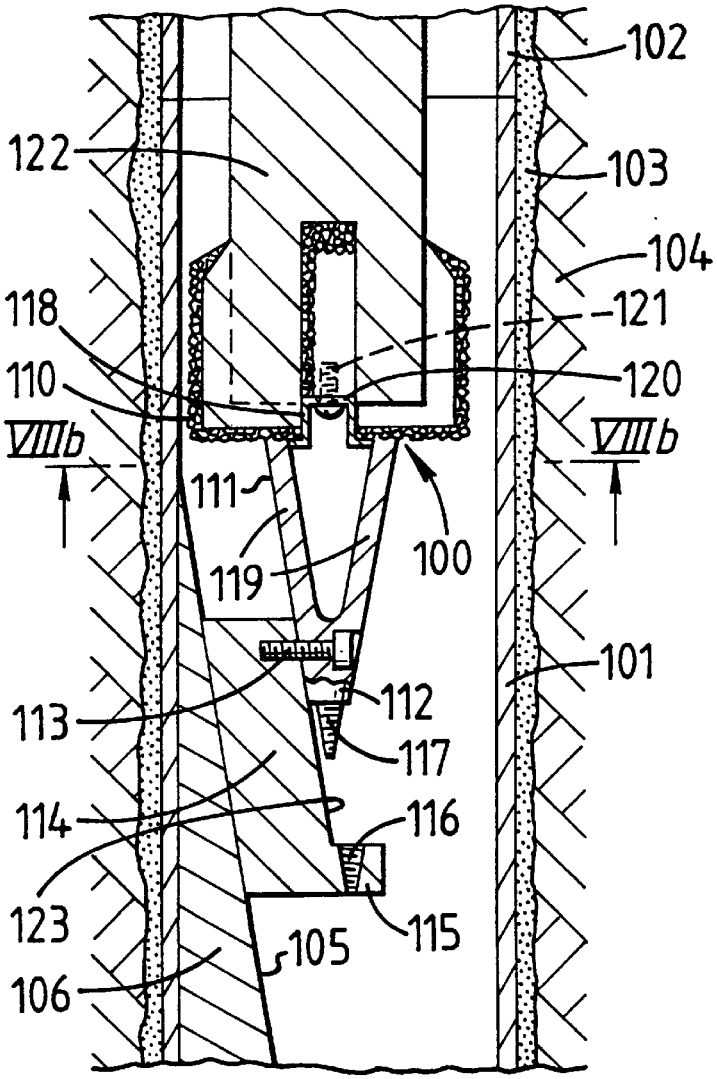
FIG. 8*a* is a side view in cross-section of a milling system according to the present invention.
Figure 8B:
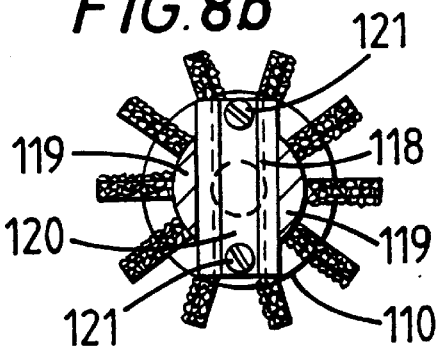
FIG. 8*b* is an end view of the system of FIG. 8*a*.

FIGS. 8*a* and 8*b* show a milling system 100 according to the present invention which is disposable in a tubular 101 (e.g. casing) of a tubular string 102 in a wellbore 103 in a formation 104 extending from the earth's surface to a location beneath it. The milling system 100 has milling apparatus 110 associated with a concave 105 of a whipstock 106. The whipstock may be any known suitable whipstock or diverter, as may be the concave. A nose member 111 has an end 112 shear-pinned with a pin 113 to a lug 114 which is secured to or formed integrally of the concave 105. The lug 114 has a projection 115 with a threaded hole 116 for receiving and threadedly mating with a threaded projection 117 of the nose member 111. A brace 118 extends between two arms 119 of the nose member 111 and an upper piece 120 is secured to the milling apparatus 110 with a bolt 121 which extends into a body 122 of the milling apparatus 110. Upon shearing of the pin 113, the tapered arms 119 move on a corresponding tapered surface 123 of the lug 114 and keep the milling apparatus 110 spaced apart from the concave 105 facilitating engagement of the casing 101 by the cutting portion of the milling apparatus 110. The threaded projection 117 eventually enters and is threaded into the hole 116 at which point the nose member is released from the milling apparatus 110 due to its further rotation and downward movement as it mills the casing 101. The milling apparatus 110 then mills away the lug 114 and the nose member 111.

Figure 9:
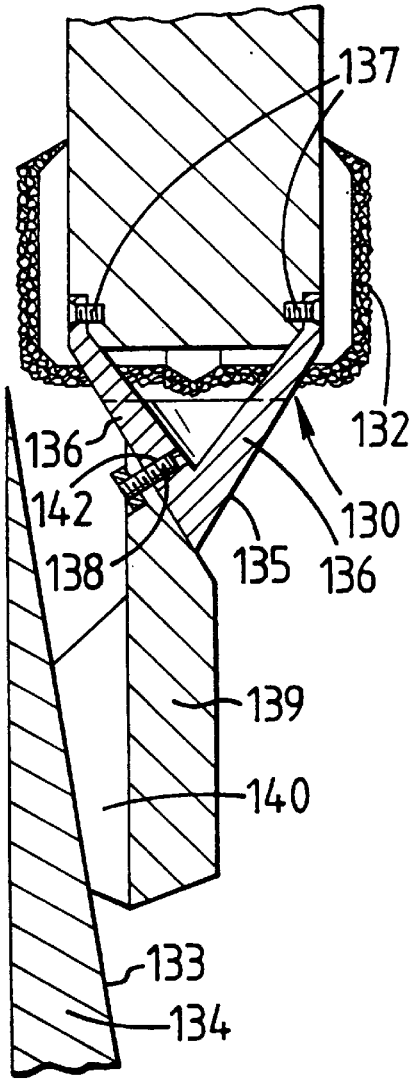
FIG. 9 is a side view in cross-section of a milling system according to the present invention.

FIG. 9 shows a milling system 130 according to the present invention which is disposable in a tubular (e.g. casing) (not shown, like the system of FIG. 8*a*). The milling system 130 has a mill 132 associated with a concave 133 of a whipstock 134. The whipstock may be any known suitable whipstock or diverter, as may be the concave. A nose member 135 has a hole 142 therethrough through which extends a shear bolt 138. The shear bolt 138 releasably pins the nose member 135 to a top portion 139 of a lug 140. The lug 140 is secured to the concave 133. Two braces 136 of the nose member 135 are secured with bolts 137 to the mill 132. In one aspect the nose member is made of mild steel. The mill 132 is freed for milling by shearing the shear bolt 138. Then the tapered brace surface of a brace 136 moves down on the tapered surface of the lug 140, spacing apart the mill 132 from the concave 133 as milling of the tubular commences. In one aspect the nose member 135 is a solid cone releasable by circulating fluid under pressure down through the mill 132 with sufficient force to shear the bolts 137.

FIGS. 10*a* and 10*b* show a milling system 150 with a mill 152 releasably secured to a lug 155 on a concave 153 of a whipstock 154 set in a tubular (not shown, as in FIG. 8*a*). The mill 152 has a body 156 with a channel 157 in which is movably disposed a central member 158 which is urged upwardly by a spring 159. A shear pin 160 initially prevents the central member 158 from moving up in the mill 152. A shear bolt 161 releasably holds the central member 158 to the lug 155 and a shear bolt 162 releasably holds the lug 155 to the concave 153. Upon shearing of the shear bolt 162, the lug 155 is free to move downwardly at an angle within a sleeve 163 secured to the concave 153. As the lug 155 moves down, the mill is rotated about the central member 158 without severing the shear bolt 161 to initiate milling of the tubular in which the system is positioned. Once the lug 155 reaches the limit of its downward travel in the sleeve 163, the shear bolt 161 is sheared to permit further downward movement of the mill 152. At this point the shear pin 160 is sheared permitting the central member 158 to retract back into the mill 152 due to the force of the spring 159. As the central member 158 moves up, spring loaded detents 164 move into recesses 165 to hold the central member 158. A lower end 166 of the central member 158 is dressed with milling material and/or inserts to assist in milling of the opening through the tubular. Alternatively the lug 155 can have a projection into a recess in the concave, the recess holding the projection and the projection moving down in the recess once the shear bolt 162 is sheared. In another aspect projections on the lug 155 ride in or on rails on the concave.

FIG. 11 shows a milling system 170 similar to that of FIGS. 8*a* and 9 with a mill 172 and a concave 173; but a nose 174 is not directly secured to a lug. Instead a hinge 176 is pivotably connected to the concave 173 and pivotably connected to a bar 177 of the nose 174. The hinge 176 will space the mill 172 apart from the concave as the mill 172 begins to mill an opening in a tubular (not shown) in which the system 170 is disposed until the hinge 176 reaches a downward travel limit. At this point the mill 172 will mill away the hinge 176 and continue to mill an opening, window, etc. in the tubular.

Figure 12:
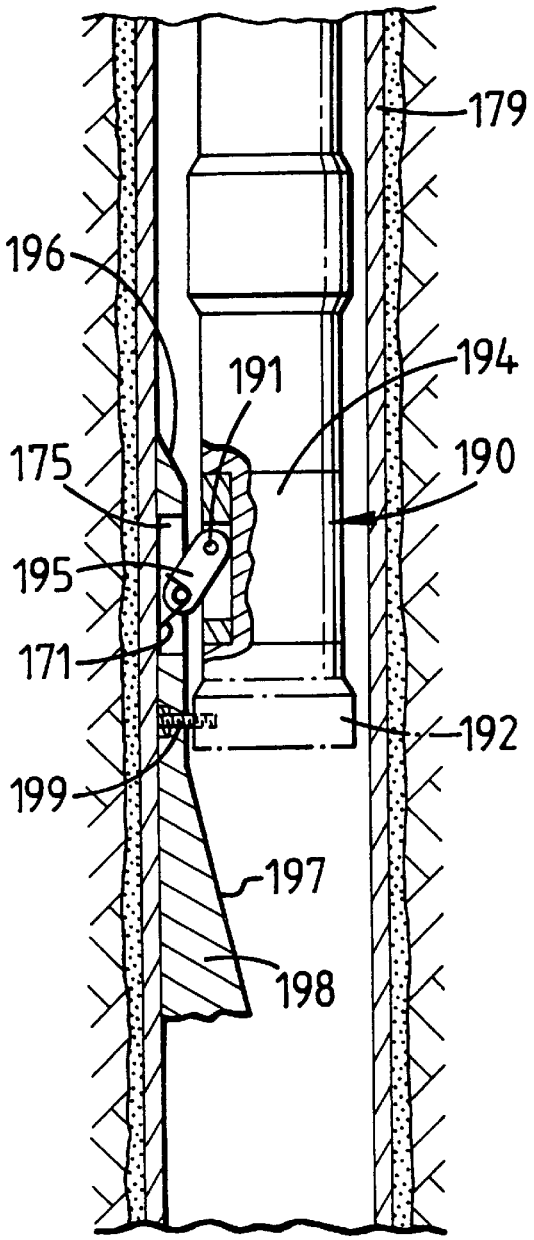

FIG. 12 shows a milling system 190 according to the present invention which has a mill 192 whose body 193 is initially freely movable in a sleeve 194. A hinge 195 is pivotably connected to the sleeve 194 and to an upper extension 196 of a concave 197 of a whipstock 198. Initially a shear pin 199 releasably holds the mill 192 to the concave 197. A shear pin 191 holds the hinge 195 to the sleeve 194. A spring 171 on the hinge 195 urges it back into a recess 175 when the shear pin 191 is sheared. Upon shearing of the shear pin 199, the mill is freed to move out and down to commence milling an opening in a tubular 179 (like the tubular of FIG. 8*a*). The concave 197 directs the mill 192 to the tubular 179. Upon reaching the downward travel limit of the hinge 195, the shear pin 191 is sheared, the hinge 195 moves into the recess 175, and the mill 192 is freed for further milling of the tubular 179. The hinge 195 serves to initially space apart the mill 192 and the concave 197.

Figure 13:
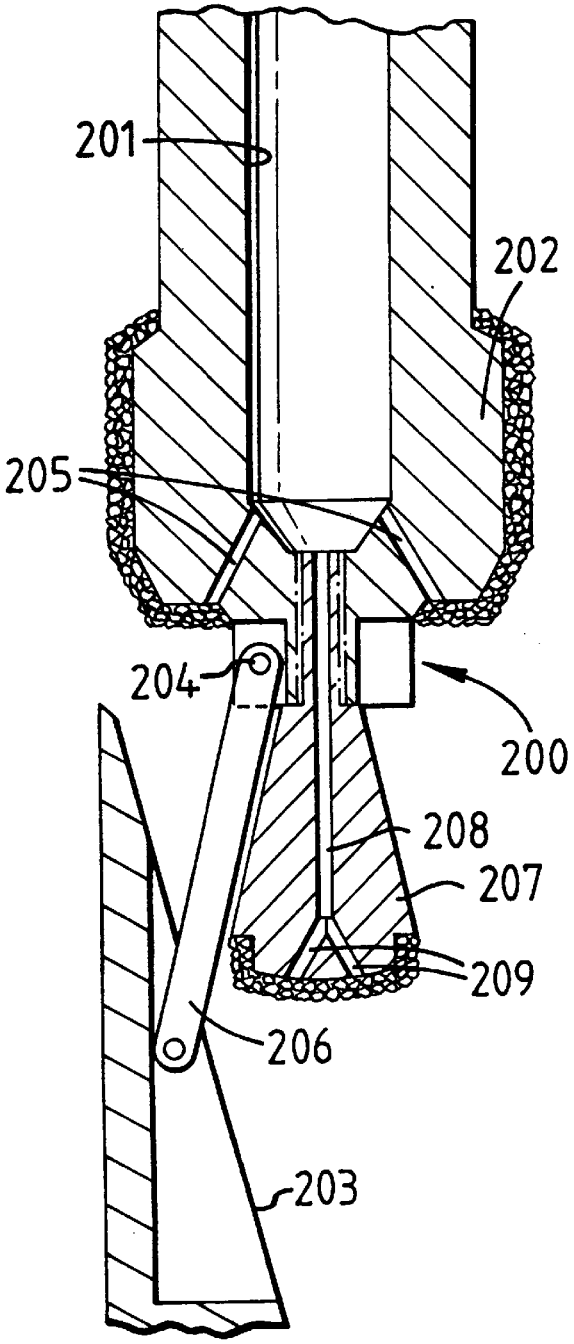

A milling system 200 shown in FIG. 13 is like the system 170 (FIG. 11) but a hinge 206 is pivotably connected directly to a mill 202 at one end and at the other to a concave 203. A central milling member 207 projects downwardly from the mill 202 and has fluid circulation channels 208 and 209 in fluid communication with a central fluid channel 201 of the mill 202. The mill 202 has typical fluid circulation channels 205. Any mill described or shown herein can have well-known fluid circulation channels to facilitate debris and cuttings movement and removal. A shear pin 204 is used to initially releasably hold the hinge 206 to the mill 202.

Figure 14:
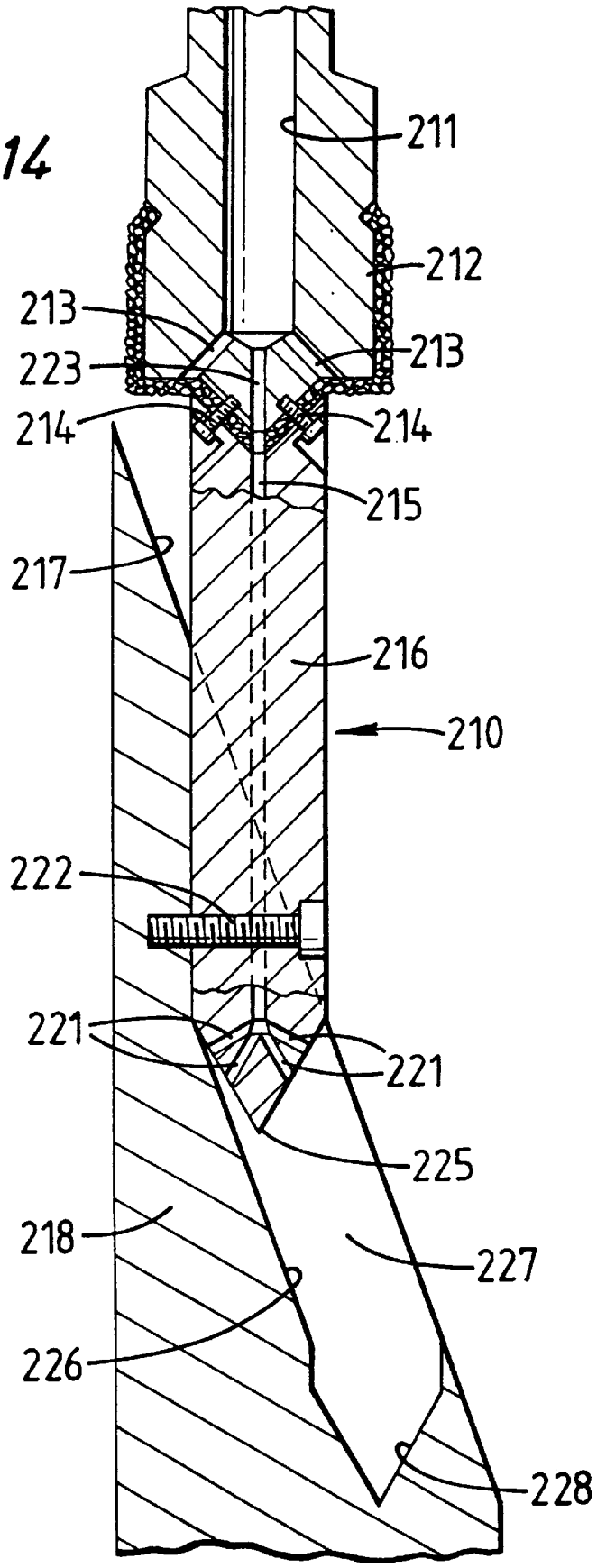

FIG. 14 shows a system 210 with a mill 212 having a central member 216 projecting downwardly and shear-pinned with a pin 222 to a concave 217 of a whipstock 218. This system is for milling a tubular (not shown) like the tubulars of the previously described systems. Circulating fluid flows through a string (not shown) to which the mill 212 is connected into a channel 211 of the mill 212, to wash ports 213 and through a channel 223 to a channel 215 of the central member 216 and then to wash ports 221 of the central member 216. Shear pins 214 releasably hold the central member 216 to the mill 212. A nose end 225 of the central member 216 is sized and configured to move down (upon shearing of the shear pin 222) a tapered surface 226 of a recess 227 in the concave 217 and then to be received in a correspondingly-shaped recess 228 in the concave 217. As the nose end moves, it spaces apart the mill 212 and concave 217 as the mill 212 begins to mill the tubular in which the system 210 is located. When the nose end 225 enters the recess 228, the shear pins 214 shear, freeing the mill 212 for milling the opening in the tubular and for milling the central member 216.

Figure 15:
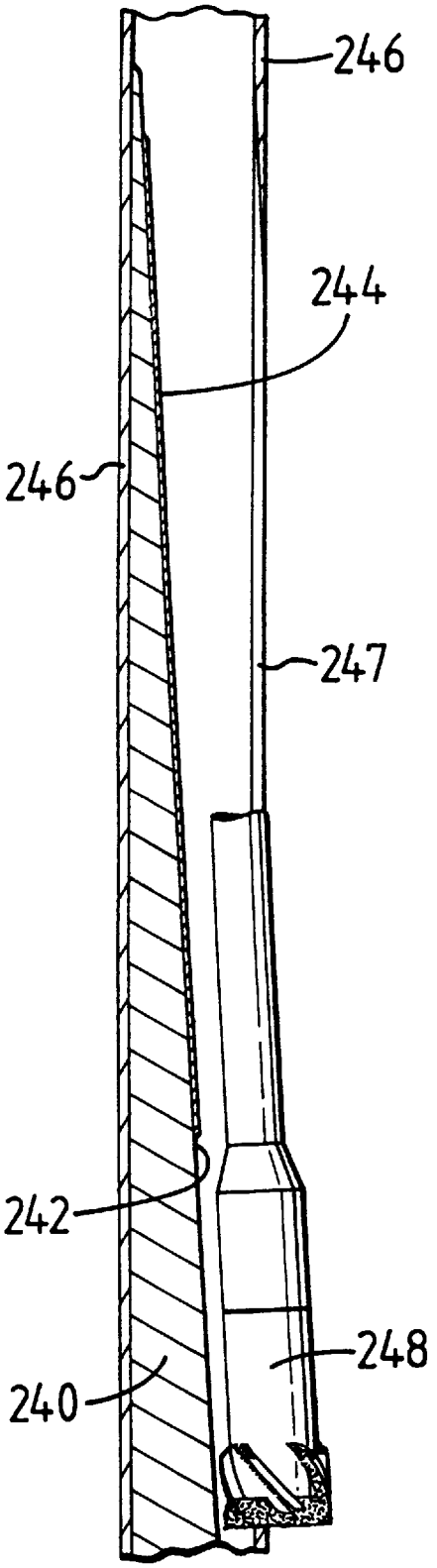
FIG. 15 is a side view in cross-section of a concave of a whipstock according to the present invention.

FIG. 15 shows a whipstock 240 with a concave 242 and an armored portion 244 of the concave 242 armored with armor material. In a particular embodiment in which the whipstock 240 is used in a tubular 246 (in a wellbore such as previously described wellbores) to mill a window 247 with a mill 248 (such as, e.g., mills previously described herein), the armor material is harder than the material of which the tubular 246 is made. Any previously described lug, concave, or part thereof, or nose may be armored with the armored material.

Figure 16:
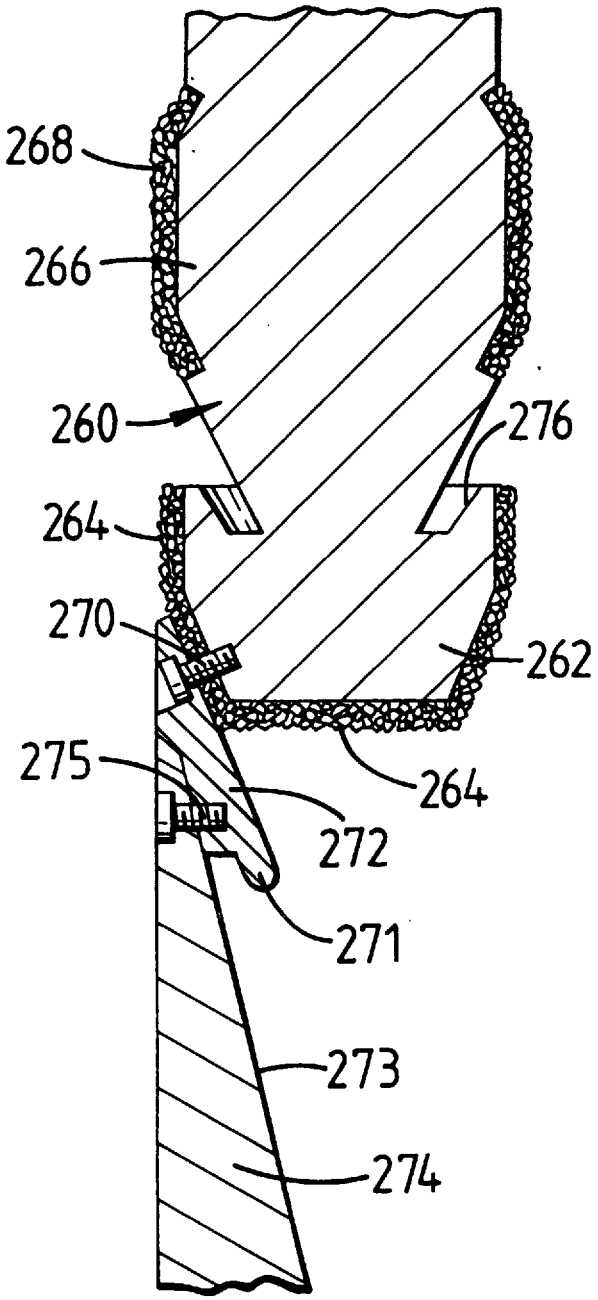
FIG. 16 is a side view in cross-section of a milling system according to the present invention.

FIG. 16 shows a mill 260 according to the present invention with a nose 262 dressed with milling material 264 and an upper portion 266 dressed with milling material 268. A shear pin 270 releasably connects the mill 260 to an armor member 272 which is itself releasably connected to a concave 274 of a whipstock by a shear pin 275. The mill 260 is useful to mill a tubular (as any tubular previously described herein). A recessed portion 276 of the mill 260 is configured, shaped, positioned and disposed to receive a finger 271 of the member 272 when the mill 260 is removed from the wellbore in which it is being used to remove the member 272 upon shearing of the shear pin 275.

Figure 17A:
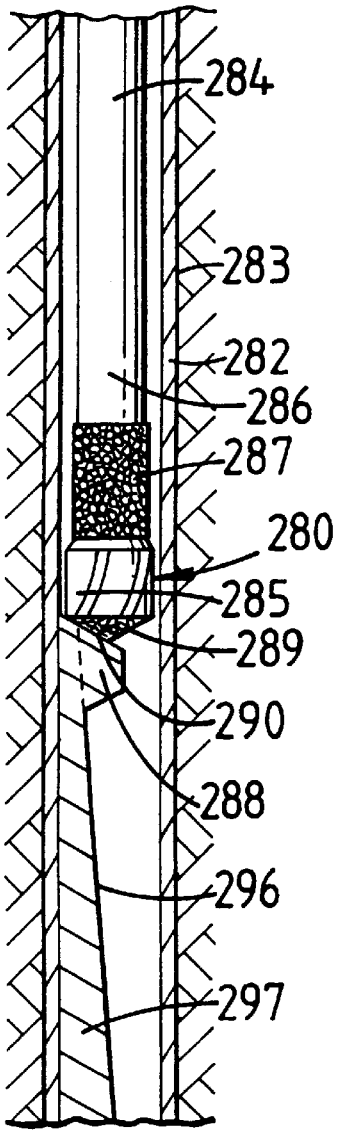
FIG. 17*a* is a side view in cross-section of a milling system according to the present invention.
Figure 17B:
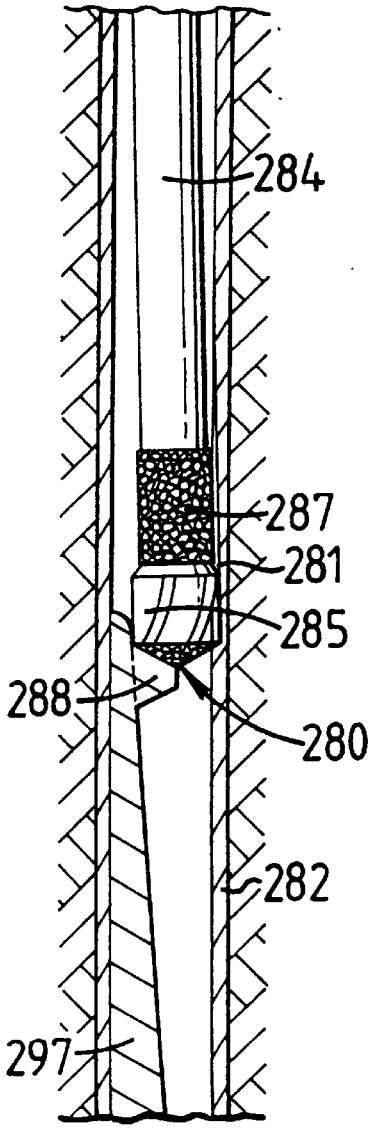
FIG. 17*b* is a temporally subsequent view to that of FIG. 17*a*.
Figure 17C:
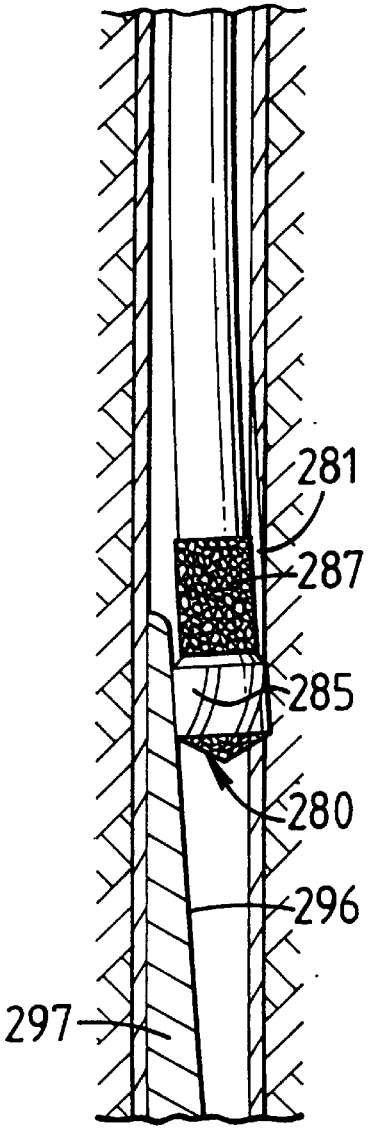
FIG. 17*c* is a temporally subsequent view to that of FIG. 17*b*.

FIGS. 17*a*–17*c* show a milling system 280 according to the present invention for milling a window 281 in a casing 282 in a wellbore 283. The milling system 280 is connected to a tubular string or coiled tubing 284 which extends to the surface and a mill 285 is rotated by a downhole motor (not shown) or by a rotary (not shown). The system 280 includes a tubular body 286 to which the mill 285 is secured and a sleeve 287 disposed around and fixed to the tubular body 286. Initially the mill 285 (see FIG. 17*a*) is releasably attached to a lug 288 of a concave 296 of a whipstock 297 set in the casing 282 (lug made, in one aspect, of wear resistant material), and the bottom of the mill 285 and sides of the mill 285 dressed with matrix milling material and presenting a rough surface to the casing 282. Preferably the sleeve 287 is dressed with milling matrix material and has a rough surface for smoothing edges of the opening made by the mill 285. The nose 289 of the mill 285 has a taper which corresponds to a taper 290 of the lug 288. As shown in FIG. 17*b*, the mill 285 has moved down on the lug 288 and initiated an opening through the casing 282. As shown in FIG. 17*c*, the mill 285 has begun milling the window 281 and has milled off the lug 288. The sleeve 287 may be rotatably mounted around the body 286.

When any system used herein results in a mill milling through the casing and then milling into formation outside the casing, an initial part of a lateral wellbore may be formed by the mill. This part, in certain embodiments, may extend for several feet, e.g. up to about two, ten, fifty, or a hundred feet. Alternatively a mill may be used which will advance a hundred yards or more into the formation.

Referring now to FIGS. 18*a*–18*h* and 19*a* and 19*b*, a tool 310 according to the present invention has a whipstock 320 according to the present invention with a pilot block 324 welded near a top 326 thereof. The whipstock has a concave face 322. The pilot block 324 has bolt holes 328.

The tool 310 has a starting bar 360 which has a body 362 which is secured to the whipstock 320 by bolts 369 through holes 363 extending into holes 328 in the pilot block 324. A groove 364 encircles the body 362. A stop bar 329 (see FIG. 21) extends through a stop pin hole 366.

Figure 18A:
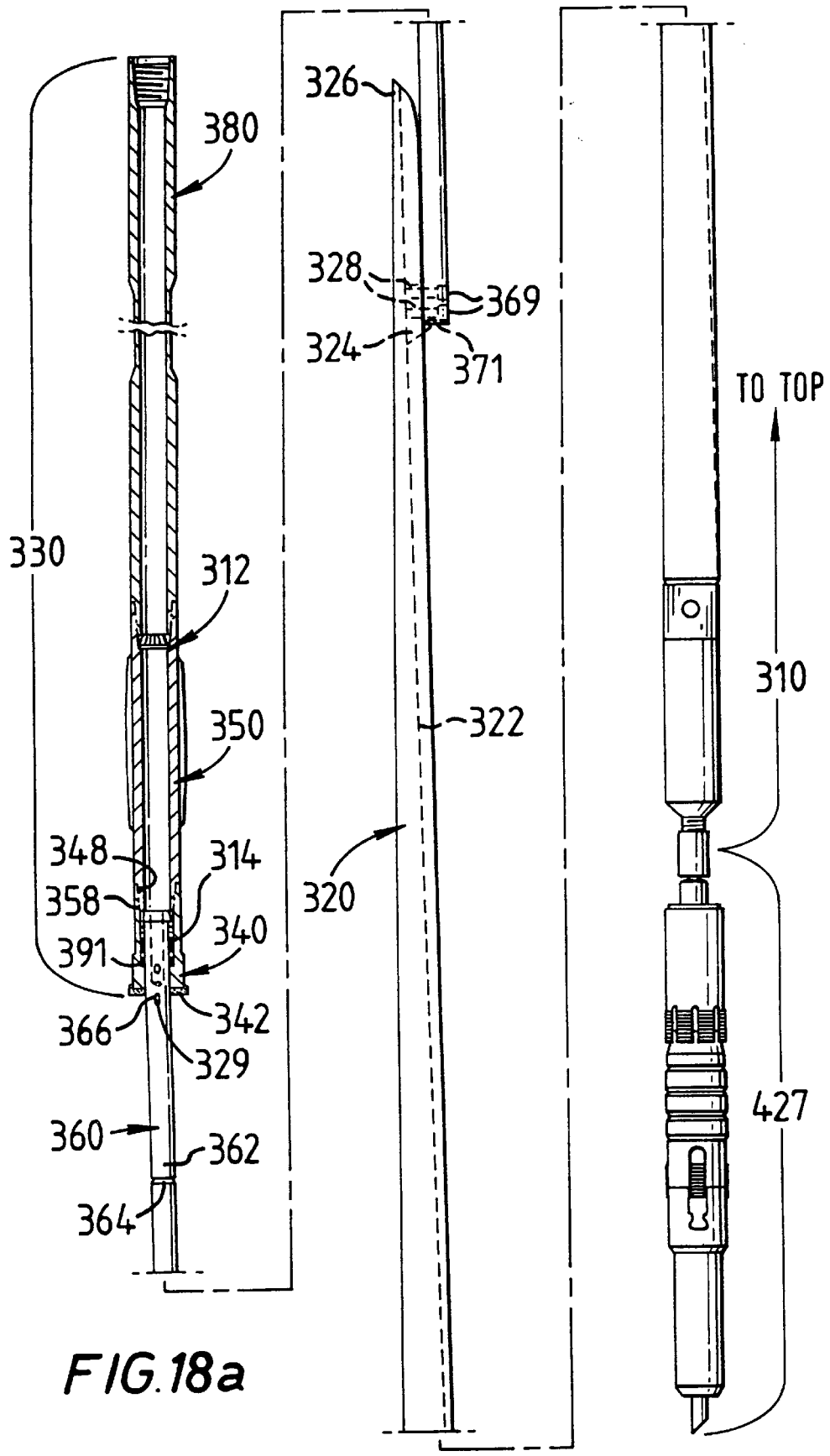
Figure 25:
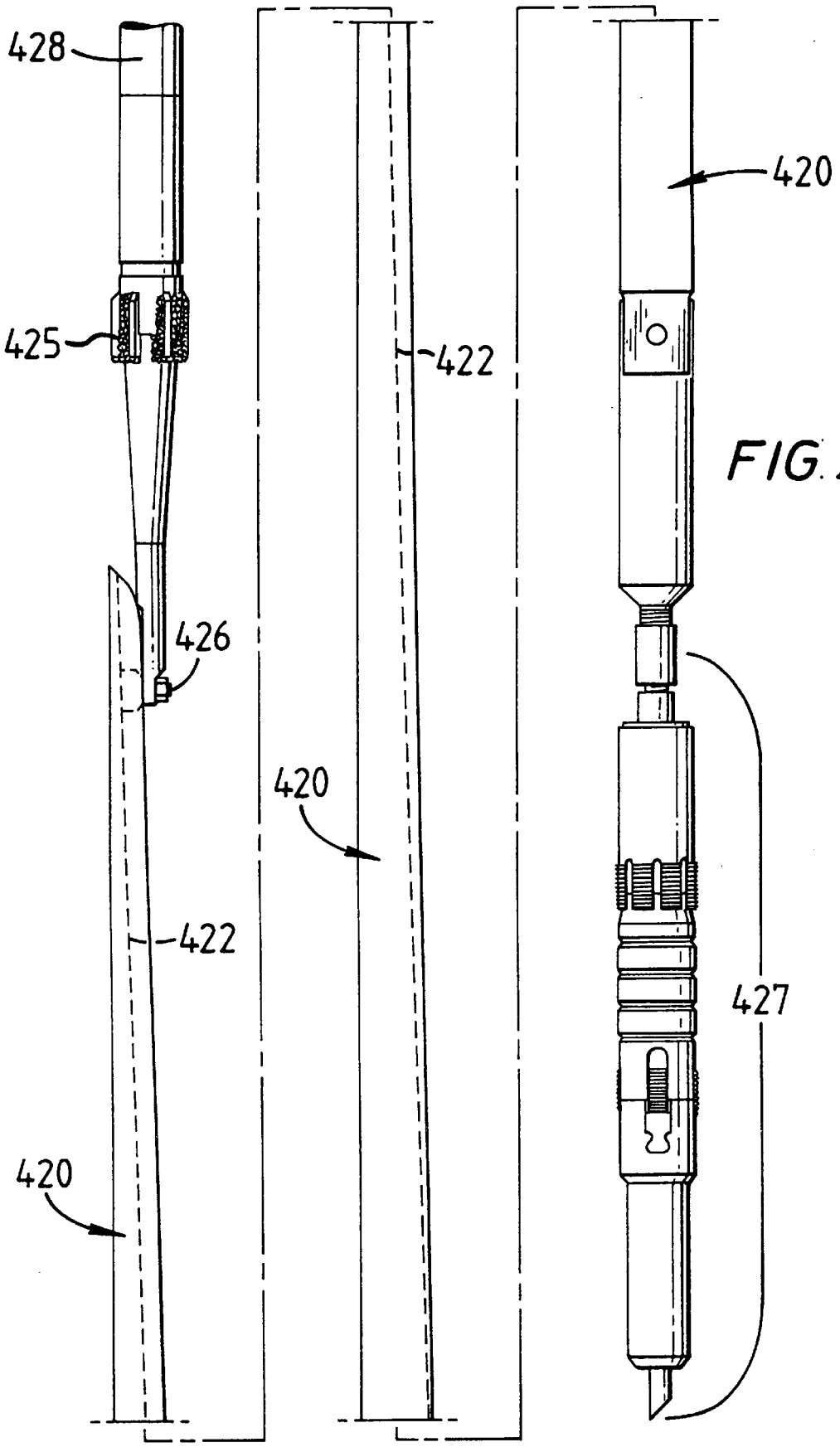
FIG. 25 is a side view of apparatus according to the present invention.

The tool 310 has the milling apparatus 330 which includes at least one and preferably two or more mills so that a milling operation for producing a sidetracking window in casing can be accomplished in a dual or single tool trip into a cased wellbore. As shown in FIGS. 18*a* and 19*a*, the milling apparatus 330 includes a starting mill 340 connected to and below a hollow finishing mill 350. Interior threads 348 of the starting mill 340 engage exterior threads 358 of the finishing mill 350.

The starting mill 340 has a central channel 344 therethrough and a cutting end with carbide cutters 342. A core catcher 314 is disposed within the starting mill 340 and rests on a shoulder 347 to receive and hold debris such as an initial casing sliver, etc. The core catcher 314 is a typical two-piece core catcher.

The finishing mill 350 has a plurality of milling blades 352 and a central channel 354 therethrough. A retainer 312 is disposed within the channel 354 and rests on a shoulder 357 of the mill 350. The retainer 312, as shown in FIG. 18g, preferably is a spring with a plurality of fingers 355 which are disposed so that the fingers 355 protrude into the groove 364 of the starting bar 360, preventing the starting bar 360 from moving downwardly from the position shown in FIG. 21.

To accommodate a substantial portion of the starting bar 360 when its length exceeds that of the combined lengths of the mill(s), a pup joint may be used such as the pup joint 380. External threads 386 on the lower end of the pup joint 380 engage upper internal threads 356 of the finishing mill 350. Upper internal threads 388 of the pup joint engage a part of a drill string (not shown) e.g. a crossover sub with a mud motor above it. A central channel 384 extends through the pup joint and is sized and configured to receive a portion of the starting bar 360.

FIGS. 19*a* and 19*b* illustrate steps in the use of a tool 310 according to this invention. As shown in FIG. 19*a*, the milling apparatus 330 has a top portion 365 of the starting bar 360 within the starting mill 340 and the starting bar 360 is secured to the whipstock 320. As shown in FIG. 19*b* the starting mill 340 and apparatus above it have pushed down on the bar 329, breaking it, and permitting the milling apparatus 330 to receive a substantial portion of the starting bar 360. The starting mill 340 has moved to contact the pilot block 324 and mill off the bar 329.

Milling now commences and the starting mill 340 mills through the pilot block 324. As the starting mill moves down the concave face of the concave member 320, the concave member 320 is moved sideways in the casing (to the left in FIGS. 19*a* and 19*b*) and a window is begun in the casing's interior wall. As shown in FIG. 21 the fingers 355 have entered the groove 364, preventing the starting bar 360 from falling out of the apparatus or from being pumped out by circulating well fluid. The starting bar 360 has an indented end 371 to facilitate entry of a core into the mill.

To move cutting and debris out of the wellbore a circulation fluid is, preferably, circulated downhole through the drill pipe, outside of and past the starting bar between the starting bar's exterior and the mills' interiors, past the core catcher, past a splined bearing 391, past the starting mill between its exterior and the casing's interior and back up to the surface.

As the milling apparatus mills down against the concave member, the finishing mill 350 smooths the transition from the casing edge to the wellbore to complete the milling operation. Then the milling apparatus is removed from the wellbore with the starting bar 360, casing sliver, debris, and core held within the interior of the mills.

Figure 26A:
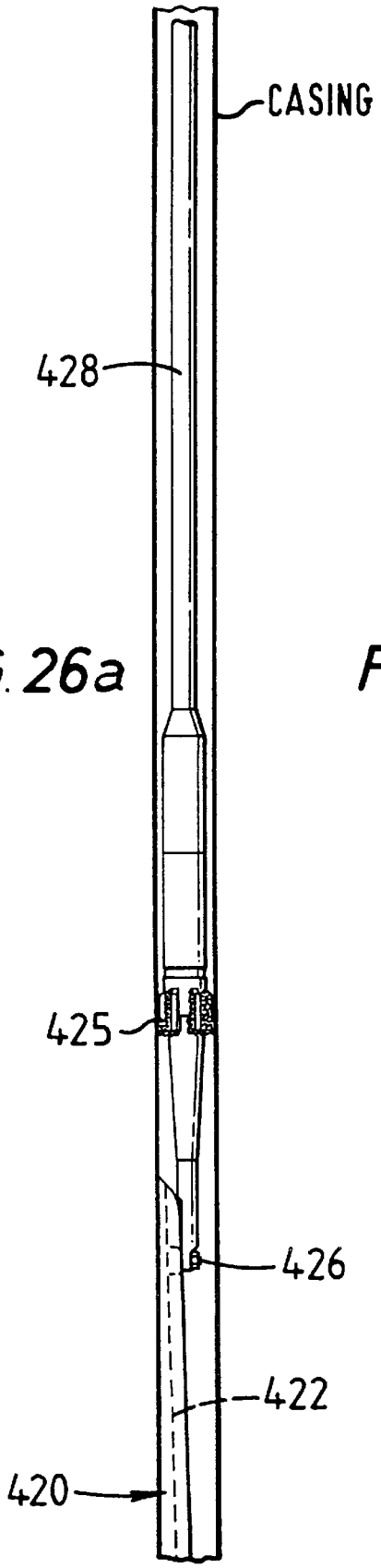
FIG. 26*a* is a side view of apparatus used in a method according to the present invention.
Figure 26B:
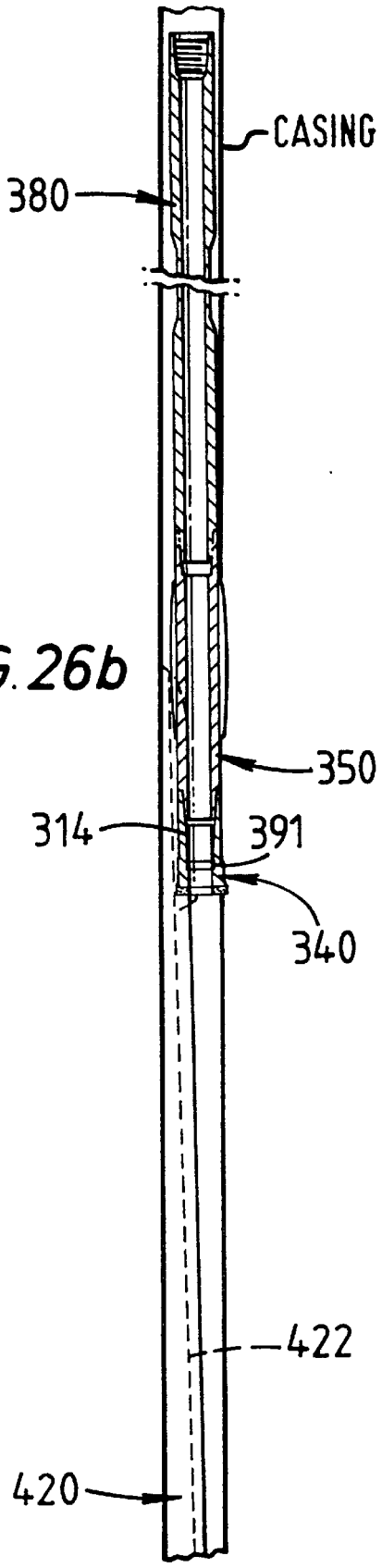
FIG. 26*b* is a side view of apparatus used in a method according to the present invention.

As shown in FIGS. 26*a* and 26*b*, in a two-trip milling operation according to the present invention, a tool 420 including a whipstock concave member 422 and a starting mill 425 secured thereto with a sheer stud 426 is run into a cased wellbore in which some type of anchoring-orientation device, e.g. a keyed packer (not shown), has been installed. Upon emplacement and orientation of the tool 420, the shear stud 426 is sheared by pushing down on the tool and milling is commenced producing an initial window or pocket in the casing. The tool 420 is removed leaving the whipstock concave member 422 in place and then a milling system (like the system shown in FIG. 19*b*) is run into the hole to continue milling at the location of the initial window or pocket. This milling system includes the items above the starting bar 360 in FIG. 19*a*, but not the starting bar 360; and the milling system, as shown in FIG. 26*b*, is used as previously described but without the starting bar. This two-trip operation results in a finished window through the casing.

Figure 27A:
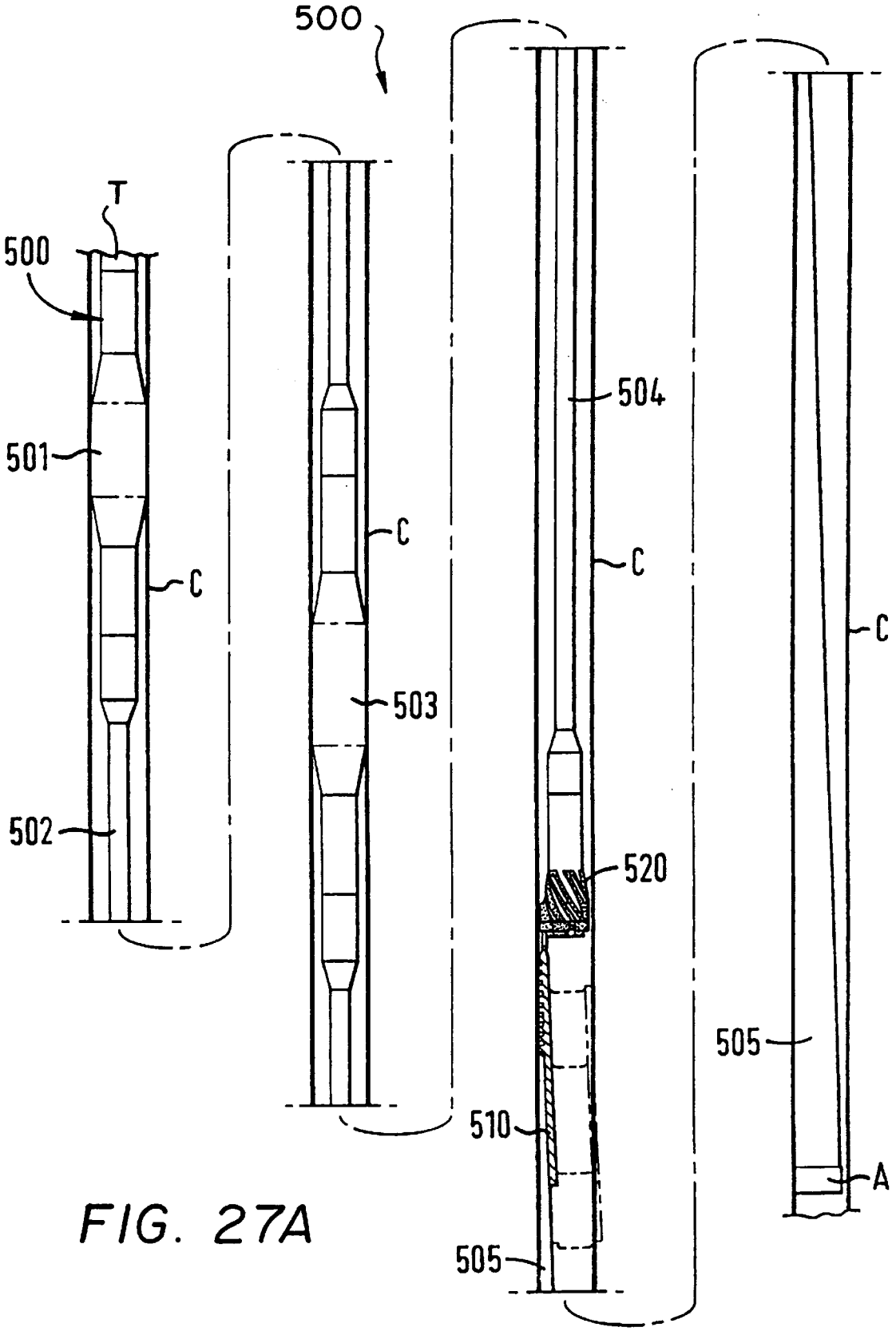
FIG. 27A is a side view in cross-section of a wellbore tool system according to the present invention.

As shown in FIG. 27A a system 500 has a top watermelon mill 501 (shown schematically in FIG. 27A) which is connected to a flexible member, flexible pipe, or flex sub 502. The flex sub 502 is connected to a second watermelon mill 503 which is connected to a second flex sub 504. The flex sub 504 is connected to a cutting tool, in one aspect a mill-drill tool 520. The mill-drill tool 520 is releasably connected to a sacrificial face element 510. The sacrificial face element is connected to a whipstock 505. The whipstock 505 is anchored in a tubular, e.g. casing C of a casing string in a wellbore, by an anchor A which is any known anchor, anchor-packer, packer, or setting apparatus.

It is within the scope of this invention to use any known mill or mill combination instead of the mill-drill tool 520, although such a substitution is not a legal equivalent of the mill-drill tool 520. It is within the scope of this invention to use any additional mill or combination of mills with the mill-drill tool 520 other than or in addition to the watermelon mills (or either of them) shown in FIG. 27A. It is within the scope of this invention to divert the mill-drill tool 520 with any known diverter or whipstock or with any known movable joint(s), knuckle joint(s), or selectively actuable device for moving the mill-drill tool [(or mills)] laterally.

Figure 28A:
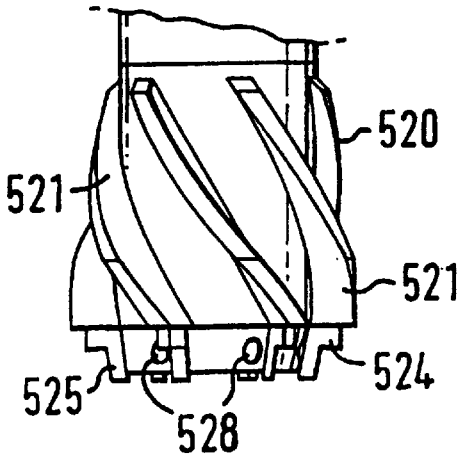
FIG. 28A is a side view of a mill of the system of FIG. 27A.
Figure 28B:
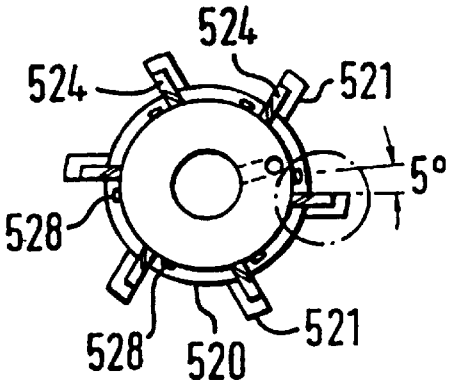
FIG. 28B is an end view of the mill of FIG. 28A.
Figure 28C:
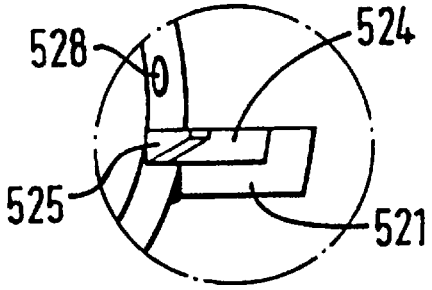
FIG. 28C is an enlargement of part of the mill as shown in FIG. 28B.
Figure 29A:
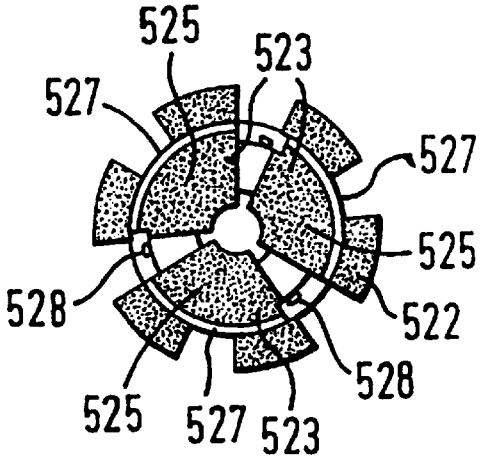
FIG. 29A is an end view of the mill of the system of FIG. 27A.
Figure 29B:
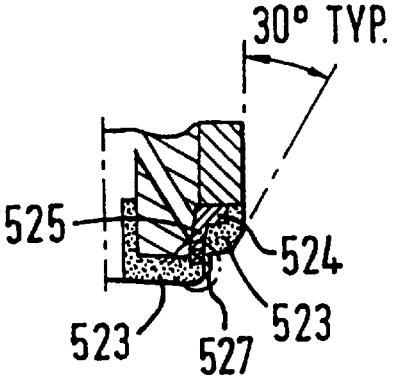
FIG. 29B is a side view in cross-section of part of the mill as shown in FIG. 29A.
Figure 29C:
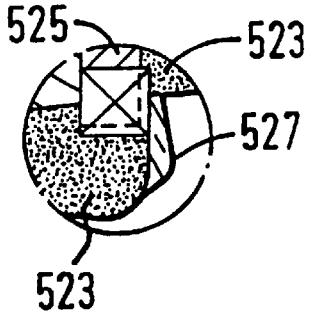
FIG. 29C is an enlargement of part of the mill as shown in FIG. 29B.

As shown in FIG. 28A, the mill-drill tool 520 (shown without the material 527) has side blades 521 dressed with matrix milling material 522 (see FIG. 27B). In one aspect the exterior blade surfaces of the side blades 521 are smooth (e.g. ground smooth with a grinder). The matrix milling material may be any known mill dressing material applied in any known manner.

Matrix milling material 523 covers lower ends 524 of the side blades 521 (see, e.g. FIG. 28A). Blades 525 (see FIG. 28A) on a nose 526 of the mill-drill tool 520 are initially laterally protected with a relatively soft material 527 (e.g. but not limited to bearing material such as brass) and, optionally partially or wholly covered with wear away material or with matrix milling material 523. Fluid under pressure, pumped from the surface, exits through ports 528 at the lower ends 524 of the side blades 521. Blades 525 may be milling blades or drilling blades or a combination thereof. Alternatively a drill bit or drilling part of a drill bit may be used instead of the blades 525. To initially isolate, cover, and/or protect the blades 525 or apparatus 555 (FIG. 31), instead of separate and distinct members or bodies 527, a cylindrical member (closed off or open at the bottom, a ring, or a hollow cap may be used, either secured immovably to the body, blades, or apparatus or rotatably secured thereto. The material 523 may act like a bearing or bearing material may be used in its place so that the side portion of tool acts as a bearing.

Two fingers 511 extend upwardly from a body 512 of the sacrificial face element 510. The fingers 511 are releasably connected to the mill-drill tool 520 (e.g. by shear bolts). Knobs 513 project from the body 512. From top to bottom the knobs project increasingly from the body 512 to correspond to a taper of the whipstock 505. Alternatively a series of grooves (up-and-down or side-to-side) may be used instead of the knobs 513. It is within the scope of this invention to employ at least one recess, a series of recesses, or a series of recesses at angles to each other to reduce the amount of material of the element 510. The sacrificial face element 510 may be welded or bolted to the whipstock. In one aspect the sacrificial face element 510 is made of millable material or bearing material (e.g. bearing bronze). In one aspect the element 510 is made of bronze. In milling down the body 512 of the element 510, the mill-drill tool 520 mills the body 512 more easily than if material were present between the knobs 513. Instead of an integral solid remainder of the body 512 left after the mill-drill tool 520 has passed, small pieces of the body 512 (knobs or knobs with portions of the body 512) are left rather than a floppy piece which impedes operations or large pieces which may be difficult to mill or to circulate. Small pieces or chunks may fall down and/or fall away following milling and are more easily circulated away from the milling location and/or out of the hole.

Figure 30A:
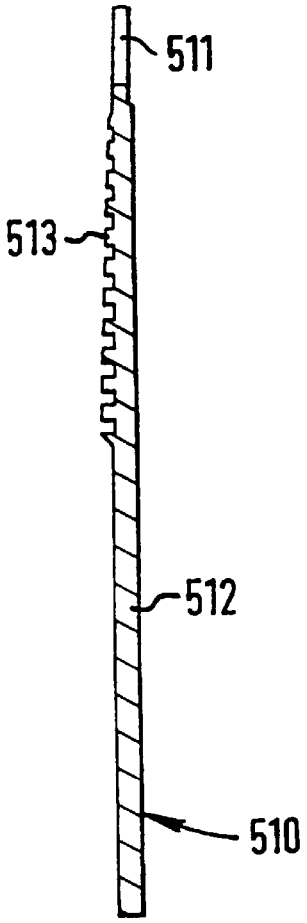
FIG. 30A is a side view of a sacrificial face element of the system of FIG. 27A.
Figure 30B:
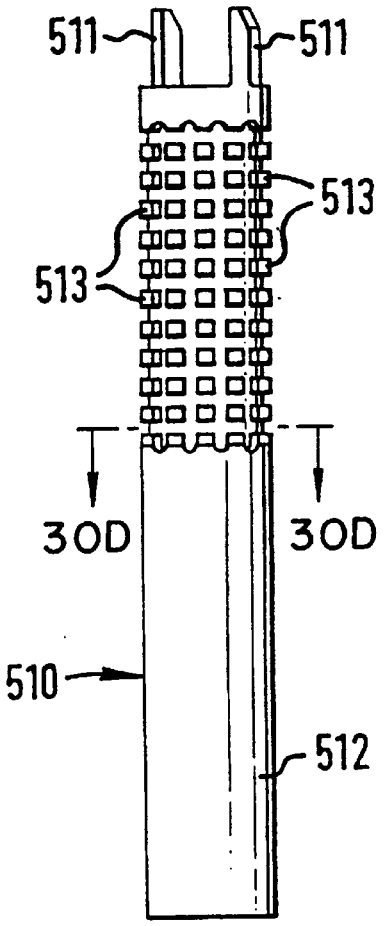
FIG. 30B is a front view of the element of FIG. 30A.
Figure 30C:
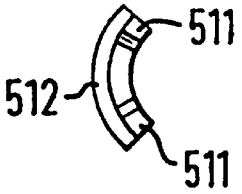
FIG. 30C is a top view of the element of FIG. 30A.
Figure 30D:
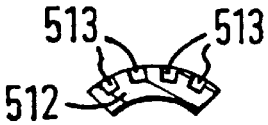
FIG. 30D is a cross-section view along line 30d—30d of FIG. 30B.
Figure 30E:
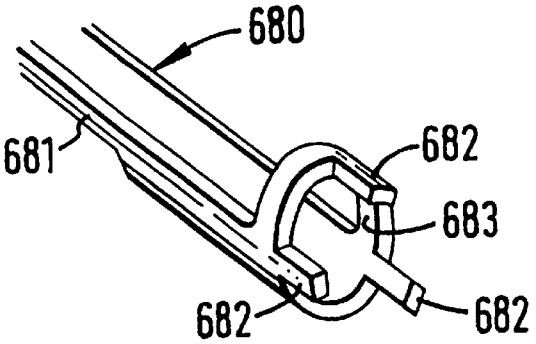
FIG. 30E is a perspective view of an element according to the present invention.

FIG. 30E shows an alternative sacrificial face element 680 with a body 681 and fingers 682 projecting from a ring 683. One or more of the fingers 682 are releasably connectible to a mill, mill system, or mill-drill tool (e.g. in a manner similar to that as described for the element 510). The element 680 is made of steel, plastic, metal millable or drillable material, or bearing material in certain embodiments, or any of the materials out of which the element 510 is made. A knob structure (see knobs 513 of the element 510) may be provided for the element 680. As is the element 510, the element 680 is securable to a whipstock and the body 681 (shown partially) may extend for any desired and suitable length along a whipstock and the body may have any desired taper to correspond to a whipstock on one side and to direct cutting apparatus on the other side. The ring 683 is sized, in one aspect, so a nose or projecting lower end of a mill or mill-drill tool may extend into the ring and, in one aspect, contact the ring for stability. The ring also strengthens the element.

Figure 31A:
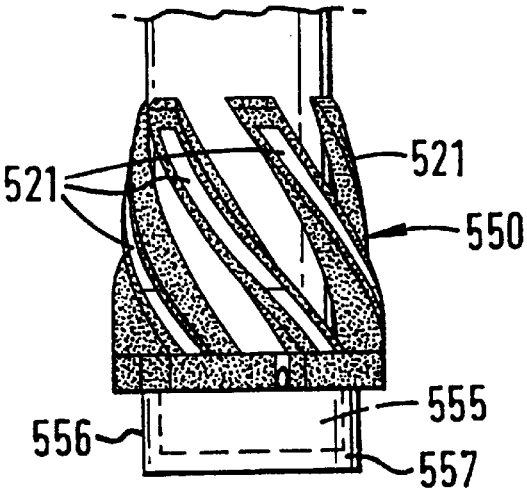
FIG. 31A is a side view of a milling-drilling tool according to the present invention.

FIG. 31A shows a mill-drill tool 550 (similar to the mill-drill tool 520 with like parts bearing the same indicating numerals). Drilling apparatus 555, shown schematically by a dotted line, is initially covered by a material 557 which may be worn away by contact with a tubular and/or formation. In one aspect, as with the system 500, the material is not worn away until milling blades have milled the tubular allowing the material 557 to contact the tubular. A nose 556 including the material 557 and drilling apparatus 555 is sized, configured, and located on the mill-drill tool 550 so that the material 557 is not worn away or worn away only minimally until the nose 556 contacts the tubular. By using bearing material as the material 557 movement of the nose down and against the sacrificial element (e.g. element 510) is facilitated. The drilling apparatus 555 may be any suitable known drilling apparatus which can cut the tubular and the formation in which it extends. In another aspect drill apparatus is positioned under or within, or interspersed with milling apparatus. In another aspect the material 557 is known matrix milling material used, optionally, with known milling inserts or cutting elements, with or without chipbreakers, in any known pattern or array.

FIG. 31B shows a mill-drill tool 650 with a cylindrical body 651 (shawn partially), a plurality of milling blades 652 dressed with matrix milling material, and two rotatable drill bit roller cones 653. (One, three, four, or more such cones may be used.) As viewed in FIG. 31B, the drill bit roller cones 653 may be disposed to project beyond (upwardly in FIG. 31B) a top surface 654 of the milling blades 652. Alternatively, the cones may be at a similar level as or below the top surfaces 654.

FIG. 31C shows a drill bit roller cone 660 with a rotatable cone 664 on a body 661 (which is mountable or formable in known manner as part of a ddrill bit or mill-drill tool), the cone having thereon stubs of ddrilling material 662 and a projecting body 663 of milling material, e.g. welded to the body 661. Such a cone may replace the one or more of the cones of the mill-drill tool 650. k Alternatively a blade body may be formed on the body 661 which is then dressed with matrix milling material.

FIG. 31D shows schematically a mill drill tool 670 with a cylindrical body 671 having a fluid flow bore 672 therethrough, a milling surface 673 and a rotatable drill bit roller cone 674 rotatably mounted to the body. Optionally lateral milling blades may be provided on the vertical sides of the body 671.

FIG. 27B shows the system 500 in a cased wellbore with various positions of the mill-drill tool 520 shown in dotted lines. Initially (as shown) the mill-drill tool 520 has not been released from the fingers 511. Following release from the fingers 511 and downward movement, the lower ends 524 of the blades 521 have milled away a portion of the sacrificial element 510 including the fingers 511 and the outer blade surfaces have moved to contact at point A an inner surface S of a casing C in a wellbore. A distance d is, preferably, of sufficient extent that the lower blade surface along the distance d is wider than the casing thickness t. The blades mill down the sacrificial element 510, leaving "chunks" thereof behind as the mill-drill tool 520 moves onto the whipstock 505 and blades reach the outer surface of the casing at point B. The outer blade surfaces which contact the whipstock are, preferably, smooth to facilitate movement of the mill-drill tool 520 down the whipstock 505 and to minimize milling of the whipstock 505 itself. The mill-drill tool 520 continues downwardly (e.g. rotated all the while by a surface rotary or by a downhole motor in the string at some point above the mill-drill tool), milling away the sacrificial element 510, moving down the whipstock 505, milling through the casing C, to a point C at which outer surface of the material 527 of the nose 526 contacts the inner surface of the casing C. At this point the material 527 begins to be worn away, exposing the drilling apparatus, milling apparatus, or milling-drilling apparatus underneath the material 527. The mill-drill tool 520 continues to mill down the casing to a point D at which the nose 526 begins to exit the casing C and the mill-drill tool 520 begins to cut the formation outside the casing C. The mill-drill tool moves down the whipstock 505 forming the beginning of a lateral wellbore. A lateral wellbore L thus formed is shown in FIG. 27C. Such a wellbore may be any desired length including, but not limited to: about one foot long; two feet long or less; five feet long or less; between five feet and fifty feet long; one hundred feet long or less; between about one hundred and about two hundred feet long; or two hundred or more feet long.

When a full gauge body is used for the mill-drill tool 520, the resulting window and lateral wellbore are full gauge, i.e. a desired diameter and no further milling is required—as opposed to certain prior art systems using a tool which is less than full gauge, e.g. an under gauge lead mill, producing a "rathole" of a smaller diameter than the diameter of the bore above the rathole which must be milled further to enlarge it to the desired diameter—often requiring one or more additional trips into the wellbore or requiring the drilling of an excessively long rathole.

By using a system as described herein, a completed lateral wellbore of a desired diameter can be achieved which extends only a relatively short distance from the casing; i.e., the extent to which the lateral wellbore's initial opening extends into the formation can be relatively small which facilitates the production of a lateral wellbore at a desired angle to the primary wellbore. With certain prior art systems which do not use a full gauge tool body and which do employ narrower mills, e.g. under gauge lead mills, when the desired window is completed the lateral wellbore (including the portion of the formation of narrow diameter into which the starting mill has moved) may be ten, fifteen, twenty or more feet long. It is relatively difficult to produce a lateral wellbore turned at a desired angle from such a relatively long initial lateral wellbore. With systems according to the present invention a uniform diameter relatively short full gauge initial lateral wellbore is produced in the formation in a single trip. In one aspect such an initial lateral wellbore is five feet long or less, three feet long or less, two feet long or less, or about one and a half feet long. It is also within the scope of this invention to use multiple blade sets, i.e. one or more additional sets of blades above the mill-drill tool 520 e.g. as described below.

The sacrificial element 510 may be made of plastic, fiberglass, composite, fiber-reinforced plastic, cermet, ceramic, metal (steel, mild steel, zinc, aluminum, zinc alloy, aluminum alloy), metal alloys, brass, bronze or metal matrix composites.

Filed on Jul. 30, 1996 and co-owned with this application is the U.S. application Ser. No. 08/688,301 entitled "Wellbore Window Formation" incorporated fully herein for all purposes and a copy of which is filed herewith as part hereof and as an appendix hereto. Incorporated fully herein for all purposes is pending U.S. application Ser. No. 97/642,118 filed on May 2,1996 entitled "Wellbore Milling System." All applications and patents referred to herein are incorporated fully herein for all purposes.

Figure 32A:
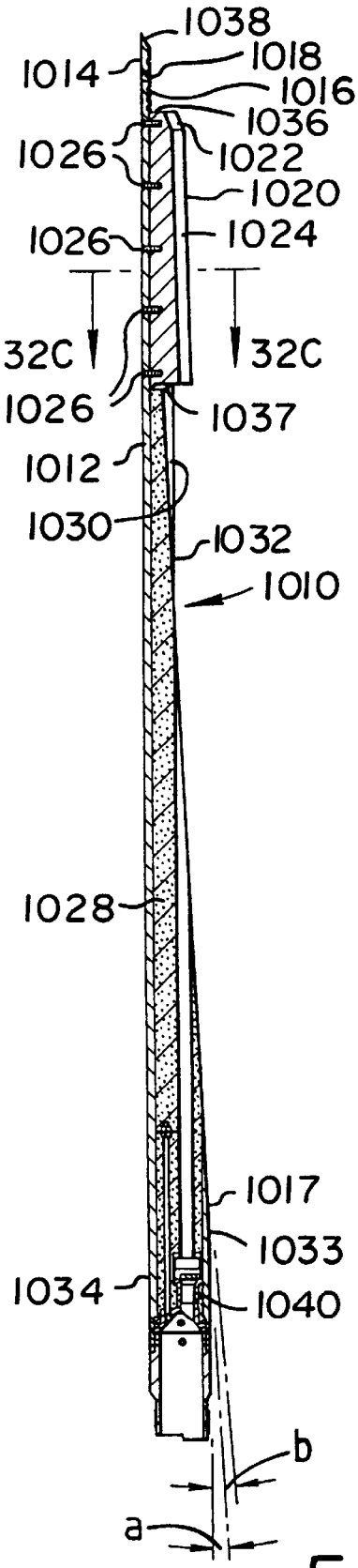
FIG. 32A is a side view in cross section of a system according to the present invention.

FIG. 32A shows a system 1010 according to the present invention having a whipstock body 1012, a sacrificial element 1020 with two guiding faces secured to the whipstock body 1012 with bolts 1026, filler 1028 in a recess 1030 of the body 1012, and a plug element 1040 in a bottom 1034 of the whipstock body 1012.

Figure 36A:
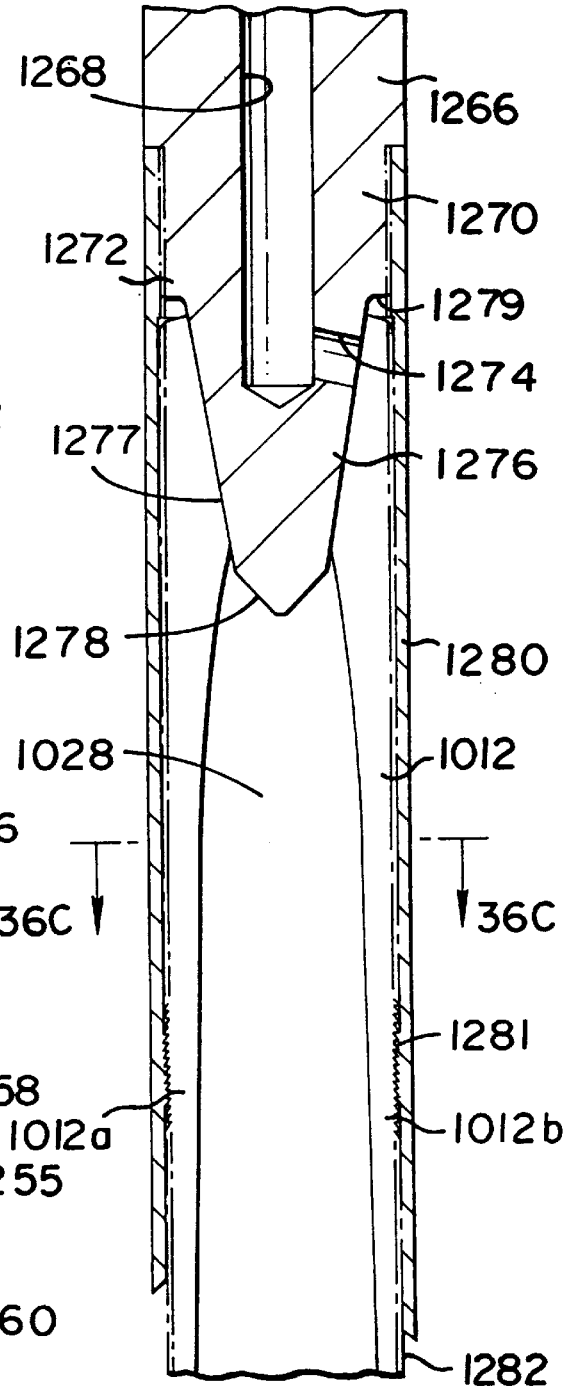
FIG. 36A is a side view in cross-section of a retrieving tool according to the present invention.
Figure 36B:
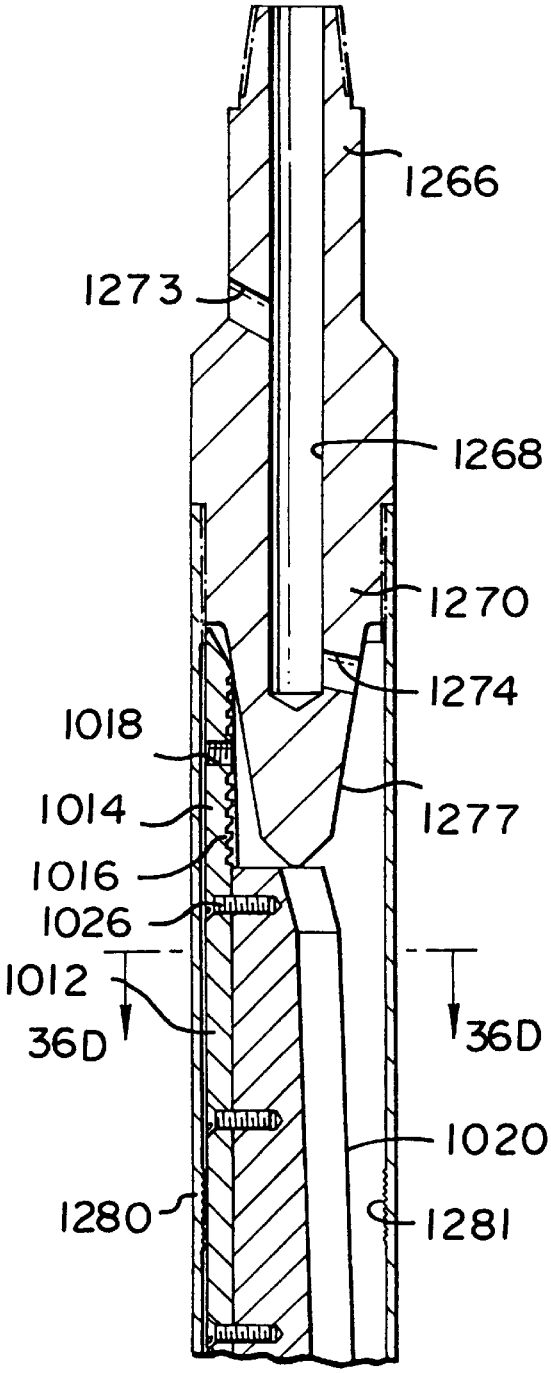
FIG. 36B is a side view in cross-section showing the tool of FIG. 36A engaging a whipstock.
Figure 36C:
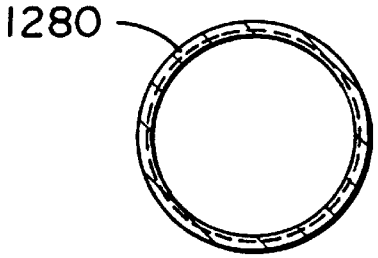
FIG. 36C is a cross-section view along line 36C—36C of FIG. 36A (with the whipstock omitted).
Figure 36D:
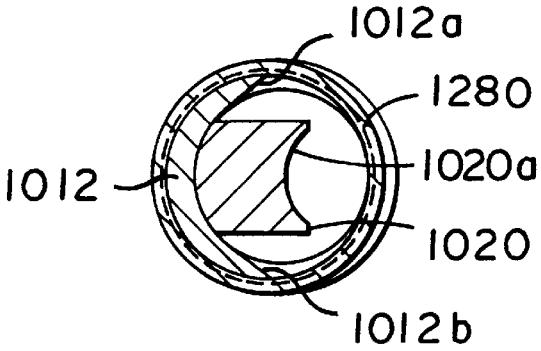
FIG. 36D is a cross-section view along line 36D—36D of FIG. 36B.

A top 1014 of the whipstock body 1012 extends above the sacrificial element 1020 (preferably made of readily millable material, e.g. brass, bronze, composite material, iron, cast iron, typical relatively soft bearing materials, soft steels, fiberglass, aluminum, zinc, other suitable metals, or alloys or combinations thereof) and has a sloped ramp 1038 (or a top shoulder 1035 as shown in FIG. 36B). One-way teeth 1016 are formed in the top 1014 so that a member (not shown in FIG. 32A) with corresponding teeth may push down on the whipstock body 1012 so that exerted force is transmitted from the corresponding teeth of the member to the whipstock body 1012 and so that the teeth 1016 and the corresponding teeth on the member slide apart when pulling up on the member with sufficient force. A hole 1018 provides an opening for receiving a connector to connect the member to the whipstock body 1012.

The first face 1022 of the sacrificial element 1020 is slanted so that a mill with an appropriate corresponding ramped portion contacts the first face 1022 and is directed away from the whipstock body 1012 (at an angle of between 5° to 25° and in one aspect about 15° from the central longitudinal axis of the body) e.g. to commence milling of a tubular (not shown), e.g. casing or tubing, in which the system 1010 is anchored. Any suitable known anchor device may be used. The second face 1024 is configured, sized and disposed for further direction of a mill away from the whipstock body 1012 as it mills the tubular.

In one aspect as a mill moves down against the sacrificial element 1020, it mills a portion of the sacrificial element 1020 rather than milling the whipstock body 1012. A third face 1032 includes sides or "rails" 1012*a*, 1012*b* (see FIGS. 32C, 41B, and 36A) of the whipstock body 1012 which are sufficiently wide and strong to guide a mill moving downwardly adjacent the whipstock. A fourth face 1033 extends below the third face 1032. In one aspect the fourth face 1033 is straight and the third face 1032 is a chord of a circle. The first, second, third, and fourth faces may each be straight or curved (e.g. a chord of a circle) as desired and either inclined at any desired angle in a straight line away from a longitudinal axis of the body or curved as a chord of any desired circle.

Figure 32B:
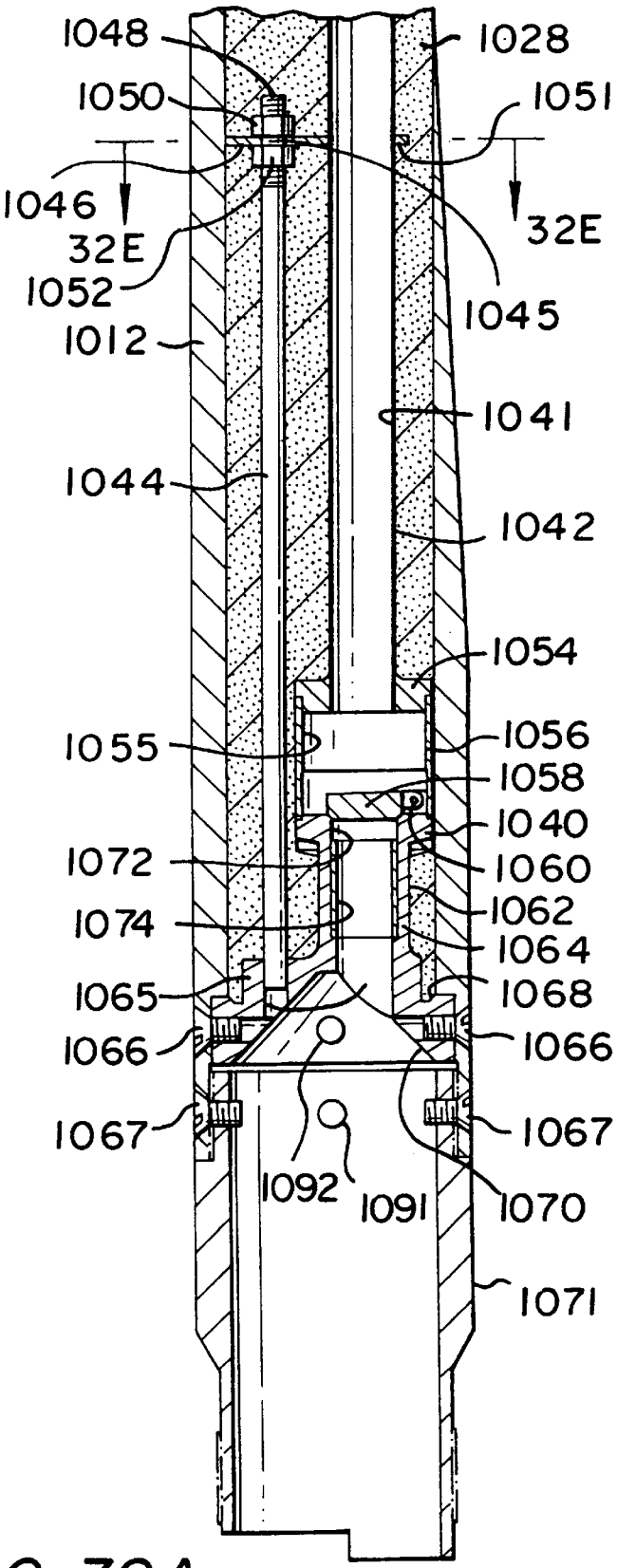
FIG. 32B is an enlargement of part of the system of FIG. 32A.

The plug element 1040 is secured in the bottom 1034 of the whipstock body 1012. The plug element 1040 retains the filler 1028 within the recess 1032. Via a channel 1041 through a tube 1042 (e.g. made of readily millable material), a channel 1055 through a valve body 1056 (e.g. made of readily millable material), a channel 1072 through a body 1062, and a sleeve 1074 in a body 1064, fluidflow through the plug element 1040 is possible when a valve member 1058 rotates upwardly about a pivot 1060. As shown in FIG. 32B the valve member 1058 is closing off fluid flow from above the plug element 1040 to beneath it, either due to the fact that there is little or no fluid flow and gravity holds the valve member 1058 down or the force of fluid flow from below into the channel 1072 is insufficient to overcome the weight of fluid on top of the valve member 1058. Epoxy or some other suitable adhesive may be used to hold the body 1062, body 1064, and sleeve 1074 together.

As shown in FIG. 32C, in one aspect a surface 1020*a* of the sacrificial element 1020 is shaped and configured as part of a curve to correspond to a curved outer shape of a nose of a mill to facilitate milling and guide a mill moving down the sacrificial element. E.g., a mill 1200 described below has a nose 1240 with a cylindrical portion 1244 that matches the curve of the surface 1020*a* and a tapered portion 1243 is also sized and configured to co-act effectively with the surface 1020*a*. These corresponding curved shapes make possible line contact rather than point contact between the mill and the surface 1020*a* so that enhanced guiding of the mill is achieved.

Preferably the plug element 1040 is off center with respect to a central longitudinal axis from top to bottom of the whipstock body 1012 to facilitate eventual milling out of the filler 1028 and of the plug element 1040 from the recess 1030.

To insure proper positioning of the plug element 1040 upon installation in the recess 1030 and to hold the plug element 1040 in position as filler 1028 is fed into the recess 1030, a rod 1044 (e.g. made of readily millable material) is secured at its bottom end in a hole 1063 in a part 1065 of the body 1064 and at its top end 1048 by nuts 1050 and 1052 in a hole 1045 in a locating plate 1046 which itself is secured in place by hardened filler 1028 (see FIG. 32E). The tube 1042 passes through a hole 1051 in the locating plate 1046.

Bolts 1066 (e.g. readily millable material) hold a part 1065 of the body 1064 in place. Bolts 1066 also connect an adapter 1071 to the whipstock body 1012. The adapter 1071 is connected to an anchor device (e.g. mechanical anchor, anchor packer, packer, etc). Additional bolts 1066 (not shown) extend through the holes 1091, 1092.

As shown in FIG. 32F, following milling out of the filler 1028 and of the plug element 1040 a ring 1090 remains which has as its lower part at one side a portion of a ramped part 1070 of the body 1064 and a portion of a ramped part 1068 of the body 1064. These remaining ramped portions (on the right side of the ring 1090 as viewed in FIG. 32F) facilitate the passage of other members, tools, or devices past the ring 1090.

The ring 1090 as shown in FIG. 32F results when the wellbore in which the system 1010 is used is non-vertical so that the whipstock body 1012 is tilted to one side within the wellbore. The ring 1090 results from milling when the "low side" of the wellbore is the left side of the apparatus as viewed in FIG. 32F. For this reason the portion of the bolts 1066 initially projecting into the body 1012 and into the adapter 1071 are completely milled away since the mill is moving along this side of the apparatus—and it is for this reason that the mill, which must have some clearance to move in the apparatus, does not completely mill off the portion of the bolts projecting into the apparatus from the "high side" (right side) in FIG. 32F. So that such milling does not create a stop member within the apparatus, the remaining part of the ramped portions 1068 and 1070 are used along which a tool may move more easily as compared to a ring with portions projecting normal to the apparatus side wall. In a vertical or nearly vertical hole, milling produces a resulting ring with a ramped portion around all or around substantially all of the top and bottom of the ring. If desired, a ramp may be used on only one side (top or bottom, e.g. 1068 or 1070) of the original ring.

When the system 1010 is being inserted into a wellbore, fluid in the wellbore is permitted to flow up through the plug element 1040 as the valve member 1058 opens in response to the fluid. The fluid flows up and out from the whipstock body 1012 through the channel 1041 of the tube 1042, thus buoyancy of the system 1010 is not a problem while it enters and passes down through the wellbore.

Preferably parts of the plug element 1040 are made of brass, plastic, bronze, epoxy resin, aluminum, composite material, iron, cast iron, relatively soft bearing material, fiberglass, some other readily millable material, or a combination thereof. In certain aspects the locating plate 1046, rod 1044 and tube 1042 are positioned so that the plug element 1040 will be on the "high side" when the system 1010 is disposed in a non-vertical wellbore (with the rod 1044 closer to the "low side" than the tube 1042).

The plug element 1040 serves to maintain filler 1028 in the recess 1030 as the filler is initially fed into the recess 1030 and prior to setting of the filler. The plug element 1040 maintains the filler 1028 in the recess 1030 when a mill is milling out the filler 1028 thus preventing a mass of the filler 1028 from exiting the whipstock body 1012 and falling down into a wellbore. The plug element 1040 also prevents the force of a hydrostatic head of fluid in the wellbore from pushing the filler 1028 or part of it upwardly and out from the recess 1030. Any known and appropriate valve device or apparatus may be used instead of the valve member 1058. To facilitate maintenance of the filler in the recess, interior indentations or threads may be provided on the recess and/or an initial coating of epoxy resin and/or fiberglass fibers is applied to the interior of the recess and allowed to set.

Figure 33A:
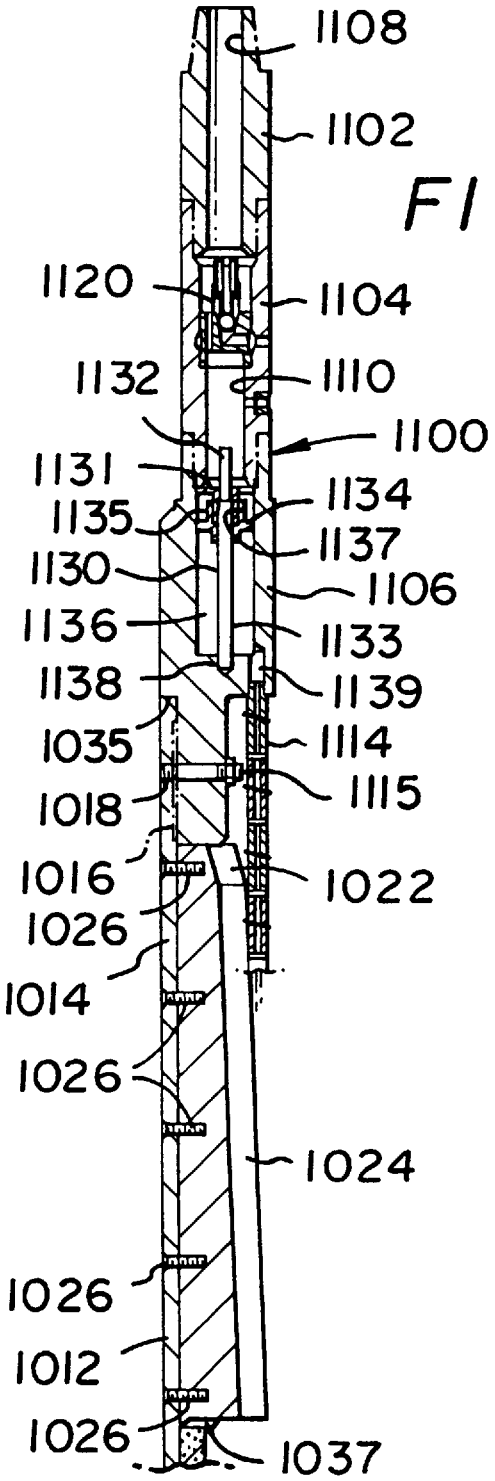
FIG. 33A is a side view in cross-section of part of the whipstock system of FIG. 32A with a running tool attached at a top thereof.
Figure 33B:
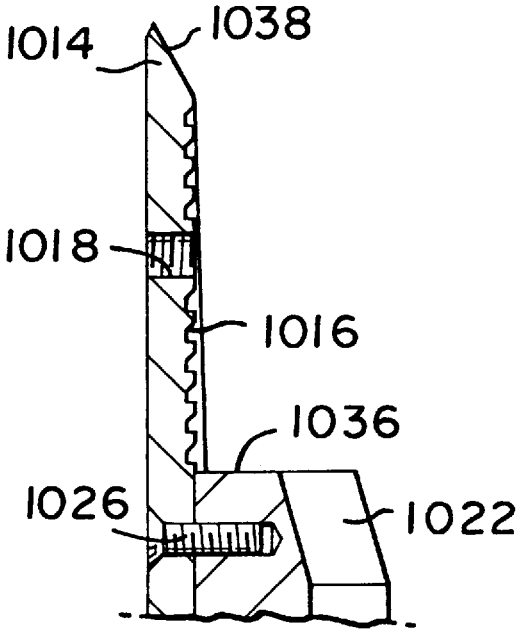
FIGS. 33B and 33C show enlarged portions of the apparatus of FIG. 33A.
Figure 33C:
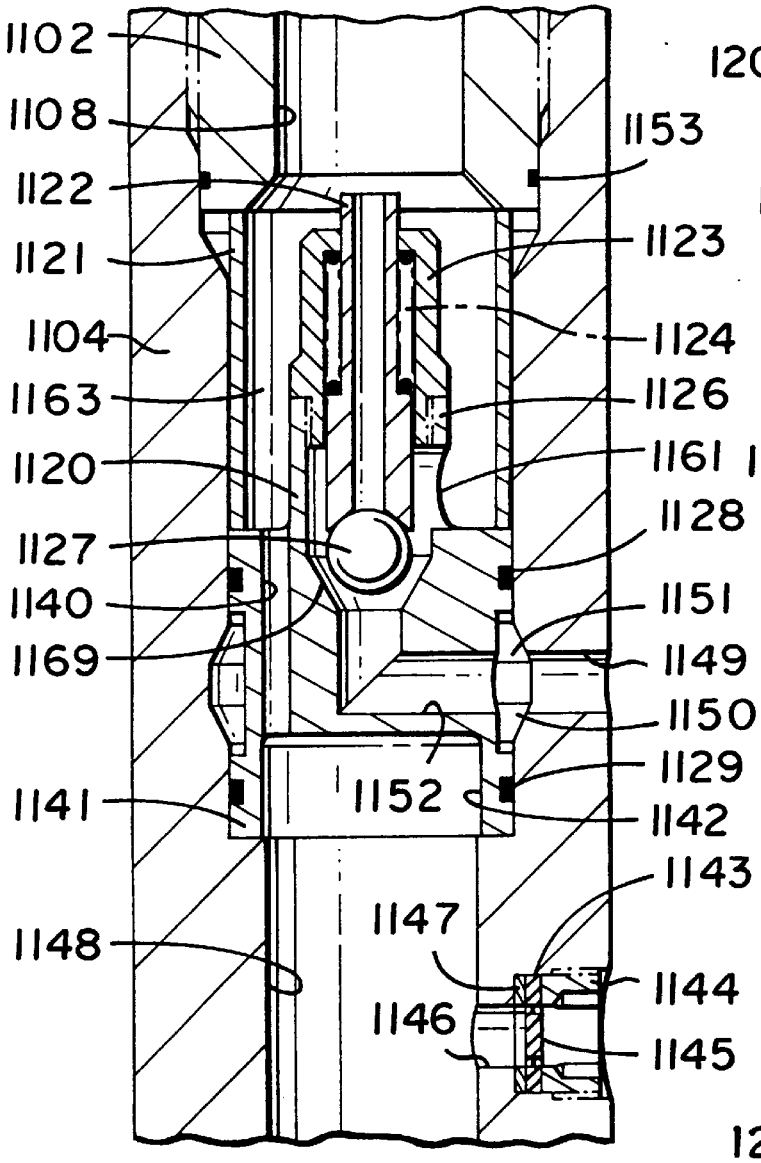

FIG. 33A shows a running tool 1100 releasably attached by a shear bolt 1115 (shearable, e.g. in response to about 30000 lbs of force) to the top 1014 of the whipstock body 1012. Fluid (e.g. working fluid, water, mud) pumped from the surface by a surface pumping unit, not shown) flows down a tubular string (not shown) to which the running tool 1100 and the system 1010 are connected through a channel 1108 through a fill-up sub 1102, past a valve 1120, and through a channel 1110 of a body 1104. This fluid then flows through holes in a centralizer 1131 that centralizes a piston 1134 and a rod 1132 in a body 1106. An end 1133 of the rod 1132 is held in a recess 1138 in the body 1106. When the fluid is of sufficient force, shear screws or pins 1137 holding a piston 1134 to a holding member 1135 are severed and the fluid pushes the piston 1134 down on the rod 1132. Fluid, e.g. oil, in a cavity 1136 in the body 1106 is thus forced out from the cavity 1136, through a port 1139, into an hydraulic line 1114 (shown partially) which extends down along the system 1010 (and/or through the plug element 1040) to an hydraulically settable anchor device (not shown) for anchoring the system 1010 at a desired location in a wellbore or in a tubular member. To check anchor setting, weight is applied to the system 1010 through the running tool 1100. The teeth 1016 of the whipstock body 1012 and corresponding teeth 1116 of the running tool 1100 transfer the load (e.g. about 80,000 pounds) to the whipstock body and thus to the anchor device. These teeth also isolate the sacrificial element 1020 and the shear bolt 1115 from the downward load. In certain aspects this facilitates insertion of the system 1010 through tight spots in a tubular string and permits a relatively large load to be applied without prematurely shearing the shear bolt 1115 and insures that the sacrificial element 1020 is not inadvertently damaged or sheared off.

While the running tool is being introduced with the system 1010 into a wellbore, fluid in the wellbore flows from outside the running tool through a port 1149, through a groove 1151 surrounding the interior of the body 1104, through a channel 1152 in a body 1141, up to and out through a port 1161, out a channel 1163, and up into the channel 1108 of the sub 1102 up into the working string. Thus buoyancy of the system and of the running tool is reduced or eliminated.

A valve member ball 1127 as shown in FIG. 33A is seated against a valve seat surface 1169, thereby preventing fluid flow out from the port 1149 (e.g. when actuating an anchor device with fluid under pressure through a channel 1140). A spring-loaded cylinder 1122 is urged down by a spring 1124 to hold the ball 1127 against the valve seat surface 1169. The spring 1124 has its top end biased against an inner top surface of a retainer 1123 and its lower end biased against a shoulder on the exterior of the cylinder 1122. The retainer 1123 is secured to a top 1126 of the body 1141. A spacer 1121 holds the body 1141 in position.

A rupture disc (or discs) 1145 is disposed across a channel 1146 and is held in place against a seal 1147 in a recess 1143. Initially the rupture disc 1145 prevents fluid flow through the channel 1146. Once the running tool 1100 has been separated from the whipstock body 1012 by shearing the shear bolt 1115 with an upward pulling force following correct positioning of the whipstock body 1012 and setting of its anchor (using typical positioning devices, e.g. a gyro) and the running tool 1100 is to be raised and removed from the wellbore, the force of fluid pumped from the surface under pressure to the running tool and in the string to which the running tool is attached ruptures the disc 1145 and pumped fluid from within the string flows down through the running tool, through the channel 1140 and out through the port 1146 draining the workstring thereby facilitating removal thereof. Thus the fluid in the string is drained therefrom into the wellbore.

Figure 34:
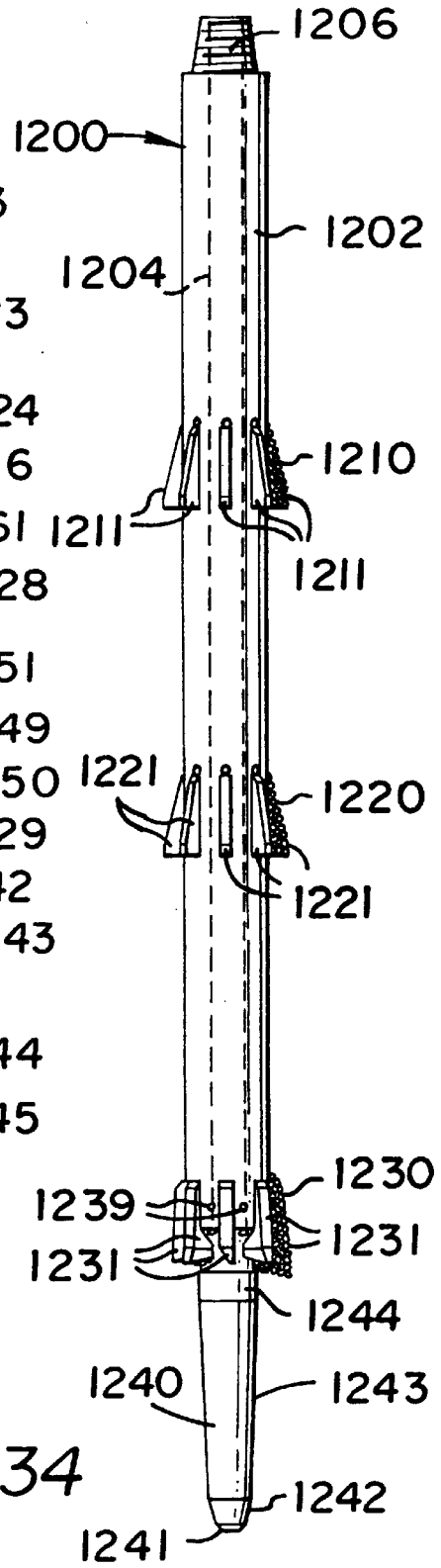
FIG. 34 is a side view of a mill system according to the present invention.

FIG. 34 shows a starting mill 1200 useful with the system 1010 for forming an initial window, e.g. in casing in which the system 1010 is positioned. The starting mill 1200 has a body 1202 with a fluid flow channel 1204 therethrough (shown in dotted lines). Three sets of cutting blades 1210, 1220, and 1230 with, respectively, a plurality of blades 1211, 1221, and 1231 are spaced apart on the body 1202. Jet ports 1239 are in fluid communication with the channel 1204. A nose 1240 projects down from the body 1202 and has a tapered end 1241, a tapered ramped portion 1242, a tapered portion 1243, and a cylindrical portion 1244. In one aspect the nose is made of readily millable material and is releasably secured to the body 1202; e.g. so that it can be twisted off by shearing a shearable member that holds the nose to the body. Then the released nose may be milled by the mill. The nose 1240 may have a fluid flow channel and valve as shown, e.g., in the system of FIG. 44.

The nose 1240 is sized, shaped and configured so that it contacts the sacrificial element 1020 as the mill 1200 initially moves down in a wellbore to mill and mill through a tubular, e.g. casing or tubing (not shown). The nose 1240 contacts and moves down along and adjacent the sacrificial element 1020 as the blades first contact and begin milling into the casing to form the initial window at the desired location. The nose 1240 and its co-action with the sacrificial element 1020 keep the mill 1200 from contacting and milling the whipstock body 1012. The cylindrical portion 1244 of the nose 1240 acts like a bearing against the sacrificial element 1020. After the mill 1200 has milled down the casing, e.g. for several inches, it has milled through the casing. For example, with casing approximately 0.5 inches thick, the mill 1200 will have milled through the casing after milling down three to four inches. Then the mill 1200 continues to move down and mill more casing to form the initial window.

After the mill 1020 has moved downwardly to an extent greater than the length of the nose 1240, the blades 1231 are in position to mill the sacrificial element 1020 in addition to milling the casing opposite the sacrificial element 1020. Simultaneously the blades 1221 and 1211 are milling casing above the sacrificial element 1020. At this point the sacrificial element 1020 begins to be milled by the blades 1231. The sacrificial element 1020 as shown is sized and disposed to prevent the blades 1231 from milling the whipstock body 1012. It is within the scope of this invention for the element 1020 to be sized so that some milling of the whipstock body occurs.

In one aspect the mill, the whipstock body, and the sacrificial element are sized, disposed, and configured so that an initial window in the casing of desired length is milled out without the mill contacting the whipstock body or the filler therein. In one aspect such a window is completed with about two inches, one inch, or less of the lower part of the sacrificial element 1020 remaining. At this point in the procedure the starting mill 1200 is removed from the wellbore. In another aspect the nose 1240 is sized, disposed, and configured, e.g. as shown in FIG. 34, so that at the bottom extent of milling there is some minimal clearance between the nose 1240 and the interior casing wall so that the nose 1240 is not held therebetween and so that damage to the nose 1240 is reduced or eliminated.

In one aspect the angle of taper of the tapered portion 1243 corresponds substantially to the angle of taper of the face 1024 of the sacrificial element 1020 so the contact between the two is effected to maximize the ability of the sacrificial element 1020 to direct the mill away from the whipstock and against the casing. Also, in this embodiment the taper angle of the tapered portion 1243 is such that when milling is finished (see FIG. 37D) the tapered portion 1243 is substantially parallel to the interior casing surface adjacent the nose 1240 inhibiting wedging contact of the two and reducing friction therebetween.

In one particular embodiment sacrificial element 1020 is about 30 inches long (excluding the extending top part with teeth) and the blade sets of the mill 1200 are spaced apart about two feet and the nose 1240 is about 18 inches from its lower end to the first set of blades 1231. With such a mill a completed initial window is about 60 inches long. It is within the scope of certain preferred embodiments of this invention for the initial window through the casing to be two, three, four, five, six, seven or more feet long.

Figure 35:
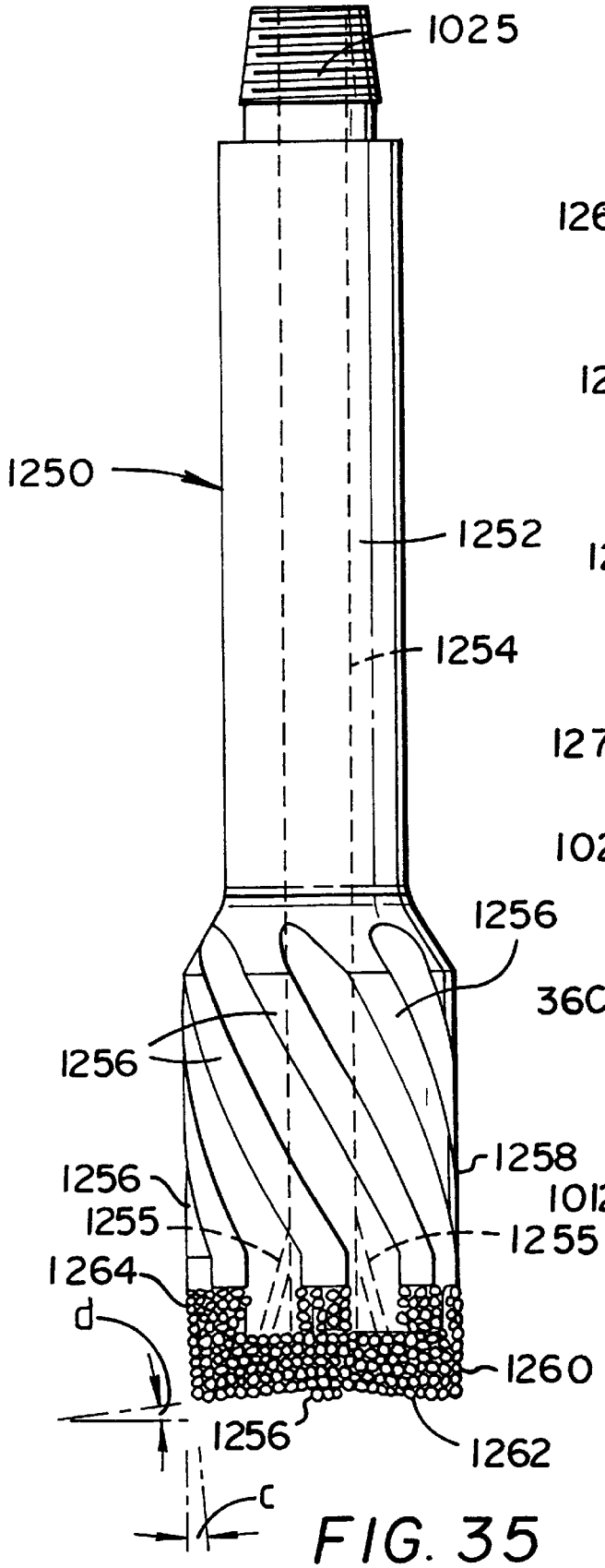
FIG. 35 is a side view of a mill according to the present invention.

FIG. 35 shows a window mill 1250 for use to enlarge the window made by a mill, including but not limited to the mill 1200. The window mill 1250 has a body 1252 with a fluid flow channel 1254 from top to bottom and jet ports 1255 to assist in the removal of cuttings and debris. A plurality of blades 1256 present a smooth finished surface 1258 which moves along what is left of the sacrificial element 1020 (e.g. one, two, three up to about twelve to fourteen inches) and then on the filler 1028 and the edges of whipstock body 1012 that define the recess 1030 with little or no milling of the filler 1028 and of the edges of the whipstock body 1012 which define the recess 1030. Lower ends of the blades 1256 and a lower portion of the body 1252 are dressed with milling material 1260 (e.g. but not limited to known milling matrix material and/or known milling/cutting inserts applied in any known way, in any known combination, and in any known pattern or array).

In one aspect the lower end of the body 1252 tapers inwardly an angle C to inhibit or prevent the window mill lower end from contacting and milling the filler 1028 and whipstock body 1012 (i.e. the angle C is preferably greater than the angle a in FIG. 32A).

In one aspect the surface 1258 is about fourteen inches long and, when used with the mill 1200 having blades about two feet apart as described above, an opening of about five feet in length is formed in the casing when the sacrificial element 1020 has been completely milled down. In this embodiment the window mill 1250 is then used to mill down another ten to fifteen feet so that a completed opening of fifteen to twenty feet is formed, which includes a window in the casing of about eleven to fifteen feet and a milled bore into formation adjacent the casing of about five to nine feet.

In one embodiment the lower ends of the blades of the window mill body 1252 taper upwardly from the outer surface toward the body center an angle d (FIG. 35). This taper part tends to pull the body 1252 outwardly in a direction away from the filler 1028, and away from the whipstock body 1012 into the formation adjacent the casing, acting like a mill-directing wedge ring. Also this presents a ramp to the casing which is so inclined that mill end tends to move down and radially outward (to the right in FIG. 38E) rather than toward the whipstock.

In one method according to the present invention a mill (such as the window mill 1250) mills down the whipstock, milling a window. Following completion of the desired window in the casing and removal of the window mill, a variety of sidetracking operations may be conducted through the resulting window (and, in some aspects, in and through the partial lateral wellbore milled out by the mill as it progressed out from the casing). In such a method the remaining portion of the whipstock is left in place and may, if desired be milled out so that the main original wellbore is again opened. In one aspect the filler 1028 and plug element 1040 are milled out to provide an open passage through the whipstock.

In another aspect, in the event there is a problem in the milling operation prior to completion of the window, the whipstock is removed. As shown in FIGS. 36A and 36B, a retrieving tool 1270 with a body 1272 has a barrel 1280 threadedly connected to the body 1272. A fluid flow channel 1268 extends down into the body 1272 from a top end thereof and is in fluid communication with a top channel 1273 and a side channel 1274 so that fluid may be pumped through or flow through the retrieving tool 1270. As shown in FIG. 36A, the tool 1270 has been inserted into the wellbore and has contacted the whipstock body 1012. Preferably the threads 1281 are positioned on the barrel 1280 interior so that corresponding threads on the whipstock body are not engaged until the barrel has moved down over a significant portion of the whipstock body so that threaded engagement does not occur at a relatively thin portion of the top of the whipstock. Interior threads 1281 of the barrel 1280 have threadedly mated with exterior threads 1282 of the whipstock body 1012. A nose 1278 of the body 1272 has entered a space between the casing and the top of the whipstock body 1012. The body 1272 may be connected to a string of hollow tubular members, e.g. but not limited to a drill string or workstring.

FIG. 36B illustrates the tool 1270 as it first contacts the whipstock top 1014 before any milling has been done. To retrieve a whipstock from the position shown in FIG. 36B, the tool 1270 (e.g. on a drill string) after engaging the whipstock is pulled upwardly (e.g. with 30,000 to 80,000 or more pounds of force). A tapered surface 1277 of the nose 1278 contacts the top 1014 and (when the system 1010 is in a non-vertical hole with the whipstock on the "low" side of the hole) pushes down on it thereby leveraging and lifting the whipstock body 1012 away from the "low" side of the casing facilitating the engagement of the threads 1281 with the threads 1282. Upon correct engagement of the whipstock by the tool 1270, the whipstock is removed from the wellbore by removing the drill string from the wellbore (e.g. by pulling with about 100,000 lbs force which, in certain aspects releases the whipstock from the anchor e.g. by shearing a shearable whipstock stinger from an anchor device). The sacrificial element, although present, is not shown in FIG. 36A. The tool 1270 may also be used following milling.

Filler 1028 may be cermet, cement, brass, fiberglass, bronze, wood, bearing material, cast iron, polymer, epoxy resin mixed with fiberglass fibers, resin, plastic, or some combination thereof.

Figure 37A:
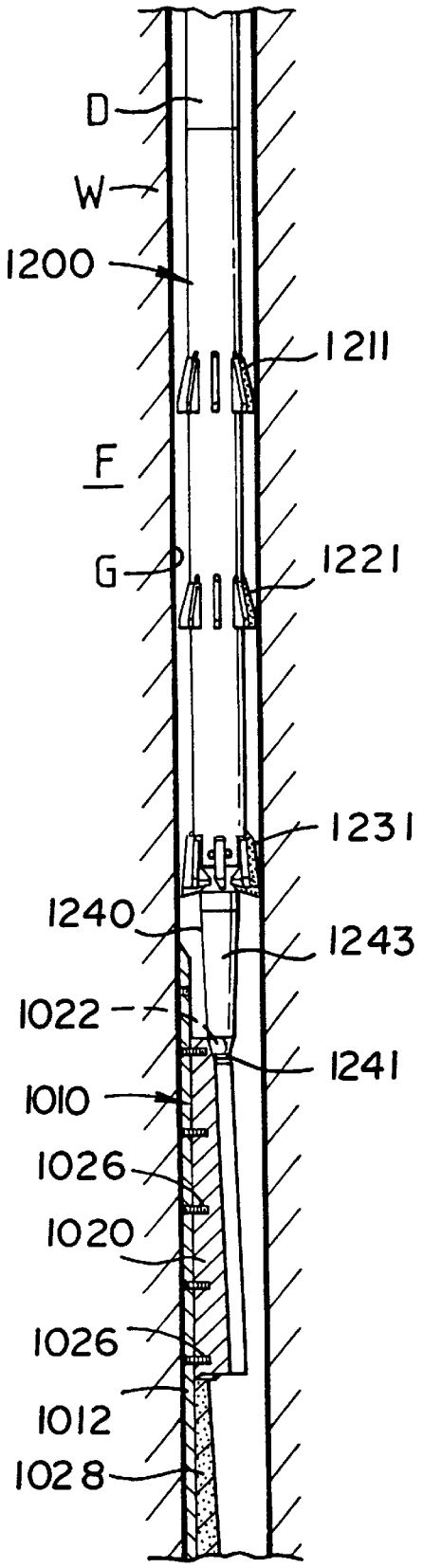
FIGS. 37A–37D show an operation of the system of FIGS. 32A and 34.

FIGS. 37A–37D illustrate steps in a method using the systems 1010 and mill 1200. The mill 1200 is connected to a working string D that extends to the surface. As shown in FIG. 37A, the system 1010 has been located, positioned, and anchored in a tubular string of casing G that extends down from the earth's surface (not shown) in a wellbore W through an earth formation F. The tapered end 1241 of the nose 1240 of the mill 1200 has contacted the first face 1022 of the sacrificial element 1020. Preferably the blades 1211, 1221, 1231, do not touch the casing on the whipstock side (left side, FIG. 37A) and are held against the casing on the opposite side (right side, FIG. 37A) both by the co-action of the tapered end 1241 with the first face 1022 and by a stabilizer S (any known stabilizer or smooth faced or smooth bladed mill, e.g. a starting mill with smooth outer surfaces). At this point milling is started by rotating the mill 1200 (e.g. by rotating with the surface rotary the string D to which the mill 1200 is attached that extends to the surface; or by using a downhole motor positioned in the string above the mill.

Figure 37B:
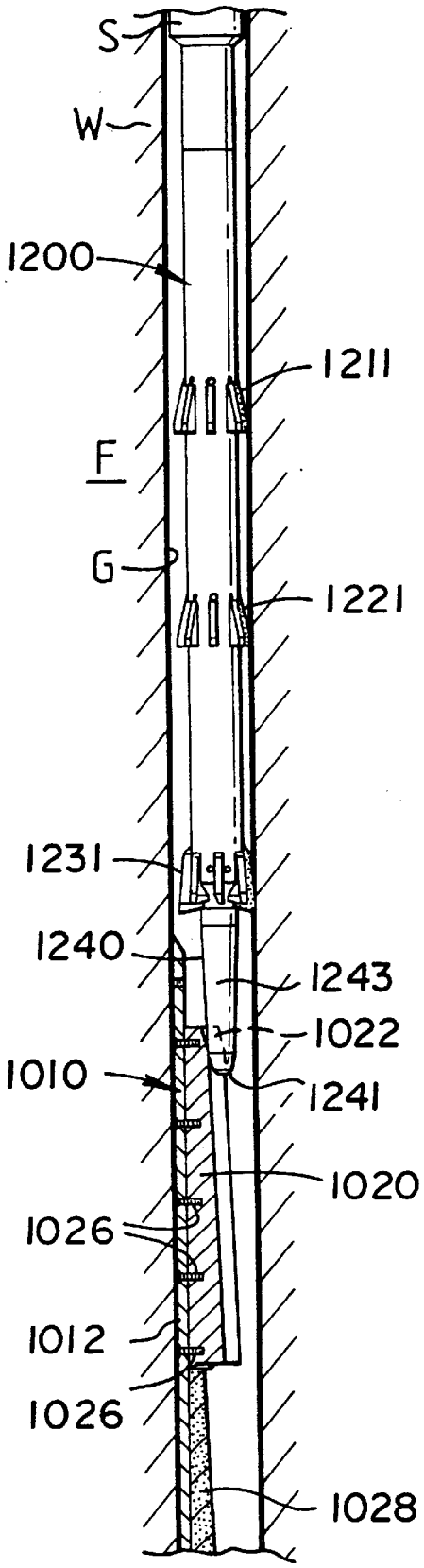

As shown in FIG. 37B the three sets of blades of the mill 1200 have begun to mill into the casing G; the tapered portion 1243 of the nose 1240 has moved down to contact the sacrificial element 1020; and the blades are held away from the whipstock side (left side, FIG. 37B) of the casing G.

Figure 37C:
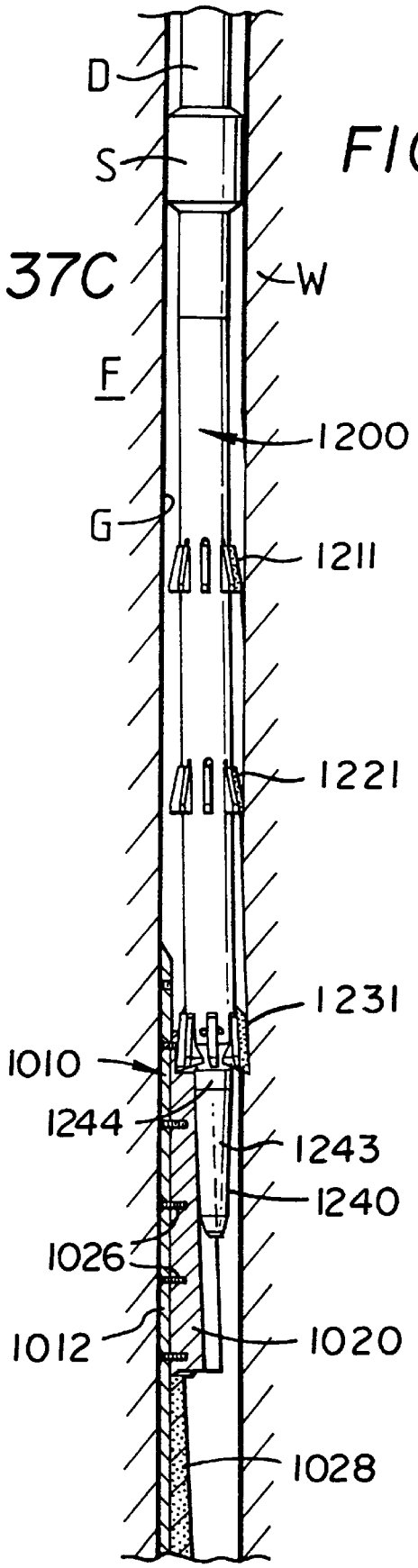

As shown in FIG. 37C, the tapered portion 1243 of the nose 1240 has continued to move down and co-act with the second face 1024 of the sacrificial element 1020; the blades 1231 have milled through the casing G; the blades 1231 have milled away part of the sacrificial element 1020; the three sets of blades have been directed away from the whipstock side of the casing G; the blades 1221 have milled through the casing G; the blades 1211 have milled and are about to mill through the casing G; the nose 1240 is not caught or wedged in between the sacrificial element 1020 and the inner wall of the casing G; part of the top bolt 1026 has been milled away; and the whipstock body 1012 and filler 1028 are not milled by the mill 1200.

Figure 37D:
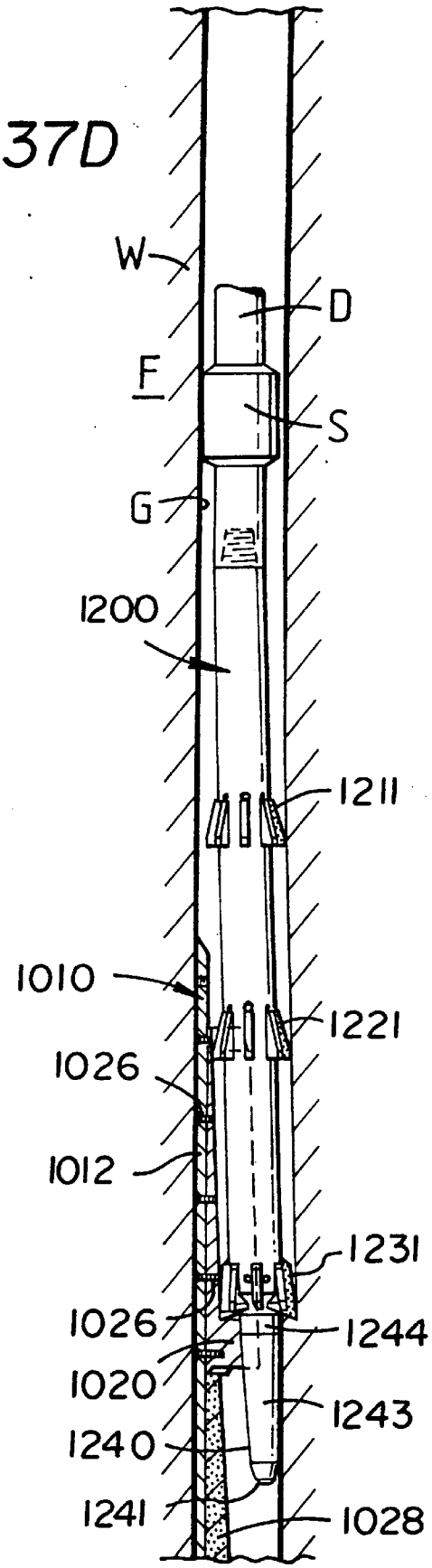

As shown in FIG. 37D an initial casing window I has been completed; the surface 1244 acts as a bearing surface against the second face 1024; portions of bolts 1026 have been milled away; parts of the formation F has been milled away; the majority of the sacrificial element 1020 has been milled away and a portion of the sacrificial element 1020 remains; the whipstock body 1012 and filler 1028 have not been milled (or in other aspects only a minor portion of the top of the whipstock body 1012 has been milled); the nose 1240 has moved freely or with minimal contact of the casing G to the position shown; the cylindrical portion 1244 is wedged between the element 1020 and the casing G indicating at the surface that there is no more progression of the mill; and the mill 1200 is ready to be removed from the wellbore so that further milling with additional mill(s) can be done to complete the desired window. Preferably the nose 1240 (other than portion 1244) is not touching the casing G or only has incidental contact therewith.

Figure 38A:
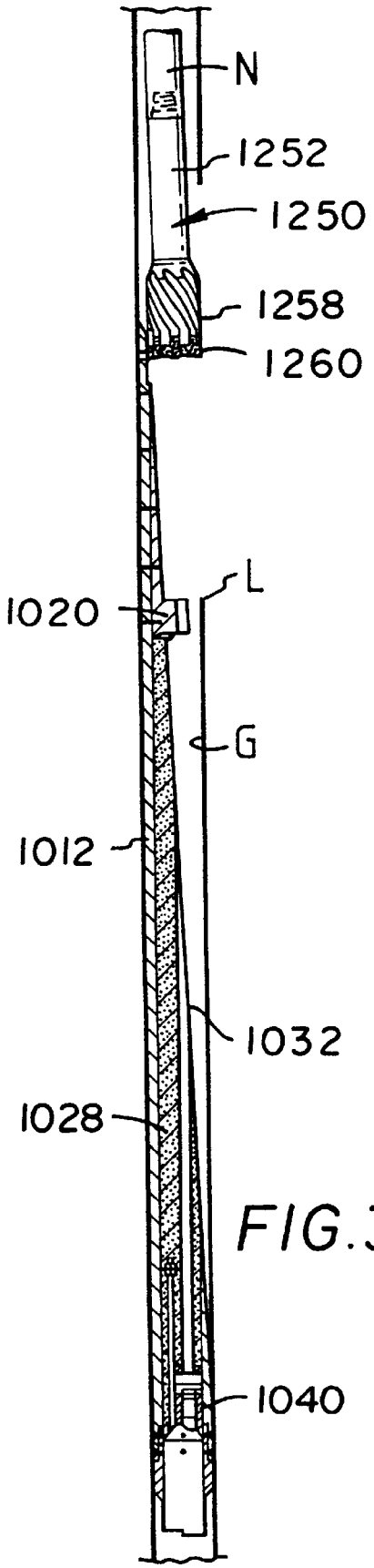
FIGS. 38A–38E show operation of the system of FIGS. 32A and 35.

If the initial window as shown in FIG. 37D is suitable, no other milling is done. If the window in FIG. 37D is to be enlarged and/or lengthened, another mill or series of mills is introduced into the wellbore. As shown in FIG. 38A, the mill 1250 (FIG. 35) has been run into the wellbore (e.g. on a tubular string N of, e.g. a drill string of drill pipe to be rotated from above or to be rotated with a downhole motor as described above). The inwardly tapered portion 1260 of the body 1252 of the mill 1250 preferably does not mill the top of the whipstock body 1012 or mills it minimally.

Figure 38B:
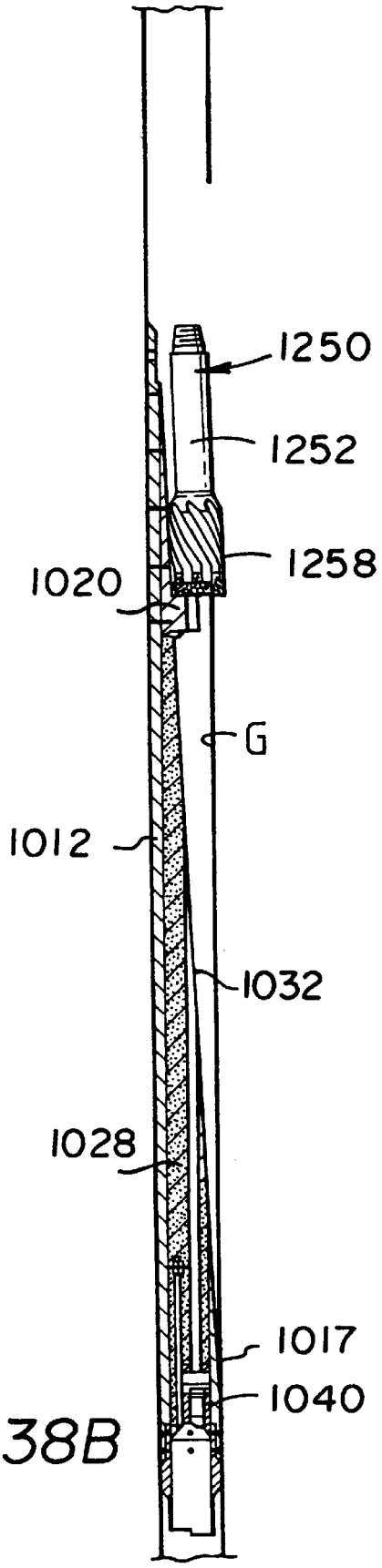

As shown in FIG. 38B the mill 1250 proceeds down along the remainder of the sacrificial element 1020 with the mill surface 1258 holding the milling end away from the sacrificial element and directing the mill 1250 away from the body 1012 toward the casing G. The inwardly tapered portion of the mill 1250 (tapered at angle d, FIG. 35) encounters a ledge L created by the mill 1200, and due to the inwardly tapered portion, the mill moves outwardly with respect to the ledge L, begins to mill the casing G, and also begins to mill the remainder of the sacrificial element 1020. The surface 1258 will continue to co-act with the resulting milled surface on the sacrificial element 1020 until the surface 1258 is no longer in contact with the sacrificial element 1258 as the mill 1250 mills down the casing G. Thus the window, (at the point at which the mill 1250 ceases contact with the sacrificial element 1020) that includes the initial window formed by the mill 1200 and the additional portion milled by the mill 1250 is created without the mills contacting the whipstock body 1012 or the filler 1028. The tubular string N is present, but not shown, in FIGS. 38B–38F.

Figure 38C:
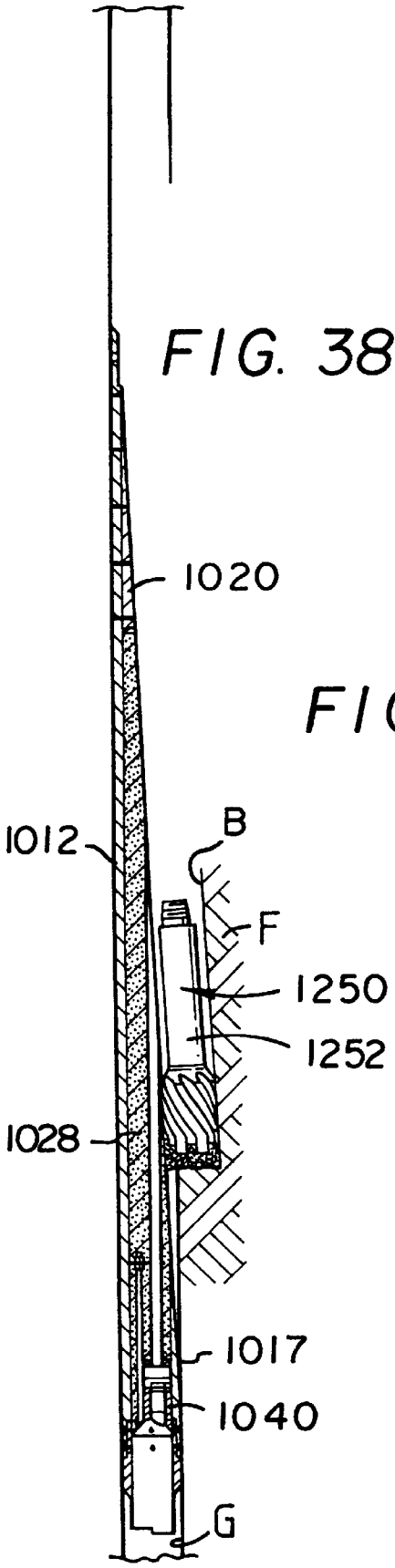

As shown in FIG. 38C, the mill 1250 has continued to mill out the window in the casing G and has both contacted the whipstock body 1012 and begun to mill a bore B into the formation F (e.g. a bore suitable for sidetracking operations). Preferably the surface 1258 of the mill 1250 is contoured, configured and shaped to correspond to the curved shape presented by the rails 1012*a* and 1012*b* (see FIG. 32C) so that these parts of the body 1012 have more than point contact and effectively direct the mill 1250 away from the whipstock. The radiused face 1032 of the whipstock body 1012 and filler 1028 also assists in directing the mill 1250 at a desired angle away from the whipstock.

Eventually the mill 1250 contacts a straight (non-radiused) face 1017 of the whipstock body and filler material 1028.

Figure 38D:
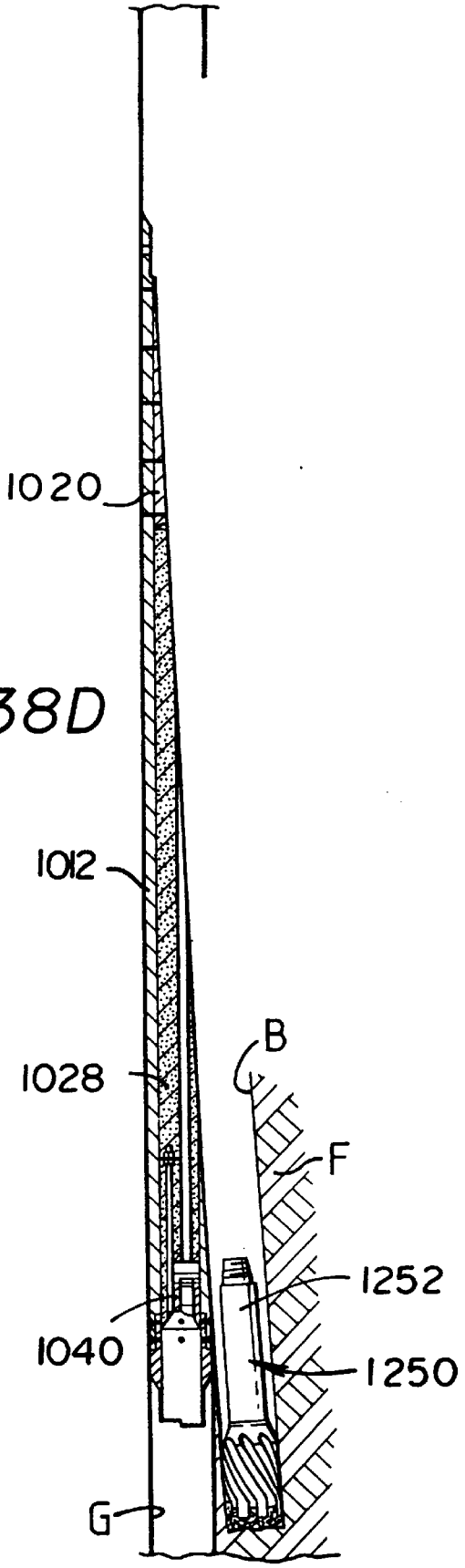
Figure 38E:
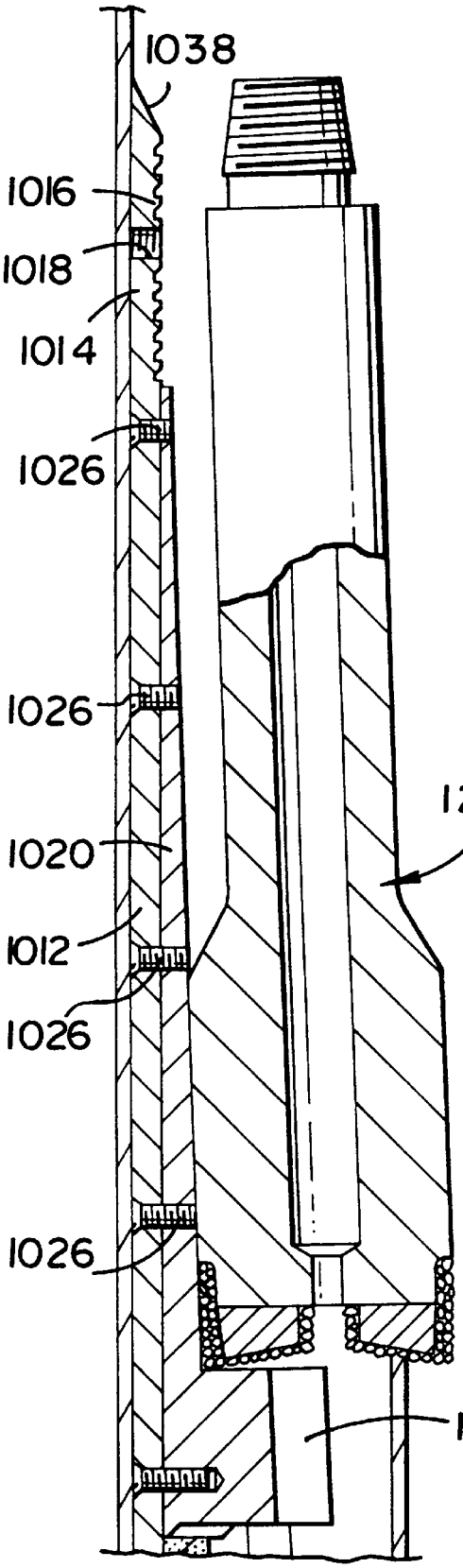

As shown in FIG. 38D the mill 1250 has milled completely through the casing G and has extended the bore B down beyond the plug element 1040 and the sub 1071. Further milling may be conducted with the mill 1250 or other mills, or the mill 1250 may be withdrawn from the wellbore.

Figure 38F:
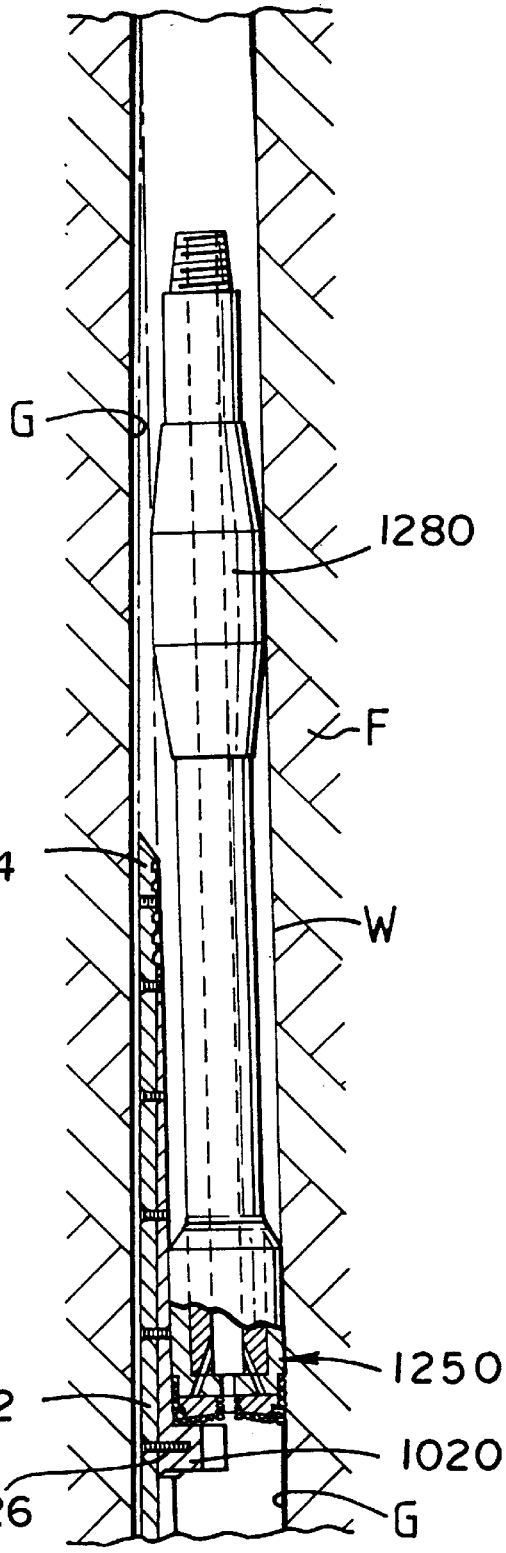
FIG. 38F shows a mill as in FIG. 38E with a watermelon mill.

An additional mill or mills as desired may be used above the mill 1250. As shown in FIG. 38F a watermelon mill 1280 is used above the mill 1250 to facilitate milling, window formation, and smoothing of milled surfaces.

The filler 1028 may have a metal sheath or shield covering exposed portions thereof. The filler 1028 may be one or more containers of filler material positioned in the originally hollow portion of the whipstock. These containers may be relatively rigid, e.g. steel plate, or relatively flexible, e.g. metal foil or plastic of sufficient thickness, yet puncturable, rupturable by pressure and/or chemicals, or tearable so that at a desired time their contents (e.g. sand, rocks, liquid, balls of material, granular material, or a mixture thereof) flows out and down away from the whipstock. In one aspect spacers (solid, containers, spoked wheels, etc) are used so that there is a series of filler masses or filler containers and spacers in the hollow portion of the whipstock. In another aspect the spacers are hollow and empty or hollow with liquid or granular material there which easily flows out and down through the tool upon breaking or rupture of the spacer body or wall. In one aspect the sheath, shield, and/or spacers are made of bearing material for contact by a mill or mills.

Figure 42:
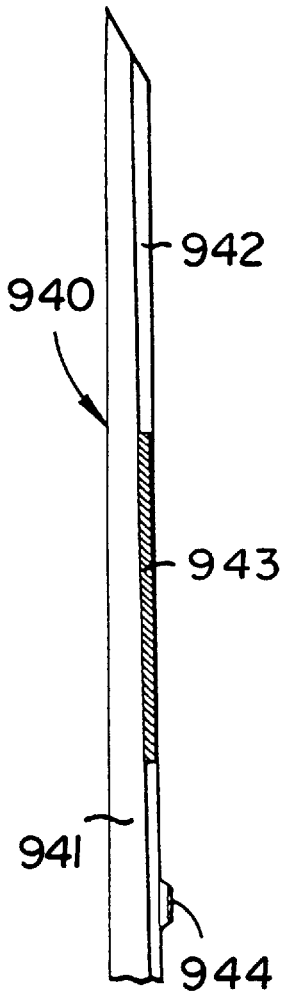
FIG. 42 is a side view of a whipstock according to the present invention.
Figure 43:
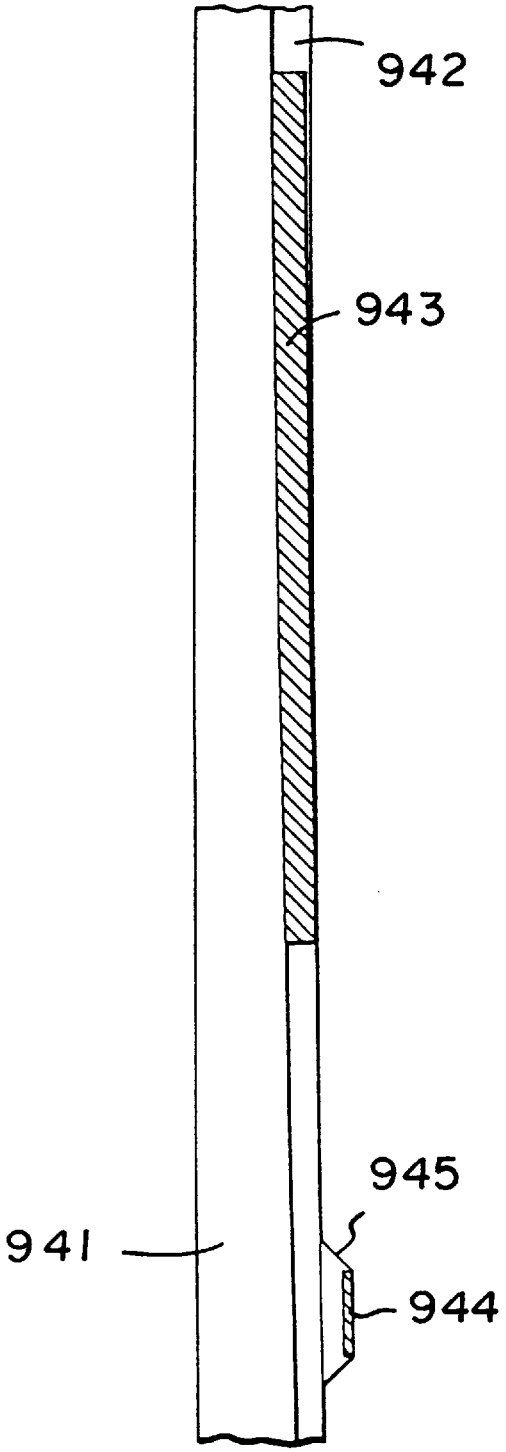
FIG. 43 is an enlarged view of part of the whipstock of FIG. 42.

FIGS. 42 and 43 show a whipstock 940 according to the present invention with a main body 941, a concave portion 942, a lug member 943, and a contact member 944. In one preferred embodiment the lug member 943 is made of a suitable bearing material such as brass.

Figure 44:
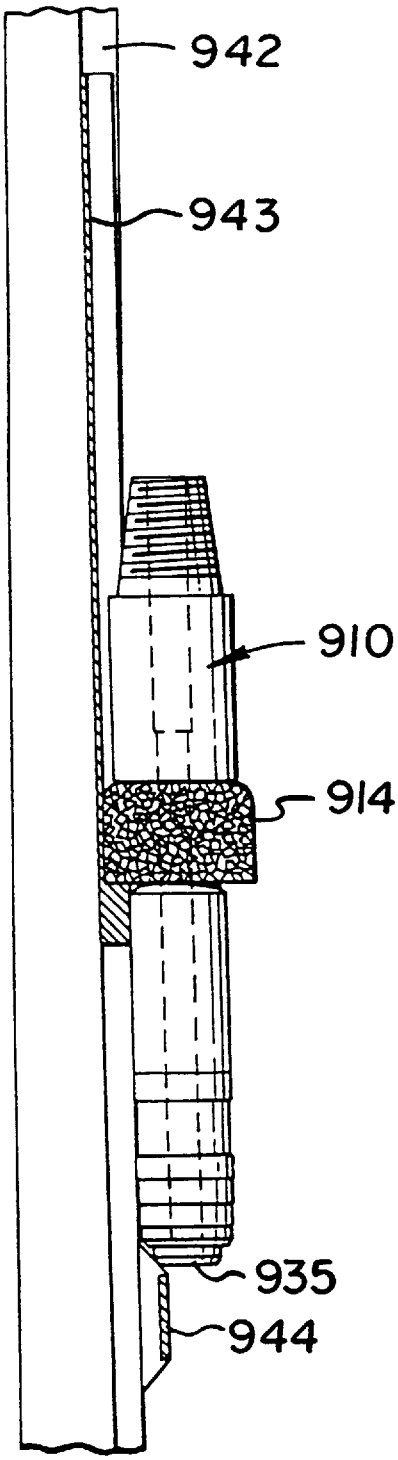
FIG. 44 is a side view showing a mill used with the whipstock of FIG. 42.
Figure 45:
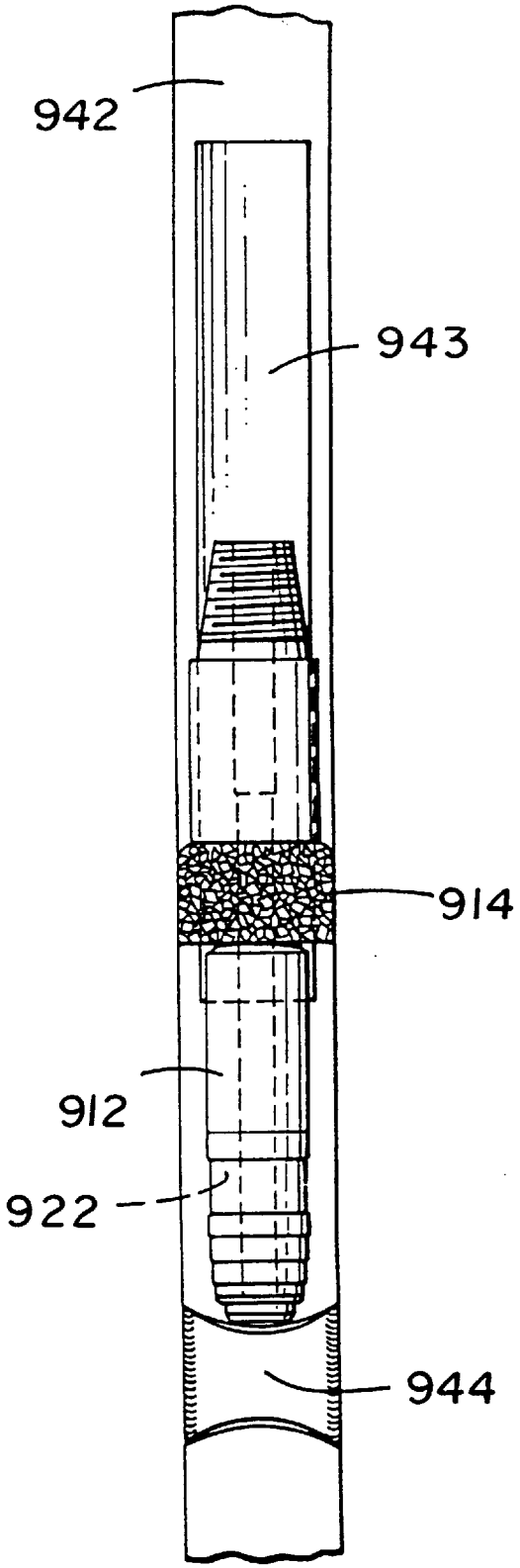
FIG. 45 is a front view of the apparatus shown in FIG. 44.

As shown in FIGS. 44 and 45, an apparatus 910 has moved down the whipstock 940 cutting a window in an adjacent tubular, e.g. a casing (not shown). The majority of the lug member 943 has also been milled away, but preferably the contact member is located and the lug member extends sufficiently so that the mill 914 does not mill into the concave portion 942 and does not mill down past the lug member 943. The surface 935 of the valving member 922 has contacted an inclined surface 945 of the contact member 944 and the valving member 922 has moved so that it has closed off fluid flow through the apparatus 910.

Figure 46:
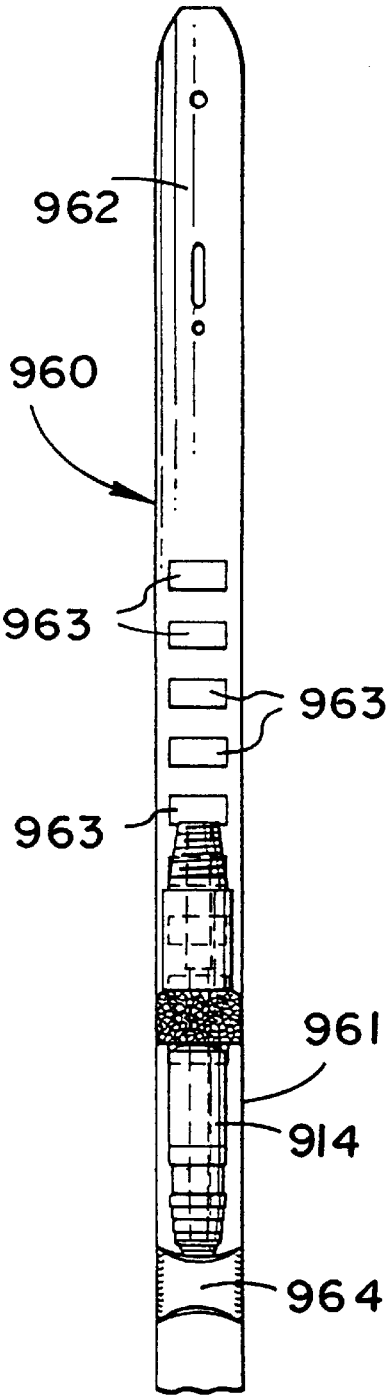
FIG. 46 is a front view of a mill and whipstock according to the present invention.

FIG. 46 illustrates another whipstock 960 according to the present invention with a main body 961, a concave portion 962, a plurality of spaced apart lug members 963 and a contact member 964. Preferably the lug members 963 are sized and positioned so that the mill 914 of the apparatus 910 is always abutting part of one of the lug members 963 so that it is held away from the concave 962 and so that the tubular body below the mill is held off of the concave.

Figure 47A:
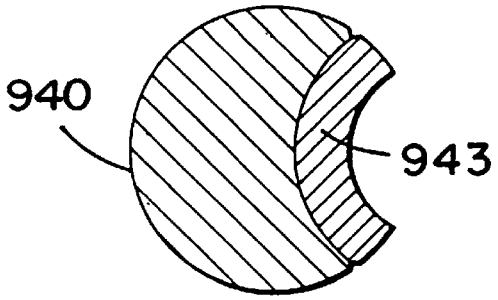
FIG. 47A is a cross-section view of FIG. 36B.
Figure 47B:
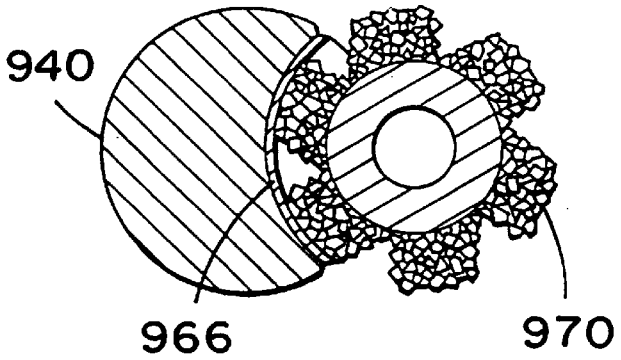
FIG. 47B shows a mill (in cross-section) moving down the whipstock of FIG. 47A.
Figure 47C:
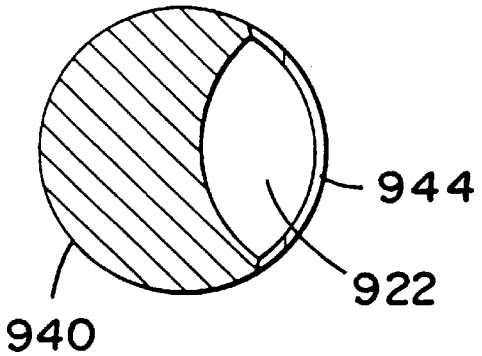
FIG. 47C is a cross-sectional view of FIG. 36A.
Figure 48A:
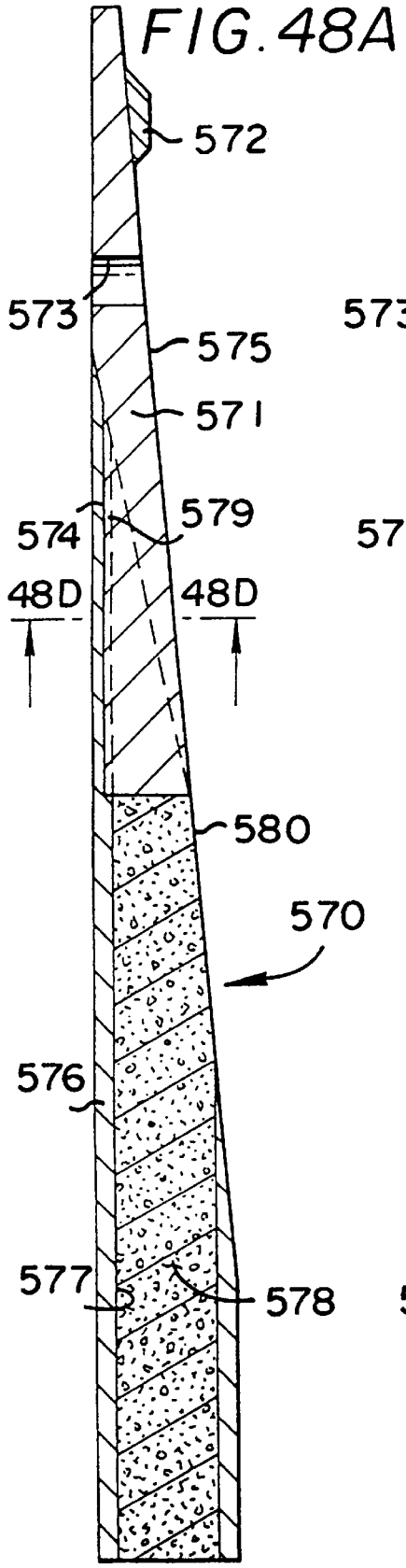
FIG. 48A is a side view in cross-section of a whipstock according to the present invention.
Figure 48B:
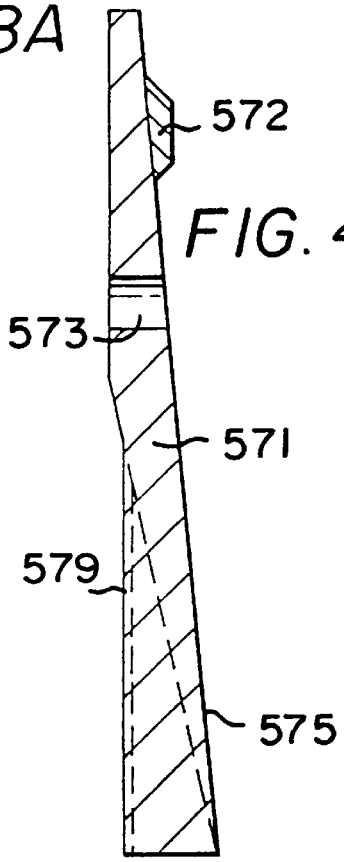
FIGS. 48B and 48C are partial views of the whipstock of FIG. 48A.
Figure 48C:
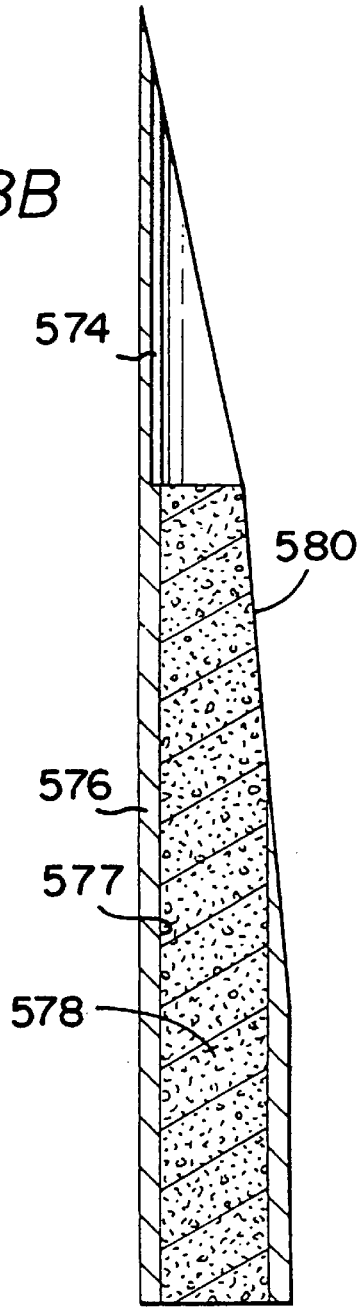
Figure 48D:
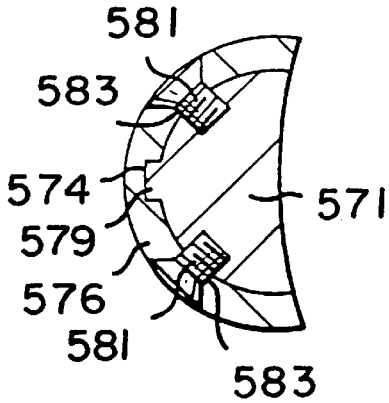
FIG. 48D is a cross-section view along line 48D—48D of FIG. 48A.

FIGS. 47A–47C show a variety of cross sectional views through a whipstock such as the whipstock 940. FIG. 47A is a view through such a whipstock 940 and its lug member 943 prior to any milling of the lug member. FIG. 47B shows a ribbed mill 970 which has milled a portion of the lug member 943 leaving a relatively thin part 966 remaining along the concave member 942. FIG. 47C shows the contact member 944 on the whipstock 940 and illustrates a space 922 between the contact member 944 and the whipstock 940 through which fluid is pumpable. This prevents the contact member 944 from providing a large surface against which fluid might be pumped creating a false pressure increase indication at the surface. Also, in this preferred embodiment, use of a curved contact member 944 whose arc completes a full circle with the whipstock 940 as shown in FIG. 47C makes it possible to easily roll the whipstock 940. Also, the contact member 944 spaces the concave member and its lug away from the ground, particularly during rolling of the apparatus. However it is within the scope of this invention to provide a solid contact member or stop with no space between it and the concave of a whipstock or other device with which the valve and/or valve and mill are used.

Figure 39A:
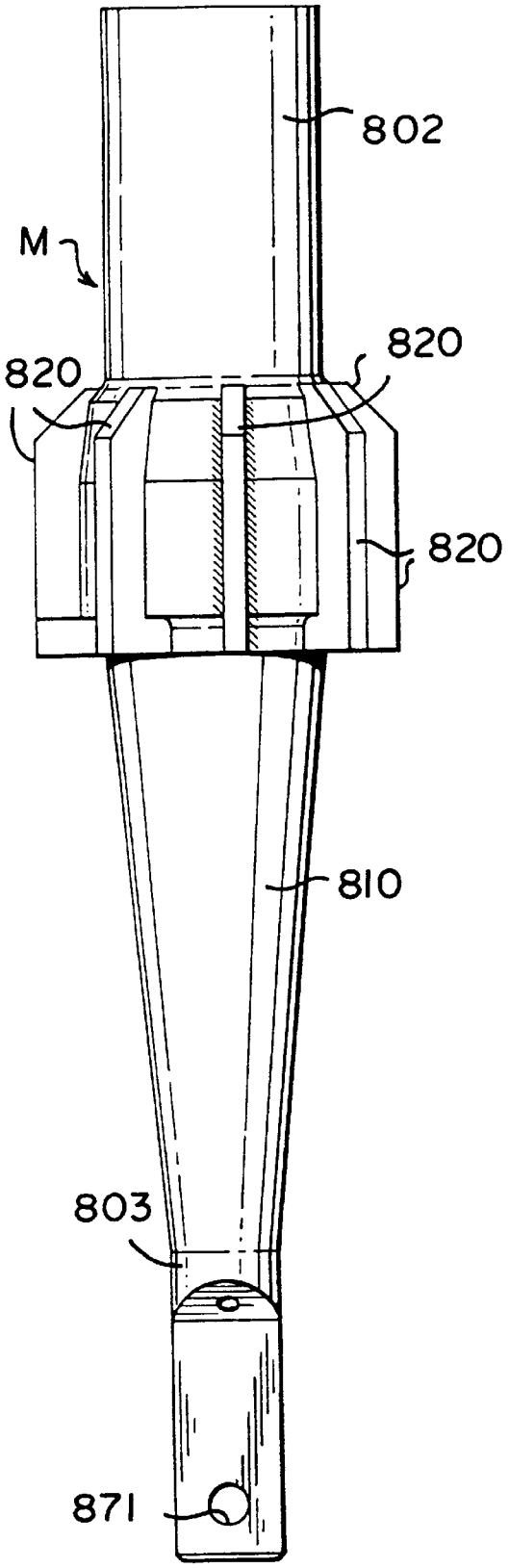
FIG. 39A is a side view of a starting mill according to the present invention.
Figure 39B:
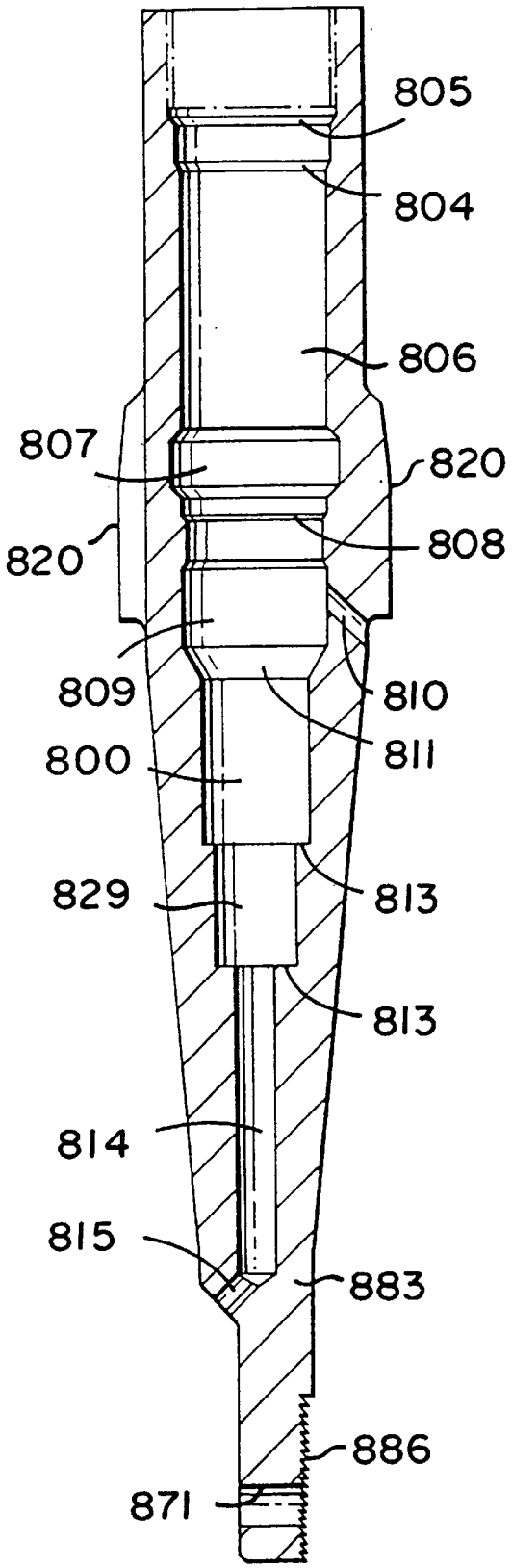
FIG. 39B is across-sectional view of the mill of FIG. 39A.

Referring now to FIGS. 39A and 39B, a starting mill M according to the present invention has a body 810 with a central longitudinal (top-to-bottom) fluid flow bore 800 extending therethrough. Typically the mill M is releasably secured to a concave of a whipstock. A plurality of milling blades 820 are secured (e.g. by welding) to the exterior of the body 810. Such a mill is useful for milling a hole in casing in a wellbore.

Fluid flowing through the body 810 is selectively controlled by flow control apparatus in the body 810 that includes a lower piston 860 releasably secured in a lower part of the bore 800 and movable therein after release; and a labyrinth piston 840 (and associated apparatus) releasably secured in an upper portion of the bore 800 and movable about a top piston rod 830 upon release. A retaining plate 880 stabilizes a top end of the top piston rod 830. A top sub 890 is releasably secured to a top end 802 of the body 810.

The labyrinth piston 840 is initially secured in place by shear pins 814 that extend through holes in the labyrinth piston into recesses in a shear sub 850 which is affixed about the top piston rod 830. Shearing of the pins in response to fluid pumped into the wellbore at a first fluid pressure releases the labyrinth piston 840 for movement in the bore 800 and effects breaking of a plug 887 in a lower male connector 870 so that fluid flows through an hydraulic line to set an anchor (not shown) below the whipstock.

The lower piston 860 is initially secured in place by shear pins 816 extending from holes in a shear ring 870 in the bore 800 into recesses 880 in a bottom end of the lower piston 860. Shearing of the pins 816 in response to fluid at a second fluid pressure (greater than the first fluid pressure) releases the lower piston 860 for movement in the bore 800 so that fluid flow ports 801 adjacent the blades 820 are exposed to fluid flow.

A cavity extending from a lower exit port 885 to the labyrinth piston 840 is initially filled with a clean fluid (e.g., but not limited to, water, drilling fluid, ethylene glycol solution, or a combination thereof) which is held in place by the labyrinth piston 840 at the top and, during shipment, by the plug 887 removably positioned in the male connector 870 provided at the exterior of a lower exit port 885 to which an hydraulic line or other item may be connected. Below the cavity the hydraulic line and packer or other anchor are filled with fluid so fluid is maintained in the cavity.

Eight blades 820 are shown, but any desired number (one, two, three, four, etc.) may be used. Each blade 820 has three primary milling surfaces: a lower part 896; a mid-portion 897; and a top part 898. It is within the scope of this invention for any or all of these parts to be dressed with any known milling inserts, matrix material, or combination thereof in any known disposition, configuration, array, or pattern. Fluid under pressure to facilitate evacuation of debris and cuttings away from the blades 820 flows out from the bore 800 through fluid flow ports 801 which, preferably, exit the body near the lower parts 896 of the blades 820.

Figure 40A:
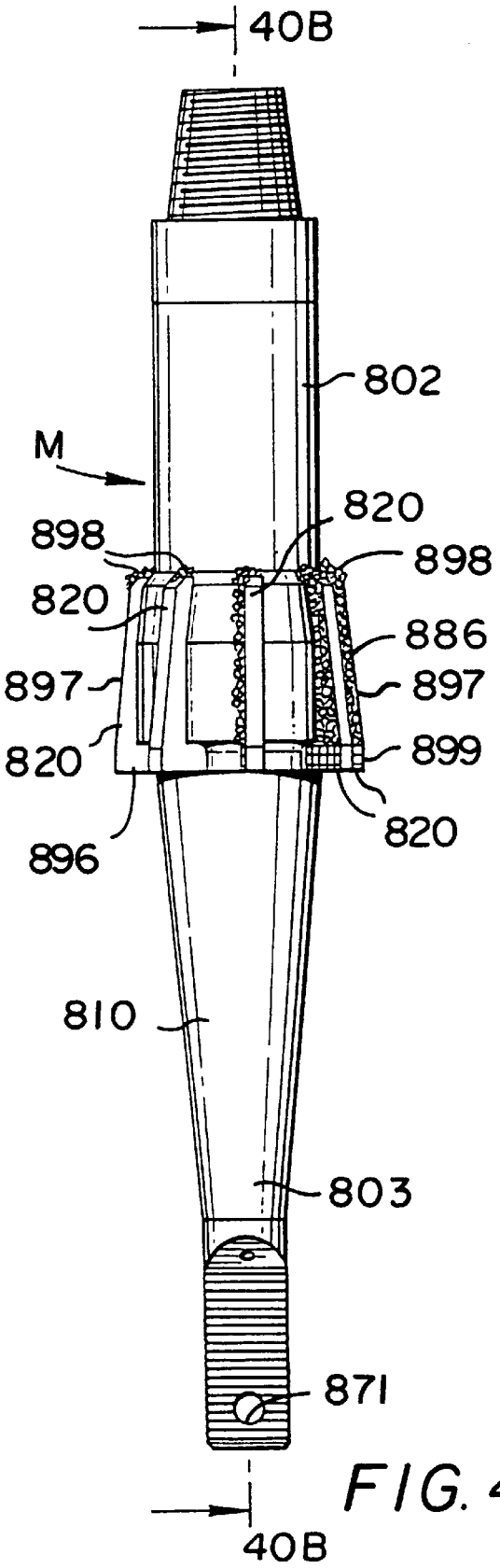
FIG. 40A is a side view of the main body of the starting mill of FIG. 39A.
Figure 40B:
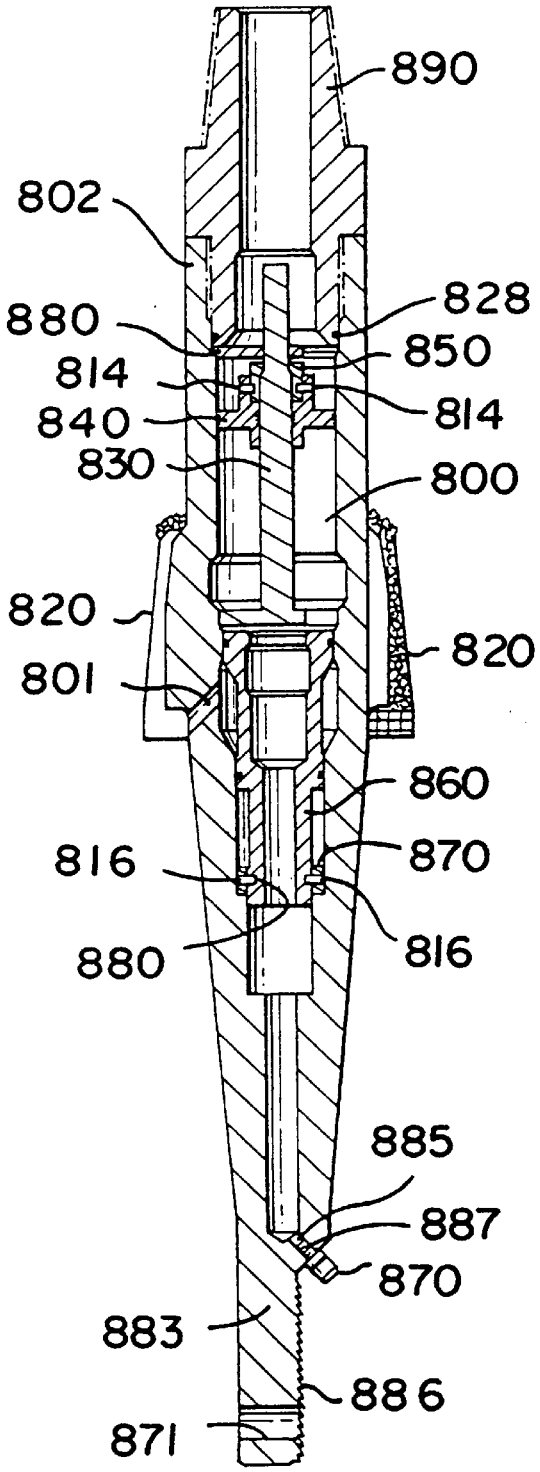
FIG. 40B is a cross-sectional view of the body of FIG. 39A.

FIGS. 40A–40B illustrate the body 810 and its bore 800. The body 810 has a top shoulder 805; an upper shoulder 804;

a top cavity 806; an enlarged cavity 807; a plate shoulder 808; a mid-cavity 809; fluid flow ports 810; a lower piston shoulder 811; a lower shoulder 812; and a bottom shoulder 813.

Ratchet (or "wicker") teeth 886 are provided on a side of the lower end 883 of the body 810. The teeth 886 are profiled so that upon pushing down on the body 810 the teeth contact and engage teeth on a whipstock and downward force is transmitted to the whipstock while the downward force is isolated from a shear stud (not shown) extending through a hole 871 in the body 810 into a pilot lug of the whipstock (not shown). The teeth 886 are also profiled so that in response to an upward pull on the body 810 there is no engagement with the corresponding teeth on the pilot lug (i.e., the teeth slide away with respect to each other), the shear stud is not isolated from the force of such upward pulling, and the shear stud is shearable when enough upward force is applied, e.g. twenty thousand to thirty thousand pounds.

Figure 41A:
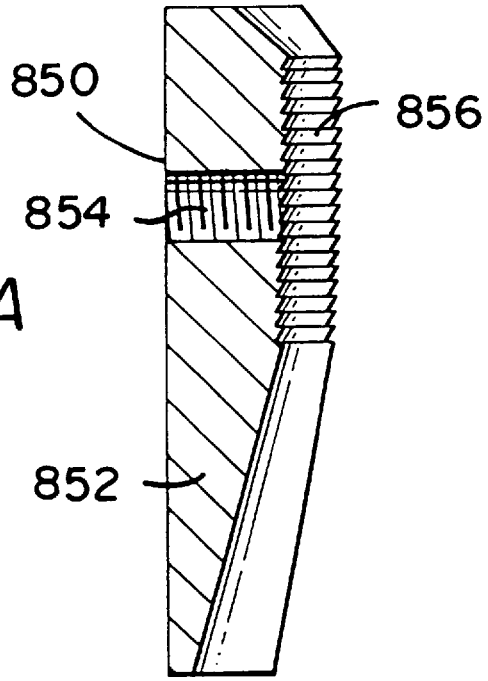
FIG. 41A is a perspective view of a pilot lug of a whipstock according to the present invention.
Figure 41B:
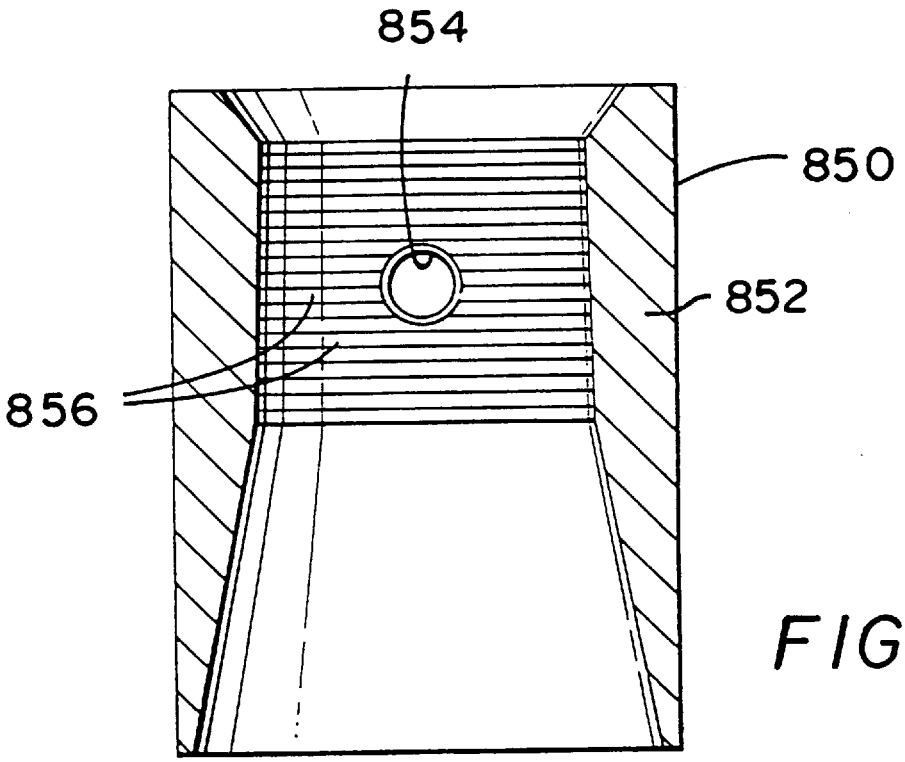
FIG. 41B is a front view of the pilot lug of FIG. 41A.

FIGS. 41A and 41B show a pilot lug 850 according to the present invention with a body 852 having a hole 854 therethrough through which a shear stud or bolt (not shown) extends to releasably secure another item (e.g. a mill) to the pilot lug. Ratchet or wicker teeth 856 on the pilot lug 850 co-act with corresponding teeth on another member (e.g. teeth 386) and operate, as described above, to isolate the shear stud from a downward force applied to a member (e.g. the mill of FIG. 8A) releasably secured by the shear stud to the pilot lug 850. The lug may have the teeth 856, as may any other pilot lug or member for attaching a mill to a whipstock according to the present invention.

FIG. 48A–48D shows a whipstock 570 according to the present invention which has a top solid part 571 releasably connected to a hollow lower part 576. The top solid part 571 has a pilot lug 572, a retrieval hook hole 573, a concave inclined surface 575 and a rail 579. The lower hollow part 576 has an inner bore 577 shown filled with drillable filler material or cement 578. The cement is in the tool as it is inserted into the casing. The lower hollow part 576 has a concave inclined surface 580 which lines up with the concave inclined surface 575 of the top solid part 571. As shown in FIG. 17D shear screws 581 extend through holes 583 in the lower hollow part 576 and holes 582 in the top solid part 571 to releasably hold the two parts together. The rail 579 is received in a corresponding groove 574 in the lower hollow part 576 to insure correct combination of the two parts. Preferably the length of the top solid part is at least 50% of the length of the inclined portion of the concave. A whipstock 570 maybe used in any system disclosed herein. Upon completion of an operation, the top solid part is released by shearing the shear screws with an upward pull on the whipstock, making retrieval and re-use of the top solid part possible. The bottom hollow part need never leave the wellbore.

Figure 49A:
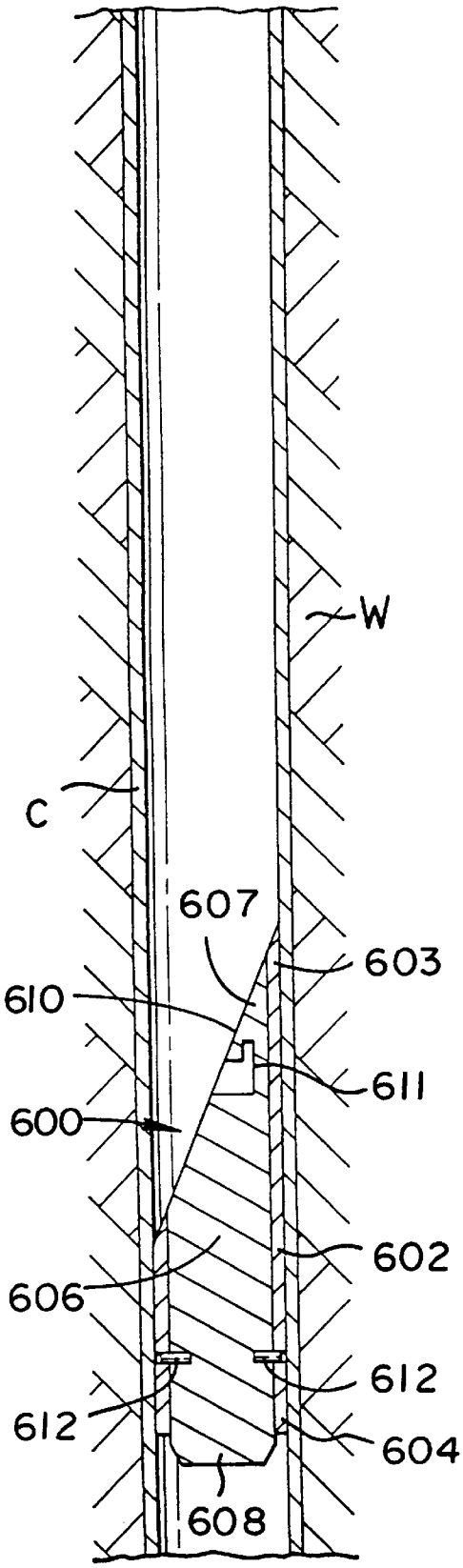
FIGS. 49A and 49B are side views in cross-section of a system according to the present invention.
Figure 49B:
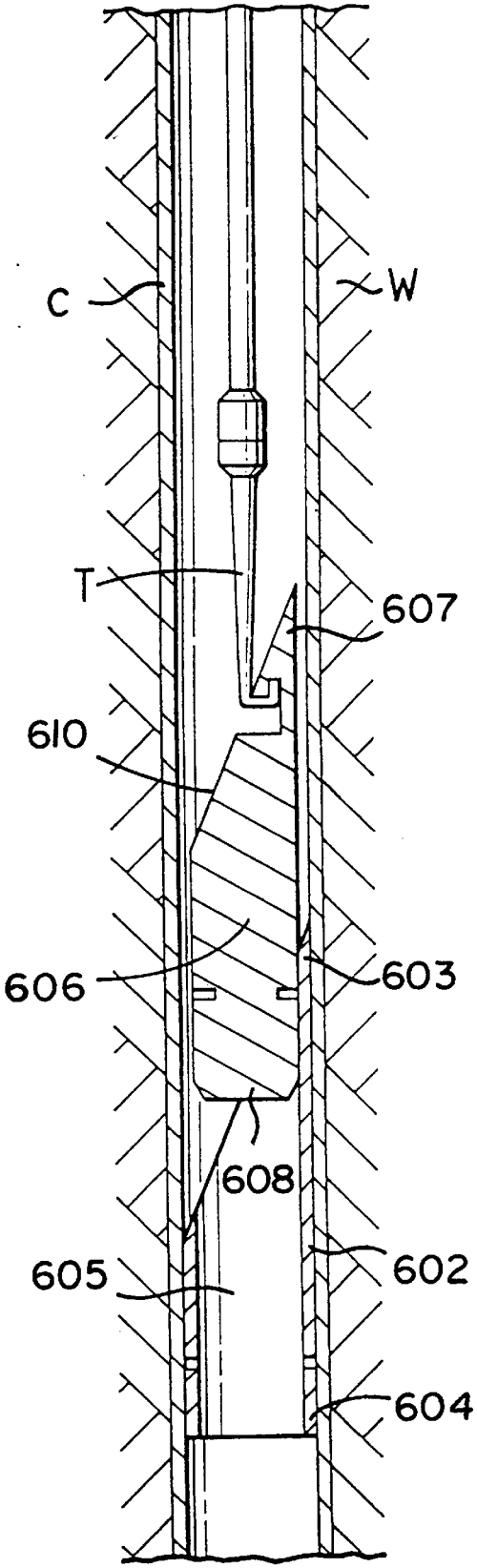

FIGS. 49A and 49B illustrate a whipstock 600 according to the present invention in a casing C in a wellbore. The whipstock 600 has an outer hollow tubular member 602 having a top end 603, a bottom end 604 and a central bore 605; and an inner solid member 606 with a top end 607, a bottom end 608, a concave 609 with a concave inclined surface 610, and a retrieval hook slot 611 in the concave 609. The hollow tubular member 602 is secured to the casing and, while in use, the inner solid member 606 is releasably secured to the outer hollow tubular member 602, e.g. by shear pins 612 extending from the inner solid member 606 into the outer hollow tubular member 602. As shown in FIG. 49B, upon shearing of the pins 612 by an upward pull with a retrieval tool T, the retrieval tool T is used to remove the inner solid member 606 for re-use.

Figure 50:
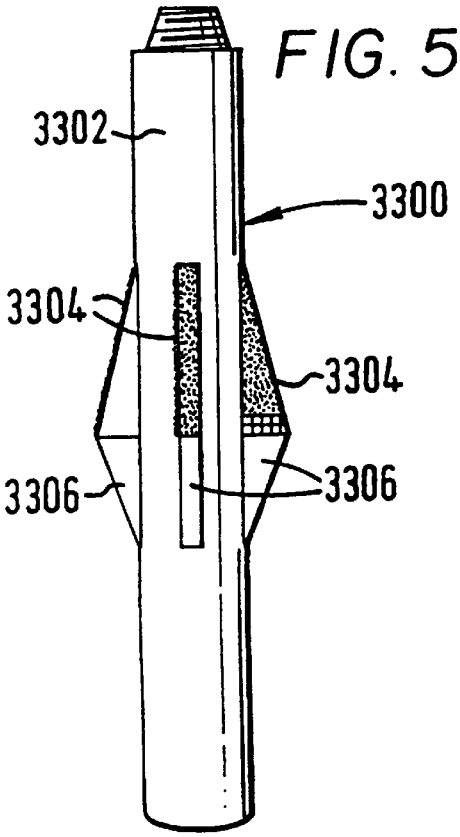
FIG. 50 is a side view of a mill according to the present invention.

FIG. 50 shows a mill 3300 according to the present invention with a body 3302 and a plurality of blades 3304. Associated with each blade 3304 is a taper member 3306 which is secured to the body 3302, or to the blade 3304, or to both, either with an adhesive such as epoxy, with connectors such as screws, bolts, or Velcro™ straps or pieces, or by a mating fit of parts such as tongue-and-groove. The taper members may be made of any suitable wood, plastic, composite, foam, metal, ceramic or cermet. In certain embodiments the taper members are affixed to the mill so that upon contact of the lower point of the mill blades with the casing to be milled, the taper members break away so that milling is not impeded.

Figure 51:
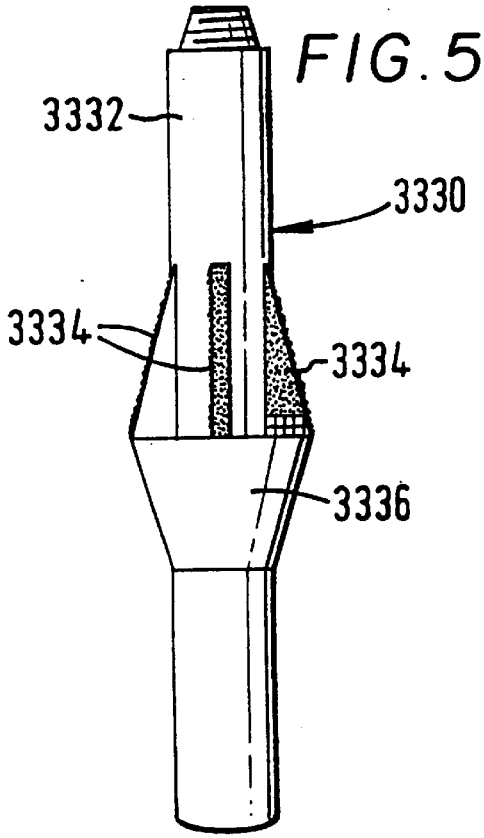
FIG. 51 is a side view of a mill according to the present invention.

FIG. 51 shows a mill 3330 according to the present invention with a body 3332 and a plurality of blades 3334. A taper device 3336 is secured around the mill 3330 or formed integrally thereon. The taper device 3336 extends around the entire circumference of the mill 3330 beneath the blades 3334 and facilitates movement of the mill 3330 through tubulars. The taper device 3336 may be a two-piece snap-on or bolt-on device and may be made of the same material as the taper member 3306.

Figure 52:
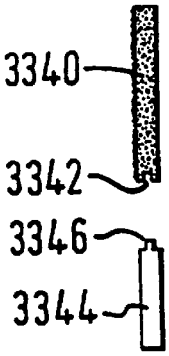
FIG. 52 is a side view of a blade with a taper member according to the present invention.

FIG. 52 shows a blade-taper member combination with a blade 3340 having a groove 3342 and a taper member 3344 with a tongue 3346. The tongue 3346 is received in the groove 3342 to facilitate securement of the taper member 3344 to the blade 3340. Optionally, an epoxy or other adhesive may be used to glue the taper member to the blade, to a mill body, or to both. The tongue and groove may be dovetail shaped.

Figure 53:
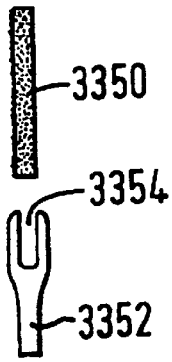
FIG. 53 is a side view of a blade with a taper member according to the present invention.

FIG. 53 shows a blade-taper member combination with a blade 3350 and a taper member 3352 with a recess 3354. The blade 3350 is received in and held in the recess 3354. Optionally an adhesive may be used to enhance securement of the taper member 3352 to the blade, to the mill, or to both.

Figure 54:
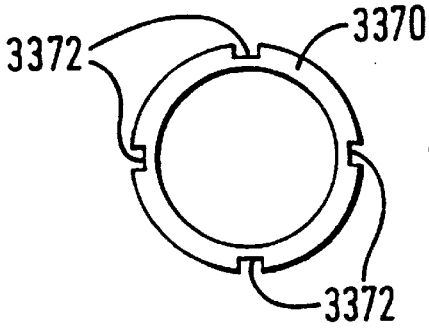
FIG. 54 is a bottom view of a mill body according to the present invention.

FIG. 54 shows a mill body 3370 (like the bodies of the mills shown in FIG. 5A, 10, and 11 of pending U.S. application Ser. No. 08/642,118 filed May 2, 1996), with a series of grooves 3372 therein which extend longitudinally on the mill body and are sized, configured, and disposed to receive and hold a taper member as shown in FIG. 50, FIG. 52, or FIG. 53. Such a mill body may be used instead of or in combination with any previously-described taper securement means.

Figure 55:
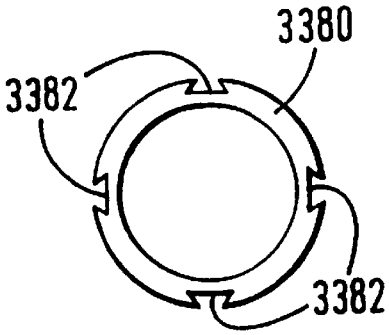
FIG. 55 is a bottom view of a mill body according to the present invention.

FIG. 55 shows a mill body 3380 (like the bodies of the mills mentioned in the previous paragraph), with a series of dovetail grooves 3382 therein which extend longitudinally on the mill body and are sized, configured, and disposed to receive and hold a taper member as shown in FIG. 50, FIG. 52, or FIG. 53. Such a mill body may be used instead of or in combination with any previously described taper securement means.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A system for making an opening in a tubular in a first wellbore in a formation, the system comprising milling means for milling the tubular, the milling means having a body and a lower nose, the lower nose having cutting apparatus at least a portion of which is covered with a bearing material to be worn away thereby exposing the cutting apparatus for cutting the tubular, the bearing material for facilitating movement of the milling means with respect to another member.

2. The system of claim 1 further comprising a sacrificial element releasably secured to the milling means and for directing the milling means against an inner surface of the tubular, the bearing material for facilitating movement of the lower nose with respect to the sacrificial element.

3. The system of claim 2 further comprising a whipstock to which is secured the sacrificial element, the whipstock for directing the milling means away therefrom toward the tubular.

4. The system of claim 3 wherein the lower nose is sized and positioned so that the lower nose does not cut the whipstock.

5. The system of claim 3 wherein the sacrificial element has at least a portion projecting upwardly beyond the whipstock so that the milling system initiates milling of the tubular prior to reaching a top of the whipstock.

6. The system of claim 2 wherein the sacrificial element has at least one recess therein for reducing the amount of the sacrificial element remaining following milling of the sacrificial element by the milling means.

7. The system of claim 6 wherein the at least one recess is a series of a plurality spaced apart recesses.

8. The system of claim 7 wherein the series of a plurality of spaced apart recesses includes recesses at angles to each other forming a plurality of projections projecting from the sacrificial element.

9. The system of claim 1 further comprising a whipstock connected to the milling means for directing the milling means away therefrom toward the tubular.

10. The system of claim 1 wherein the milling means is suitable for cutting a completed window through the tubular in a single trip of the system into the wellbore.

11. The system of claim 10 wherein the cutting apparatus is also suitable for cutting a second wellbore beyond the window into the formation.

12. The system of claim 11 wherein the second wellbore is five feet or less in length.

13. The system of claim 11 wherein the second wellbore is two feet or less in length.

14. The system of claim 11 wherein the second wellbore is at least fifty feet in length.

15. The system of claim 11 wherein the second wellbore is at least one hundred feet in length.

16. The system of claim 11 wherein the milling means is a full gauge milling means so that the second wellbore is of a substantially uniform diameter along its entire length.

17. A system for making an opening in a tubular in a first wellbore in a formation, the system comprising milling means for milling the tubular, the milling means having a body and a lower nose, the lower nose having cutting apparatus covered with a bearing material to be worn away by contacting the tubular thereby exposing the cutting apparatus for cutting the tubular to form a window therethrough and a second wellbore there beyond, a sacrificial element millable by the milling means, the sacrificial element for directing the milling means against an inner surface of the tubular, the bearing material for facilitating movement of the milling means with respect to the sacrificial element, a whipstock to which is secured the sacrificial element, the whipstock for directing the milling means away therefrom, the milling means suitable for cutting a completed window through the tubular in a single trip of the system into the wellbore, the sacrificial element having at least one recess therein for reducing the amount of the sacrificial element remaining following milling of the sacrificial element by the milling means.

18. The system of claim 17 wherein the milling means is suitable for cutting a completed window through the tubular in a single trip of the system into the wellbore.

19. The system of claim 18 wherein the cutting apparatus is also suitable for cutting a second wellbore beyond the window into the formation.

20. A system for making an opening in a tubular in a wellbore in a formation, the system comprising a body, cutting apparatus on the body for cutting the tubular, and bearing material covering at least a portion of the cutting apparatus, the bearing material to be worn away by contacting the tubular thereby exposing the cutting apparatus for cutting the tubular, the bearing material for facilitating movement of the milling means with respect to another member.

21. The system of claim 20 wherein the cutting apparatus is suitable for cutting a completed window through the tubular in a single trip of the system into the wellbore.

22. The system of claim 21 wherein the cutting apparatus is also suitable for cutting a second wellbore beyond the window into the formation.

23. The system of claim 21 further comprising a sacrificial element releasably secured to the body and for directing the cutting apparatus against an inner surface of the tubular, a whipstock for directing the cutting apparatus away therefrom, the sacrificial element having at least a portion projecting upwardly beyond the whipstock so that the system initiates cutting of the tubular prior to reaching a top of the whipstock.

24. A method for forming an opening in a tubular in a first wellbore, the method comprising positioning a milling means in the tubular at a location at which an opening is desired in the tubular, the milling means for milling an opening through the tubular, the milling means having a body and a lower nose, the lower nose having cutting apparatus at least a portion of which is covered with a bearing material thereon to be worn away thereby exposing the cutting apparatus for cutting the tubular, the bearing material for facilitating movement of the lower nose with respect to another member in the tubular, and milling the opening in the tubular with the milling means.

25. The method of claim 24 further comprising exposing the cutting apparatus of the milling means by wearing away the material on the cutting apparatus so that the cutting apparatus assists in formation of the opening.

26. The method of claim 25 further comprising cutting a second wellbore beyond the opening in the tubular with the milling means.

27. The method of claim 26 wherein the second wellbore is five feet or less in length.

28. The method of claim 26 wherein the second wellbore is two feet or less in length.

29. The method of claim 26 wherein the second wellbore is at least fifty feet in length.

30. The method of claim 26 wherein the second wellbore is at least one hundred feet in length.

31. The method of claim 24 wherein the cutting apparatus includes wellbore drilling apparatus.

* * * * *